US006754912B1

(12) United States Patent
Hayashi et al.

(10) Patent No.: US 6,754,912 B1
(45) Date of Patent: Jun. 29, 2004

(54) HUMAN BODY CLEANER

(75) Inventors: Ryosuke Hayashi, Kitakyushu (JP); Yoshiyuki Kawahara, Kitakyushu (JP); Minoru Sato, Kitakyushu (JP); Haruo Tsutsui, Kitakyushu (JP); Michinori Yananose, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 0 days.

(21) Appl. No.: 09/890,037

(22) PCT Filed: Jan. 24, 2000

(86) PCT No.: PCT/JP00/00335

§ 371 (c)(1),
(2), (4) Date: Sep. 26, 2001

(87) PCT Pub. No.: WO00/43602

PCT Pub. Date: Jul. 27, 2000

(30) Foreign Application Priority Data

| | | |
|---|---|---|
| Jan. 25, 1999 | (JP) | 11/15336 |
| Jul. 16, 1999 | (JP) | 11/203490 |
| Oct. 13, 1999 | (JP) | 11/291238 |
| Oct. 13, 1999 | (JP) | 11/291570 |

(51) Int. Cl.[7] ..... A47K 3/022
(52) U.S. Cl. ..... 4/420.2; 4/420.4; 239/468
(58) Field of Search ..... 4/420.2, 420.4; 239/405, 468

(56) References Cited

U.S. PATENT DOCUMENTS

| | | | | |
|---|---|---|---|---|
| 2,578,392 A | * 12/1951 | Bendersky et al. | ..... | 239/468 |
| 3,195,303 A | * 7/1965 | Widell | ..... | 239/468 X |
| 4,761,837 A | * 8/1988 | Takeda | ..... | 4/420.2 X |
| 5,826,282 A | * 10/1998 | Matsumoto et al. | ..... | 4/420.4 |

FOREIGN PATENT DOCUMENTS

| | | | | |
|---|---|---|---|---|
| JP | 318623 | * 12/1989 | ..... | 4/420.4 |
| JP | 257231 | * 11/1991 | ..... | 4/420.4 |
| JP | 4231528 | * 8/1992 | ..... | 4/420.4 |
| JP | 6228999 | * 8/1994 | ..... | 4/420.2 |

* cited by examiner

*Primary Examiner*—Robert M. Fetsuga
(74) *Attorney, Agent, or Firm*—Beyer Weaver & Thomas

(57) ABSTRACT

The present invention provides a novel water spray technique that extends a cleansing area in a two-dimensional manner without moving a nozzle.

A nozzle head 170 has a water swirling chamber 171, which is located immediately below a nozzle opening 31 and connects with the nozzle opening 31 via a small-diametral connection pipe 163. The water swirling chamber 171 is formed as a hollow room having a tapered inner wall. A head flow path 34 is eccentrically connected to the water swirling chamber 171. Cleansing water flowed through the head flow path 34 into the water swirling chamber 171 swirls along the tapered inner wall of the water swirling chamber 171 as shown by the arrow SY and is sprayed from the nozzle opening 31 in a spiral (cone-shaped) form.

2 Claims, 67 Drawing Sheets

Fig.48
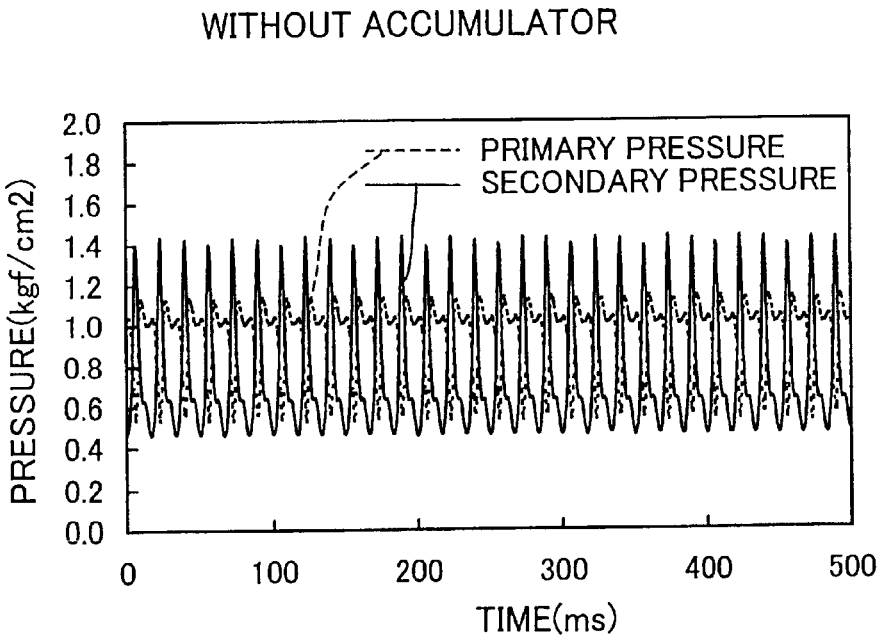
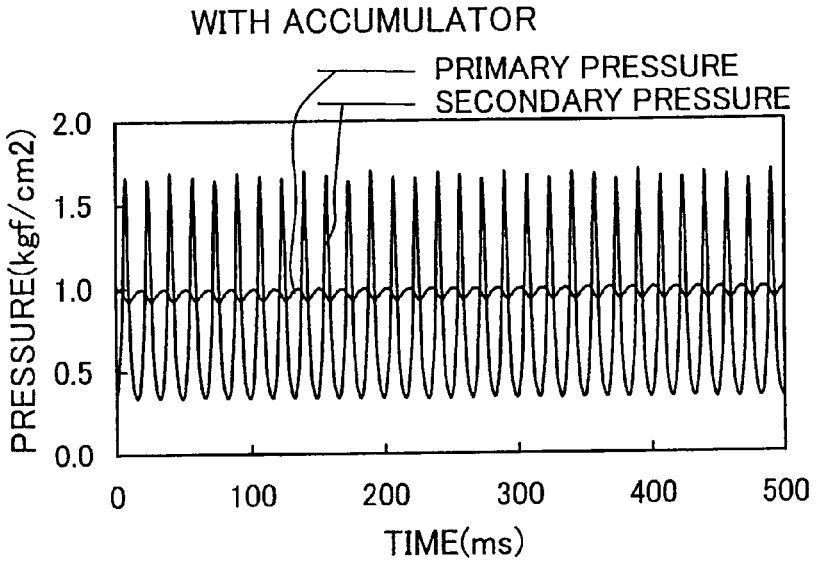

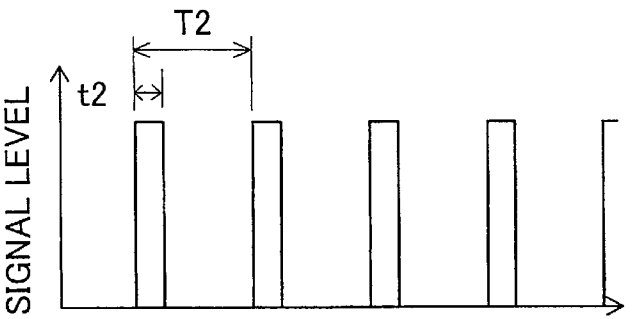
Fig.49(a)
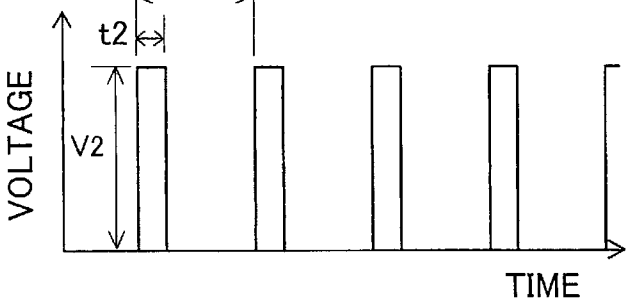
Fig.49(b)
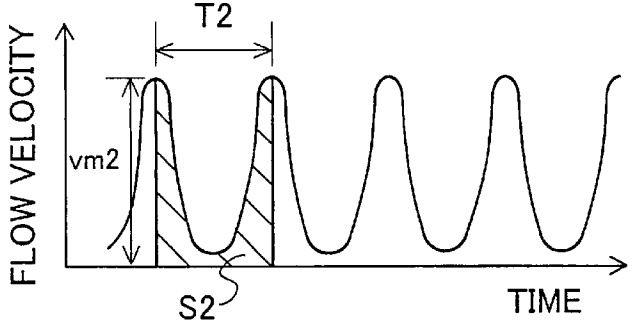
Fig.49(c)
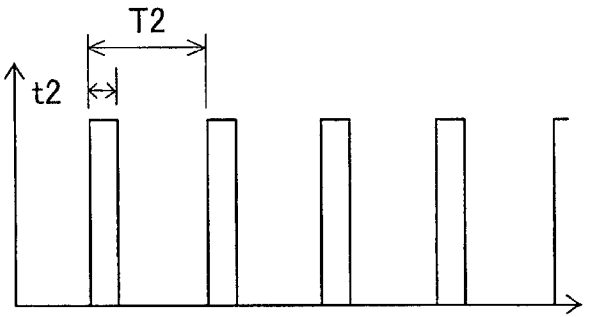
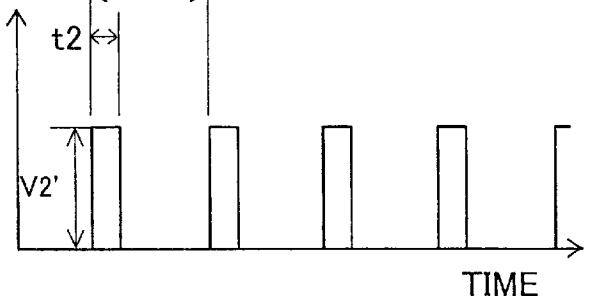
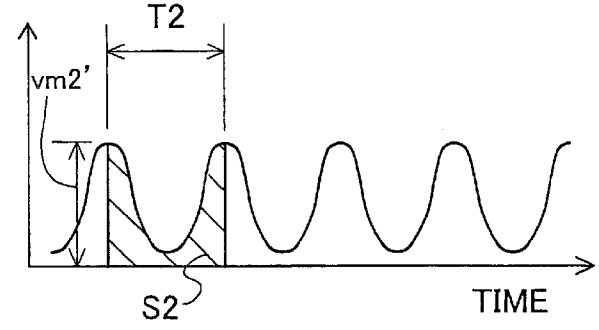

Fg. 53

HUMAN BODY CLEANER

TECHNICAL FIELD

The present invention relates to a human body cleaner that sprays cleansing water on a human body from a nozzle opening of a nozzle.

BACKGROUND ART

Human body cleaners, such as personal hygiene appliances, enable a private part of the human body to be cleaned with cleansing water and have been rapidly spread in use. A storage-type heat exchanger is typically used for such personal hygiene appliances.

The recent trend diversifies the spray form of cleansing water. One technique incorporates a fluid element in a nozzle having a nozzle opening and uses the fluid element to change over the spray direction of cleansing water between front and back or between left and right relative to the nozzle. The technique of changing over the direction of the water spray extends a target area cleansed with the spray of cleansing water (that is, a cleansing area).

Another technique intermittently sprays cleansing water and periodically varies the flow rate. The variation in flow rate has the massage effects to stimulate the movement of the bowels.

These prior art personal hygiene appliances, however, have several drawbacks discussed below.

The first drawback is described. The changeover of the direction of the water spray by the fluid element is restricted, because of the structural restraint, to one direction between front and back of the nozzle or between left and right of the nozzle. The cleansing area can thus be extended only linearly in the back and forth direction or in the left and right direction. With a view to extending the cleansing area in a two-dimensional manner, for example, in a quasi-circular shape, the changeover should be combined with the back and forth movement of or the left and right movement of the nozzle. Actuation of a nozzle driving motor is required for the movement of the nozzle. In order to attain extension of the cleansing area, additional energy should thus be consumed for driving the motor.

The following description regards the second drawback.

The storage-type heat exchanger has a large energy loss due to dissipation of heat from a hot water reservoir and accordingly takes a high running cost. An instantaneous-type heat exchanger may be used to solve this problem. In general houses, a distribution of electric power to a bathroom generally ranges from 10 to 15 amperes. This level of electric power can not ensure the sufficient heating power.

From this point of view, the flow rate of cleansing water should be decreased in the case of application of the instantaneous-type heat exchanger.

The current situation does not take any specific measures against potential troubles due to the intermittent water spray of cleansing water.

In a conduit of a non-compressed fluid like water or oil, an instantaneous cutoff of the stream of the fluid generally causes a shock in the system of the fluid. The personal hygiene appliance is no exception. The intermittent spray of cleansing water leads to the instantaneous cutoff of the stream of cleansing water. Water hammer thus occurs in the system of cleansing water. The water shock may result in damaging or deteriorating constituents of the system (for example, pipes and valves). The water shock may also cause noise like chatter or undesirable vibrations. The prior art personal hygiene appliance, which adopts the intermittent spray of cleansing water, does not take any sufficient measure against the water shock.

In the technique of spray of cleansing water in the intermittent stream, no special attention is drawn to the frequency of the intermittent water spray. The frequency is restricted to a low frequency domain of 1 to 3 Hz. Only the intermittent water spray at such a low frequency makes the user perceptible of a variation in flow rate. In order to ensure the massage effects, the prior art intermittent water spray is carried out at the low frequency of the above frequency domain. When the spray of cleansing water in the intermittent stream is applied for standard bidet-back or bidet-front, which requires the private part to be continuously cleansed with water, however, the body part is exposed to the intermittent spray of cleansing water at the low frequency.

The variation in cleansing power with time makes the user feel uncomfortable.

The present invention is accordingly directed to a novel water spray technique to solve the problems discussed above. The first object of the present invention is to provide a novel water spray technique that extends a cleansing area in a two-dimensional manner without moving a nozzle.

The second object of the present invention is to provide a novel water technique that enables a decrease in flow rate of cleansing water for standard bidet-back and bidet-front, which requires continuous cleansing with the water stream, to be compatible with reduction of potential troubles due to an intermittent stream of cleansing water.

DISCLOSURE OF THE INVENTION

At least part of the above and the other related objects is attained by a first human body cleaner that sprays cleansing water on a human body from a nozzle opening of a nozzle. The first human body cleaner includes: a water supply unit that has a flow path for feeding a supply of cleansing water therethrough to the nozzle opening; and a water swirling unit that applies a swirling force around an axial center of the nozzle opening applied to the supply of cleansing water, leads the cleansing water with the swirling force to the nozzle opening, and causes the cleansing water with the swirling force to be sprayed from the nozzle opening.

In the first human body cleaner of the present invention having the above construction, cleansing water with the swirling force around the axial center of the nozzle opening is sprayed from the nozzle opening. The cleansing water is accordingly sprayed while swirling around the axial center of the nozzle opening by the component of the swirling force (hereinafter such form of water spray is referred to as swirling water spray). The swirling force of the swirling water spray is given to the supply of cleansing water, and there is no need of specifically moving the nozzle opening or the nozzle. This arrangement attains the swirling water spray of cleansing water without any specific movement of the nozzle and thus extends the cleansing area in a two-dimensional shape defined by the swirl.

The first human body cleaner of the present invention having the above construction may be actualized by a diversity of applications as discussed below.

In accordance with one preferable application, the water swirling unit includes a variation unit that varies a degree of the swirling force applied to the supplied cleansing water.

This application enables the cleansing area by the swirling water spray to be varied with a variation in degree of the swirling force.

In accordance with another preferable application, the water swirling unit includes: a swirling chamber that is formed in the nozzle and connected with the nozzle opening; and an introduction unit that introduces the supply of cleansing water to the swirling chamber such that the cleansing water flowed into the swirling chamber swirls along an inner wall of the swirling chamber.

The introduction unit may have an eccentric conduit that is eccentrically connected with the swirling chamber and makes the cleansing water flowed into the swirling chamber.

Simple introduction of cleansing water into the water swirling chamber by means of the introduction unit applies the swirling force along the inner wall of the water swirling chamber to the supply of cleansing water, thus attaining the swirling water spray. This arrangement does not require any special electrical appliance, such as a motor, to apply the swirling force, and accordingly enhances the energy consumption efficiency. The degree of swirling force may be regulated by varying the flow velocity of cleansing water introduced into the water swirling chamber (that is, the flow velocity in the eccentric conduit).

The following arrangement may be adopted in a nozzle having at least two nozzle openings. A plurality of nozzle openings are aligned approximately along a center axis of the nozzle. Water swirling chambers corresponding to the respective nozzle openings are disposed along the alignment of the nozzle openings. Eccentric conduits connecting with the respective water swirling chambers are arranged on left and right sides across the center axis of the nozzle. This layout enables the left and right eccentric conduits to be located close to ach other via a narrow interval, thus reducing the size of the whole nozzle as well as the size of the nozzle head with the nozzle openings. Alternatively the eccentric conduits connecting with the respective water swirling chambers may be arranged vertically about the center axis of the nozzle.

In one preferable embodiment of the above application, the human body cleaner further includes an axial center-directing conduit that is connected with the swirling chamber toward an axial center of the swirling chamber and makes the cleansing water flowed into the swirling chamber. In this embodiment, the variation unit has a regulation unit that regulates flow rates of the cleansing water passing through the eccentric conduit and the axial center-directing conduit.

In the structure of this embodiment, the ratio of flow rate of the eccentric conduit to the flow rate of the axial center-directing conduit practically determines the behavior of cleansing water in the water swirling chamber. Regulation of the flow rate ratio varies the degree of swirling force and sets the cleansing area.

In accordance with another preferable application, the human body cleaner further includes an air mixing unit that mixes the air into the cleansing water, prior to the spray of the cleansing water with the swirling force from the nozzle opening.

This arrangement ensures effects due to suction of the air into cleansing water, for example, the reduced flow rate of cleansing water and the resulting enhanced water consumption efficiency and diverse clean up feeling, in addition to the advantages of the swirling water spray discussed above.

In one practical application of the human body cleaner of the present invention, the variation unit has a vibration generation unit that generates a vibrating stream, which is around a water supply pressure of the water supply unit, in the supply of cleansing water fed from the water supply unit.

The high-pressure swirling water spray occurs intermittently. This arrangement thus reduces the flow rate of cleansing water during cleansing operations, in addition to the advantages of the swirling water spray. The flow velocity of cleansing water for swirl is varied periodically. This advantageously extends the cleansing area.

In another practical application, the variation unit has a variation generation unit that generates a periodical variation in a stream of cleansing water fed from the water supply unit.

This arrangement generates a variation in the stream of cleansing water and causes the swirling stream of cleansing water with the variation to be sprayed from the nozzle opening in a periodic manner.

The periodic spray of cleansing water is attained by generating a variation in the stream of cleansing water and making the cleansing water with the variation sprayed from the nozzle opening.

The state of the stream of cleansing water led to the nozzle opening is reflected on the spray of cleansing water from the nozzle opening. In the case where a uniform flow (continuous flow) of cleansing water is led to the nozzle opening, the cleansing water is continuously sprayed from the nozzle opening to attain the water spray in the continuous stream. In the case where the varying flow of cleansing water is led to the nozzle opening, on the other hand, the cleansing water attains a periodic water spray with the variation reflected thereon. The cleansing water is accordingly led in the form of a vibrating stream to the nozzle opening. The water spray from the nozzle opening accordingly has a swirl in combination with a vibration that is reflected by the vibrating stream and varies the flow rate of water spray. At an instant in this form of the water spray, cleansing water sprayed at the high flow rate forms water masses, which are joined with each other via cleansing water sprayed at the low flow rate.

The vibrating water spray, that is, the spray of cleansing water in the vibrating stream, has a greater force against the cleansing surface or a greater instantaneous pressure peak value than the continuous stream of a fixed flow rate. The vibrating stream thus advantageously ensures the equivalent cleansing power with a lower flow rate than that of the continuous stream, while having the advantages of the swirling water spray discussed above. The lower flow rate for a desired cleansing power attains the following advantages. A further advantage is that the arrangement periodically varies the flow velocity for a swirl, thus extending the cleansing area.

In general, the human body cleaner for cleansing a private part of the human body, that is, a personal hygiene appliance, sprays warm cleansing water for the user's comfort. The smaller flow rate requires the smaller capacity of a heat source for heating the cleansing water to a preset temperature, and accordingly has a high power consumption efficiency. Namely the required heat source is a small-sized, small-capacity heater. This reduces the size of the heating mechanism and the whole size of the human body cleaner.

In the structure of generating the variation in the stream of cleansing water, one applicable procedure prevents the flow rate of cleansing water from being equal to zero.

The procedure causes no cutoff of the stream of cleansing water even at an instant, and accordingly prevents the occurrence of a water shock in the cleansing water system or at least reduces the strength of the water shock to a sufficiently small level. This arrangement accordingly prevents or at least relieves the potential troubles due to the intermittent cleansing water spray, for example, damage and deterioration of pipes, valves, and other elements included in the cleansing water system, noise like chatter, and undesirable vibrations.

The cleansing water with the variation generated therein is sprayed from the nozzle opening, while the flow rate of cleansing water does not reach zero. The spray of cleansing water with the periodic vibration ensures formation of the vibrating stream, since the flow rate is not equal to zero. The water spray from the nozzle opening has the vibration that varies the flow rate without reaching zero. In this application, the cleansing water in the vibrating stream is sprayed while being swirled.

The variation generation unit may have a change unit that changes a cycle of the variation generated in the stream of cleansing water, and the change unit may include a unit that changes the cycle of the variation regularly or irregularly.

The state of the cleansing water spray in the vibrating stream is varied by changing the cycle of the variation. This results in regularly or irregularly varying the clean up feeling and the cleansing power by the spray of cleansing water in the vibrating stream. Namely this arrangement effectively ensures diverse clean up feeling and cleansing power.

The stimulus given by the water spray in the vibrating stream is also varied. In the case of regular variation, the spray of cleansing water in the vibrating stream against the private part of the human body gives a regular variation in stimulus and has massage effects to stimulate the movement of bowels.

In the case of irregular variation, on the other hand, the user can not readily expect the variation in stimulus. This relieves monotonous clean up feeling and stimulates the movement of bowels in somewhat unconscious state.

In accordance with still another preferable application, the variation generation unit has a variation inducing unit that induces the variation in the stream of cleansing water such that a change in spray of the cleansing water with the variation induced therein is not perceptible by the human body as a variation in stimulus.

The variation inducing unit may include an induction unit that induces the variation in the stream of cleansing water at a specific frequency that is higher than a frequency range in which the human body feels a periodical stimulus as the variation in stimulus.

This arrangement enables the human body to be unperceptible of the variation in state of cleansing water spray in the vibrating stream and the variation generated in the stream of cleansing water to attain the water spray in the vibrating stream, as the variation in stimulus. This arrangement ensures generation of the variation in the stream of cleansing water, while preventing the human body from feeling the chained water masses of respective instants due to the cleansing water spray in the vibrating stream or the state of water spray in which water masses successively hit against the skin of the human body. Even in the case of the cleansing water spray in the vibrating stream, the user recognizes it as the water spray in the continuous flow. The cleansing water spray in the vibrating stream is thus preferably applicable for standard bidet-back and bidet-front, which require the continuous cleansing with water, without causing any uneasiness or discomfort.

The flow rate of cleansing water may be lowered independently of the variation in the stream of cleansing water. Even in the case of the reduced flow rate of cleansing water, this arrangement keeps the clean up feeling and comfort given by the spray of cleansing water in the vibrating stream, thus further enhancing the water consumption efficiency.

The technique discussed below may be applied to induce the variation in state of cleansing water spray in the vibrating stream. When the cycle of the cleansing water spray in the vibrating stream is about 0.3 seconds, the human body rather distinctly perceives a variation in stimulus due to the cleansing water spray in the vibrating stream. It is accordingly preferable to set the cycle of the cleansing water spray in the vibrating stream, that is, the variation in the stream of cleansing water to attain the cleansing water spray in the vibrating stream, to be not longer than 2 seconds. When the cleansing water spray in the vibrating stream is carried out at a frequency of not higher than about 3 Hz, the human body is distinctly perceptible of the variation in stimulus. The greater frequency makes the human body unperceptible of the variation in stimulus. Namely there is an unperceptible range (range of unperceptible frequency), in which the human body can not perceive the variation in stimulus. In order to make the human body unperceptible of the variation in state of water spray, it is accordingly preferable to set the frequency of the variation in the as stream of cleansing water to be not lower than about 5 Hz, which is included in the range of unperceptible frequency. The procedure of generating the variation at a specific frequency of a commercial power source is especially preferable, since this facilitates control of the equipment for generating such a variation.

Here the characteristic of this arrangement of the present invention is to intentionally making the human body unperceptible of the variation in stimulus. This arrangement makes the human body unperceptible of the variation in stimulus, whereas the massage cleansing makes the human body perceptible of some variation in stimulus (for example, a variation in stimulus based on a temperature change or a change of the flow rate) to stimulate the movement of the bowels in the course of cleansing the private part. Both the above arrangement and the massage cleansing, however, commonly carry out the intentional control of the water spray. The variation in stimulus here does not include the inevitable variation in stimulus by the water spray of cleansing water in any form, for example, the inevitable variation in frequency or cycle of the stimulus in the course of the continuous water spray.

The place hit by the spray of cleansing water (that is, the cleansing area) is, for example, anus or a female's private part. Such private parts are originally delicate skin parts, and besides the user who suffers from hemorrhoids or is in a menstrual period is especially sensitive to the stimulus. Different private parts have different degrees of sensitivity. The range of unperceptible frequency may not be restricted to the frequency domain of not lower than about 5 Hz. The minimum frequency may be regulated according to the private part to be cleansed. In a low frequency domain of the unperceptible frequency range, the user usually does not perceive the variation in stimulus in the course of cleansing the private part. The user who suffers from hemorrhoids or is in a menstrual period may, however, slightly perceive the variation in stimulus in the process of the spray of cleansing water in such a low frequency domain. The low frequency domain may thus be set as a boundary zone of the unperceptible frequency range. The frequency domain above the boundary zone is then specified as the real unperceptible frequency range. In order to ensure unperceptibleness of the variation in stimulus, the frequency domain of about 5 Hz to about 60 Hz or 80 Hz may be set as the boundary zone, and the frequency domain higher than this boundary zone may be set as the real unperceptible frequency range.

In accordance with one preferable application, the variation generation unit includes: a cylinder that forms part of the flow path of the water supply unit; a plunger that moves back and forth in the cylinder and generates a vibration in the stream of cleansing water due to the back and forth movement, so as to press the cleansing water towards downstream of the cylinder; an electromagnetic solenoid that drives the plunger back and forth; a control unit that controls excitation of the electromagnetic solenoid; and a check valve that is disposed in the plunger and allows the cleansing water to flow towards downstream.

The plunger is moved back and forth in the cylinder through control of the excitation of the electromagnetic solenoid. The back and forth movement generates a vibration in the stream of cleansing water and press feeds the cleansing water in the vibrating stream.

The check valve is disposed not in the upstream of the cylinder but only in the downstream of the cylinder. This arrangement enables the cleansing water in the vibrating stream to be led into the cylinder and press fed to the downstream, irrespective of the working state of the plunger. This arrangement accordingly prevents the flow rate of the cleansing water in the vibrating stream from being equal to zero without any specific construction or control of the movement of the plunger.

One applicable procedure controls excitation of the electromagnetic solenoid through regulation of a duty ratio and varies the duty ratio based on either one of a preset quantity of spray of cleansing water and a preset cleansing power.

This arrangement enables adjustment of the quantity of cleansing water spray and the cleansing power by regulating the duty ratio of excitation of the electromagnetic solenoid.

The variation may be generated in the stream of cleansing water, prior to application of the swirl to the cleansing water.

One applicable procedure for this purpose interrupts the stream of cleansing water in the flow path leading to the nozzle opening at a frequency of not lower than about 5 Hz and causes the interrupted stream of cleansing water to be led to the water swirling unit.

The cleansing water in the intermittent stream is accordingly sprayed from the nozzle opening. The frequency of the intermittent stream is not lower than about 5 Hz, which is included in the range of unperceptible frequency discussed above. The user receiving the spray of cleansing water in the intermittent stream accordingly does not recognize the intermittent collision of cleansing water against the skin of the human body. Even in the case of the cleansing water spray in the intermittent stream, which is one form of the intermittent water spray, the user recognizes it as the water spray in the continuous flow. The cleansing water spray in the intermittent stream is thus preferably applicable for standard bidet-back and bidet-front, which require the continuous cleansing with water, without causing any uneasiness or discomfort.

A variety of techniques may be applied to attain the water spray in the intermittent stream at the above frequency. For example, an on-off valve that connects and disconnects the flow path of the water supply unit or a flow rate-type electromagnetic pump may be used as the intermittent water spray unit. The flow rate may be varied by the interruption in a whole range of 0 to 100%. This range may be specified arbitrarily as long as it makes the user feel the intermittent stream and enhances the water consumption efficiency. One possible modification varies the flow rate in a range of 10 to 100%. Another possible modification varies the intermittent flow rate with time. Setting the frequency of the commercial power source to the frequency of interruption facilitates control of the valve or the pump.

In one preferable embodiment of the above procedure, the human body cleaner further includes a pressure regulation unit that is disposed in an upstream portion of the flow path of the water supply unit, which is located upstream the specific position where the stream of cleansing water is interrupted by the intermittent water spray unit, and varies a pressure of the cleansing water flowed through the flow path of the water supply unit to a preset level.

This arrangement regulates the pressure of cleansing water before interrupting the stream of cleansing water to attain the cleansing water spray in the intermittent stream. The pressure of the cleansing water flowed through the flow path of the water supply unit affects the flow rate of the cleansing water. The flow rate of the cleansing water spray in the intermittent stream is accordingly adjusted by regulating the pressure of cleansing water prior to interruption of the stream.

In accordance with another preferable application of the first human body cleaner of the present invention, the nozzle has a plurality of nozzle openings for different cleansing targets. The water supply unit feeds the supply of cleansing water to each of the nozzle openings. The water swirling unit gives the swirling force to the supply of cleansing water fed to each of the nozzle openings.

In accordance with still another preferable application, the human body cleaner has a plurality of nozzles, each having a nozzle opening, corresponding to different cleansing targets. The water swirling unit is provided for each nozzle.

Either of the above applications enables the swirled cleansing water to be sprayed against a different cleansing target (for example, bidet-back or bidet-front in the personal hygiene appliance) and thereby cleanse each cleansing target in a wide cleansing area. The swirling degree of cleansing water and its variable range may be set for each cleansing target. For example, in the personal hygiene appliance, the bidet-front may have the greater swirling degree to extend the cleansing area, compared with the bidet-back. This arrangement ensures the wide cleansing area for bidet-front and thus gives the sufficient clean up feeling, for example, in the menstrual period.

A turbulence may be given to the stream of cleansing water, prior to the swirl in the course of swirling water spray against each cleansing target.

One applicable procedure for this purpose changes over the destination of cleansing water in the vibrating stream or in the intermittent stream among one of the water swirling units corresponding to the respective nozzle openings or among one of the water swirling units corresponding to the respective nozzles.

This arrangement enables the swirled cleansing water in the vibrating stream or in the intermittent stream to be sprayed against and cleanse a different cleansing target. This ensures diverse clean up feeling. The frequency of the vibrating stream or the intermittent stream may be set for each cleansing target. The frequency may be set according to the characteristics of each cleansing form by taking into account the boundary zone discussed above. For example, in the personal hygiene appliance, the frequency may be set equal to about 71 Hz for standard bidet-back, equal to about 71 Hz for gentle bidet-back, and equal to about 83 Hz for bidet-front.

In another preferable embodiment of the present invention, the human body cleaner further includes: an instruction unit that gives an instruction to carry out cleansing water spray in either one of a vibrating stream and an intermittent stream; and a frequency regulation unit that varies a frequency of either one of the vibrating stream and the intermittent stream generated in response to a signal output from the instruction unit and regulates the frequency to be not lower than about 5 Hz (in the range of unperceptible frequency) at least when the water spray hits against a cleansing surface. One applicable procedure of this embodiment does not generate the vibrating stream or the intermittent stream in a non-body cleansing cycle, for example, in a nozzle pre-clean or post-clean cycle that cleans the vicinity of the nozzle opening in the initial stage of a start of cleansing or in the last stage of conclusion of cleansing or in a nozzle cleaning time. The vibrating stream or the intermittent stream may be generated at a frequency in the range of unperceptible frequency only when the cleansing water hits against the cleansing surface. One possible modification generates a vibrating stream or an intermittent stream at a frequency lower than the range of unperceptible frequency in the nozzle pre-clean cycle prior to start of cleansing the human body and raises the frequency to the range of unperceptible frequency at the subsequent body cleansing cycle. This arrangement ensures comfortable cleansing with the vibrating stream or the intermittent stream.

At least part of the above and the other related objects is also attained by a second human body cleaner that sprays cleansing water on a human body from a nozzle opening of a nozzle. The second human body cleaner includes a pressure generation unit that intermittently generates a specific pressure in the cleansing water which is higher than an ejection pressure of a water supply source.

This arrangement gives the intermittent cleansing water spray with a high pressure, thus reducing the flow rate of cleansing water in the general process of cleansing the private part.

At least part of the above and the other related objects is further attained by a third human body cleaner that sprays cleansing water on a human body from a nozzle opening of a nozzle. The third human body cleaner includes a pressure generation unit that intermittently generates a specific pressure on a output side, which is higher than a water supply pressure on a input side.

This arrangement gives the intermittent cleansing water spray with a high pressure, thus reducing the flow rate of cleansing water in the general process of cleansing the private part.

At least part of the above and the other related objects is further attained by a fourth human body cleaner that sprays cleansing water on a human body from a nozzle opening of a nozzle. The fourth human body cleaner includes a pressure generation unit that gives a vibration, which is around a water supply pressure on a input side, to cleansing water.

This arrangement gives the intermittent cleansing water spray with a high pressure, thus reducing the flow rate of cleansing water in the general process of cleansing the private part.

At least part of the above and the other related objects is also attained by a fifth human body cleaner that sprays cleansing water on a human body from a nozzle opening of a nozzle. The fifth human body cleaner includes: a water supply unit that has a flow path for feeding a supply of cleansing water therethrough to the nozzle opening; a variation generation unit that generates a variation in a stream of cleansing water; and a variation leading unit that leads the cleansing water with the variation generated therein by the variation generation unit to the nozzle opening.

The fifth human body cleaner of the present invention generates a variation in the stream of cleansing water and causes the stream of cleansing water with the variation to be sprayed from the nozzle opening in a periodic manner.

In the fifth human body cleaner of the present invention, the periodic spray of cleansing water is attained by generating a variation in the stream of cleansing water and making the cleansing water with the variation sprayed from the nozzle opening.

The state of the stream of cleansing water led to the nozzle opening is reflected on the spray of cleansing water from the nozzle opening. In the case where a uniform flow (continuous flow) of cleansing water is led to the nozzle opening, the cleansing water is continuously sprayed from the nozzle opening to attain the water spray in the continuous stream. In the case where the varying flow of cleansing water is led to the nozzle opening, on the other hand, the cleansing water attains a periodic water spray with the variation reflected thereon. In this application of the present invention, the cleansing water is accordingly led in the form of a vibrating stream to the nozzle opening. The water spray from the nozzle opening accordingly has a vibration that is reflected by the vibrating stream and varies the flow rate of water spray. At an instant in this form of the water spray, cleansing water sprayed at the high flow rate forms water masses, which are joined with each other via cleansing water sprayed at the low flow rate.

The vibrating water spray, that is, the spray of cleansing water in the vibrating stream, has a greater force against the cleansing surface or a greater instantaneous pressure peak value than the continuous stream of a fixed flow rate. The vibrating stream thus advantageously ensures the equivalent cleansing power with a lower flow rate than that of the continuous stream. The lower flow rate for a desired cleansing power attains the following advantages.

In general, the human body cleaner for cleansing a private part of the human body, that is, a personal hygiene appliance, sprays warm cleansing water for the user's comfort. The smaller flow rate requires the smaller capacity of a heat source for heating the cleansing water to a preset temperature, and accordingly has a high power consumption efficiency. Namely the required heat source is a small-sized, small-capacity heater. This reduces the size of the heating mechanism and the whole size of the human body cleaner.

In the structure of generating the variation in the stream of cleansing water in the flow path of the water supply unit, one applicable procedure prevents the flow rate of cleansing water from being equal to zero.

The procedure causes no cutoff of the stream of cleansing water even at an instant, and accordingly prevents the occurrence of a water shock in the cleansing water system including the flow path of the water supply unit or at least reduces the strength of the water shock to a sufficiently small level. This arrangement accordingly prevents or at least relieves the potential troubles due to the intermittent cleansing water spray, for example, damage and deterioration of pipes, valves, and other elements included in the cleansing water system, noise like chatter, and undesirable vibrations.

The cleansing water with the variation generated therein is sprayed from the nozzle opening, while the flow rate of cleansing water does not reach zero. The spray of cleansing water with the periodic vibration ensures formation of the vibrating stream, since the flow rate is not equal to zero. The water spray from the nozzle opening has the vibration that varies the flow rate without reaching zero.

The fifth human body cleaner of the present invention having the above construction may be actualized by a variety of applications.

In one preferable application, the variation generation unit includes a change unit that changes a cycle of the variation generated in the stream of cleansing water. Here the change unit may have a unit that changes the cycle of the variation regularly or irregularly.

The state of the cleansing water spray in the vibrating stream is varied by changing the cycle of the variation. This results in regularly or irregularly varying the clean up feeling and the cleansing power by the spray of cleansing water in the vibrating stream. Namely this arrangement effectively ensures diverse clean up feeling and cleansing power.

The stimulus given by the water spray in the vibrating stream is also varied. In the case of regular variation, the spray of cleansing water in the vibrating stream against the private part of the human body gives a regular variation in stimulus and has massage effects to stimulate the movement of bowels.

In the case of irregular variation, on the other hand, the user can not readily expect the variation in stimulus. This relieves monotonous clean up feeling and stimulates the movement of bowels in somewhat unconscious state.

In accordance with still another preferable application, the variation generation unit has a variation inducing unit that induces the variation in the stream of cleansing water such that a change in spray of the cleansing water with the variation induced therein is not perceptible by the human body as a variation in stimulus.

The variation inducing unit may include an induction unit that induces the variation in the stream of cleansing water at a specific frequency that is higher than a perceptible frequency range in which the human body is perceptible of a periodical stimulus as the variation in stimulus.

This arrangement enables the human body to be unperceptible of the variation in state of cleansing water spray in the vibrating stream and the variation generated in the stream of cleansing water to attain the water spray in the vibrating stream, as the variation in stimulus. This arrangement ensures generation of the variation in the stream of cleansing water, while preventing the human body from feeling the chained water masses due to the cleansing water spray in the vibrating stream or the state of water spray in which water masses successively hit against the skin of the human body. Even in the case of the cleansing water spray in the vibrating stream, the user recognizes it as the water spray in the continuous flow. The intermittent water spray, that is, the cleansing water spray in the vibrating stream attained by this arrangement of the present invention, is thus preferably applicable for standard bidet-back and bidet-front, which require the continuous cleansing with water, without causing any uneasiness or discomfort.

The flow rate of cleansing water may be lowered independently of the variation in the stream of cleansing water. Even in the case of the reduced flow rate of cleansing water, this arrangement keeps the clean up feeling and comfort given by the spray of cleansing water in the vibrating stream, thus further enhancing the water consumption efficiency.

The technique discussed below may be applied to induce the variation in state of cleansing water spray in the vibrating stream. When the cycle of the cleansing water spray in the vibrating stream is about 0.3 seconds, the human body rather distinctly perceives a variation in stimulus due to the cleansing water spray in the vibrating stream. It is accordingly preferable to set the cycle of the cleansing water spray in the vibrating stream, that is, the variation in the stream of cleansing water to attain the cleansing water spray in the vibrating stream, to be not longer than 2 seconds. When the cleansing water spray in the vibrating stream is carried out at a frequency of not higher than about 3 Hz, the human body is distinctly perceptible of the variation in stimulus. The greater frequency makes the human body unperceptible of the variation in stimulus. Namely there is an unperceptible range (range of unperceptible frequency), in which the human body can not perceive the variation in stimulus. In order to make the human body unperceptible of the variation in state of water spray, it is accordingly preferable to set the frequency of the variation in the stream of cleansing water to be not lower than about 5 Hz, which is included in the range of unperceptible frequency. The procedure of generating the variation at a specific frequency of a commercial power source is especially preferable, since this facilitates control of the equipment for generating such a variation.

Here the characteristic of this arrangement of the present invention is to intentionally making the human body unperceptible of the variation in stimulus. This arrangement makes the human body unperceptible of the variation in stimulus, whereas the massage cleansing makes the human body perceptible of some variation in stimulus (for example, a variation in stimulus based on a temperature change or a change of the flow rate) to stimulate the movement of the bowels in the course of cleansing the private part. Both the above arrangement and the massage cleansing, however, commonly carry out the intentional control of the water spray. The variation in stimulus here does not include the inevitable variation in stimulus by the water spray of cleansing water in any form, for example, the inevitable variation in frequency or cycle of the stimulus in the course of the continuous water spray.

The place hit by the spray of cleansing water (that is, the cleansing area) is, for example, anus or a female's private part. Such private parts are originally delicate skin parts, and besides the user who suffers from hemorrhoids or is in a menstrual period is especially sensitive to the stimulus. Different private parts have different degrees of sensitivity. The range of unperceptible frequency may not be restricted to the frequency domain of not lower than about 5 Hz. The minimum frequency may be regulated according to the private part to be cleansed. In a low frequency domain of the unperceptible frequency range, the user usually does not perceive the variation in stimulus in the course of cleansing the private part. The user who suffers from hemorrhoids or is in a menstrual period may, however, slightly perceive the variation in stimulus in the process of the spray of cleansing water in such a low frequency domain. The low frequency domain may thus be set as a boundary zone of the unperceptible frequency range. The frequency domain above the boundary zone is then specified as the real unperceptible frequency range. In order to ensure unperceptibleness of the variation in stimulus, the frequency domain of about 5 Hz to about 60 Hz or 80 Hz may be set as the boundary zone, and the frequency domain higher than this boundary zone may be set as the real unperceptible frequency range.

In accordance with one preferable application, the variation generation unit includes: a cylinder that forms part of the flow path of the water supply unit; a plunger that moves back and forth in the cylinder and generates a vibration in the stream of cleansing water by the back and forth movement, so as to press the cleansing water towards downstream of the cylinder; an electromagnetic solenoid that drives the plunger back and forth; a control unit that controls excitation of the electromagnetic solenoid; and a check valve that is disposed in the plunger and allows the cleansing water to flow towards downstream.

The plunger is moved back and forth in the cylinder through control of the excitation of the electromagnetic solenoid. The back and forth movement generates a vibration in the stream of cleansing water and press feeds the cleansing water in the vibrating stream.

The check valve is disposed not in the upstream of the cylinder but only in the downstream of the cylinder. This arrangement enables the cleansing water in the vibrating stream to be led into the cylinder and press fed to the downstream, irrespective of the working state of the plunger. This arrangement accordingly prevents the flow rate of the cleansing water in the vibrating stream from being equal to zero without any specific construction or control of the movement of the plunger.

In one preferable embodiment of this application, the control unit has an excitation control unit that controls excitation of the electromagnetic solenoid through regulation of a duty ratio and varies the duty ratio based on either one of a preset quantity of spray of cleansing water and a preset cleansing power.

This arrangement enables adjustment of the quantity of cleansing water spray and the cleansing power by regulating the duty ratio of excitation of the electromagnetic solenoid.

In accordance with another preferable application, the variation generation unit includes: an air mixing unit that is disposed in the flow path of the water supply unit to enable the air to be introduced from outside to the flow path; and an air mixing unit that is connected with the air introduction unit and applies a variation in either one of pressure and flow rate to the air,to be forcibly supplied the air from the air introduction unit, thus generating the variation in the stream of cleansing water in the air mixing unit.

The forcible suction of the air with the variation in pressure or flow rate to the cleansing water from the air mixing unit readily generates a variation in the stream of cleansing water. The variation in the stream of cleansing water is caused by the air suction, and the air has the compressive property. The air suction effectively prevents the flow rate of the cleansing water from reaching zero and thus advantageously prevents a water hammer.

The air mixing unit may be arranged in a neighborhood of the nozzle opening. This arrangement enables the cleansing water to be sprayed immediately after the variation is applied in the stream of cleansing water by the forcible air suction. This arrangement also prevents the variation in the stream of cleansing water generated by the air suction from undesirably damping in the course of cleansing water spray.

In accordance with still another preferable application, the human body cleaner further includes a water hammer reduction unit that reduces a water hammer due to the variation which is generated in the stream of cleansing water by the variation generation unit, in an upstream portion of the flow path of the water supply unit and is disposed in the upstream of the variation generation unit.

This arrangement prevents or at least relieves the water hammer with certainty. Combination with the arrangement of preventing the flow rate of cleansing water from reaching zero further ensures the prevention or relieve of the water hammer.

The human body cleaner of the above application may further have a heater unit that is disposed in a specific portion of the flow path of the water supply unit, which is disposed in the upstream of the water hammer reduction unit, and heats the supply of cleansing water.

This arrangement protects the heater unit from the water hammer and thus prevents a turbulence from being applied in the cleansing water in the heating process. The temperature distribution in the heating process is not disturbed undesirably. This arrangement thus stabilizes the temperature distribution and facilitates the temperature control in the heating process.

The present invention is also directed to a sixth human body cleaner that sprays cleansing water on a human body from a nozzle opening of a nozzle. The sixth human body cleaner includes: a water supply unit that has a flow path for feeding a supply of cleansing water therethrough to the nozzle opening; and an intermittent water spray unit that interrupts a stream of cleansing water at a specific position in the flow path leading to the nozzle opening at a frequency of not lower than about 5 Hz and causes the interrupted stream of cleansing water to be sprayed from the nozzle opening.

The cleansing water in the intermittent stream is accordingly sprayed from the nozzle opening. The frequency of the intermittent stream is not lower than about 5 Hz, which is included in the range of unperceptible frequency discussed above. The user receiving the spray of cleansing water in the intermittent stream accordingly does not recognize the intermittent collision of cleansing water against the skin of the human body. Even in the case of the cleansing water spray in the intermittent stream, which is one form of the intermittent water spray, the user recognizes it as the water spray in the continuous flow. The cleansing water spray in the intermittent stream attained by the sixth human body cleaner of the present invention is thus preferably applicable for standard bidet-back and bidet-front, which require the continuous cleansing with water, without causing any uneasiness or discomfort.

A variety of techniques may be applied for the intermittent water spray unit that attains the water spray in the intermittent stream at the above frequency. For example, an on-off valve that connects and disconnects the flow path of the water supply unit or a flow rate-type electromagnetic pump may be used as the intermittent water spray unit. The flow rate may be varied by the interruption in a whole range of 0 to 100%. This range may be specified arbitrarily as long as it makes the user feel the intermittent stream and enhances the water consumption efficiency. One possible modification varies the flow rate in a range of 10 to 100%. Another possible modification varies the intermittent flow rate with time. Setting the frequency of the commercial power source to the frequency of interruption facilitates control of the valve or the pump.

In one preferable embodiment, the human body cleaner further includes a pressure regulation unit that is disposed in an upstream portion of the flow path of the water supply unit, which is disposed in the upstream of the specific position where the stream of cleansing water is interrupted by the intermittent water spray unit, and varies a pressure of the cleansing water flowed through the flow path of the water supply unit to a preset level.

This arrangement regulates the pressure of cleansing water before interrupting the stream of cleansing water to attain the cleansing water spray in the intermittent stream. The pressure of the cleansing water flowed through the flow path of the water supply unit affects the flow rate of the cleansing water. The flow rate of the cleansing water spray in the intermittent stream is accordingly adjusted by regulating the pressure of cleansing water prior to interruption of the stream.

OTHER APPLICATIONS OF THE INVENTION

In accordance with another preferable application of the present invention, the human body cleaner further includes:

a water spray unit that has a plurality of nozzle openings corresponding to different cleansing targets and a plurality of conduits leading to the respective nozzle openings; and a changeover unit that changes over a destination of the supply of cleansing water with either the vibration or the intermission among the plurality of conduits of the water spray unit.

In accordance with still another preferable application of the present invention, the human body cleaner further includes: a plurality of water spray units, each having a nozzle opening and a conduit leading to the nozzle opening and being provided for a different cleansing target; and a changeover unit that changes over a destination of the supply of cleansing water with either the vibration or the intermission among the conduits of the plurality of water spray units.

This arrangement enables the cleansing water in the vibrating stream or in the intermittent stream to be sprayed against and cleanse a different cleansing target. This ensures diverse clean up feeling. The frequency of the vibrating stream or the intermittent stream may be set for each cleansing target. The frequency may be set according to the characteristics of each cleansing form by taking into account the boundary zone discussed above. For example, in the personal hygiene appliance, the frequency may be set equal to about 71 Hz for standard bidet-back, equal to about 71 Hz for gentle bidet-back, and equal to about 83 HZ for bidet-front.

In another preferable embodiment of the present invention, the human body cleaner further includes: an instruction unit that gives an instruction to carry out cleansing water spray in either one of a vibrating stream and an intermittent stream; and a frequency regulation unit that varies a frequency of either one of the vibrating stream and the intermittent stream generated in response to a signal output from the instruction unit and regulates the frequency to be not lower than about 5 Hz (in the range of unperceptible frequency) at least when the water spray hits against a cleansing surface. One applicable procedure of this embodiment does not generate the vibrating stream or the intermittent stream in a non-body cleansing cycle, for example, in a nozzle pre-clean or post-clean cycle that cleans the vicinity of the nozzle opening in the initial stage of a start of cleansing or in the last stage of conclusion of cleansing or in a nozzle cleaning time. The vibrating stream or the intermittent stream may be generated at a frequency in the range of unperceptible frequency only when the cleansing water hits against the cleansing surface. One possible modification generates a vibrating stream or an intermittent stream at a frequency lower than the range of unperceptible frequency in the nozzle pre-clean cycle prior to start of cleansing the human body and raises the frequency to the range of unperceptible frequency at the subsequent body cleansing cycle. This arrangement ensures comfortable cleansing with the vibrating stream or the intermittent stream.

BRIEF DESCRIPTION OF THE DRAWINGS

FIG. 48 shows the effects of the accumulator 73;

FIG. 49 shows an exemplified control process of varying the flow rate and the flow velocity in the case of spray of cleansing water in the vibrating stream at a low velocity;

BEST MODES OF CARRYING OUT THE INVENTION

Figure 1:
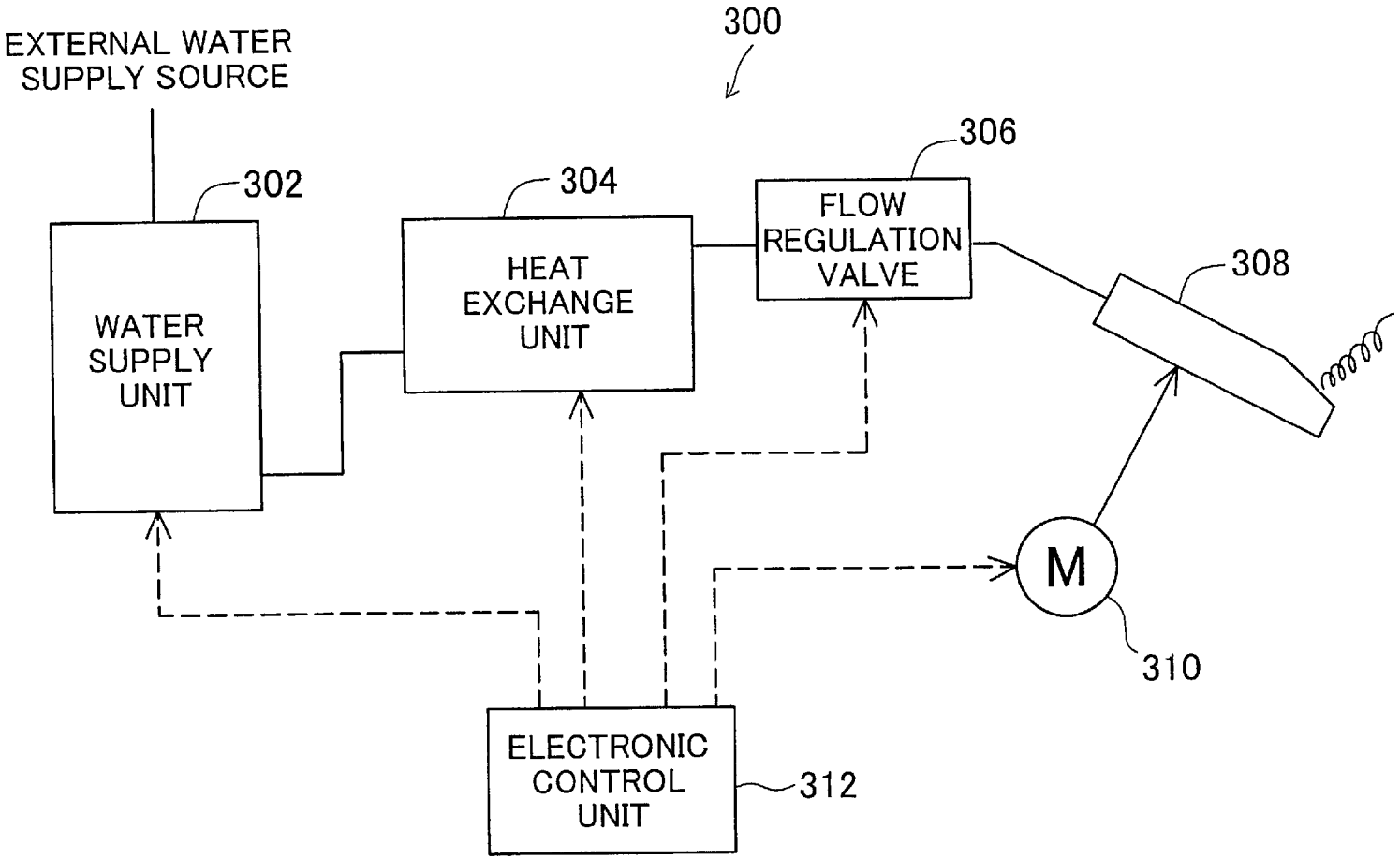
FIG. 1 is a block diagram schematically illustrating the structure of a personal hygiene appliance 300 in a first embodiment.
Figure 2:
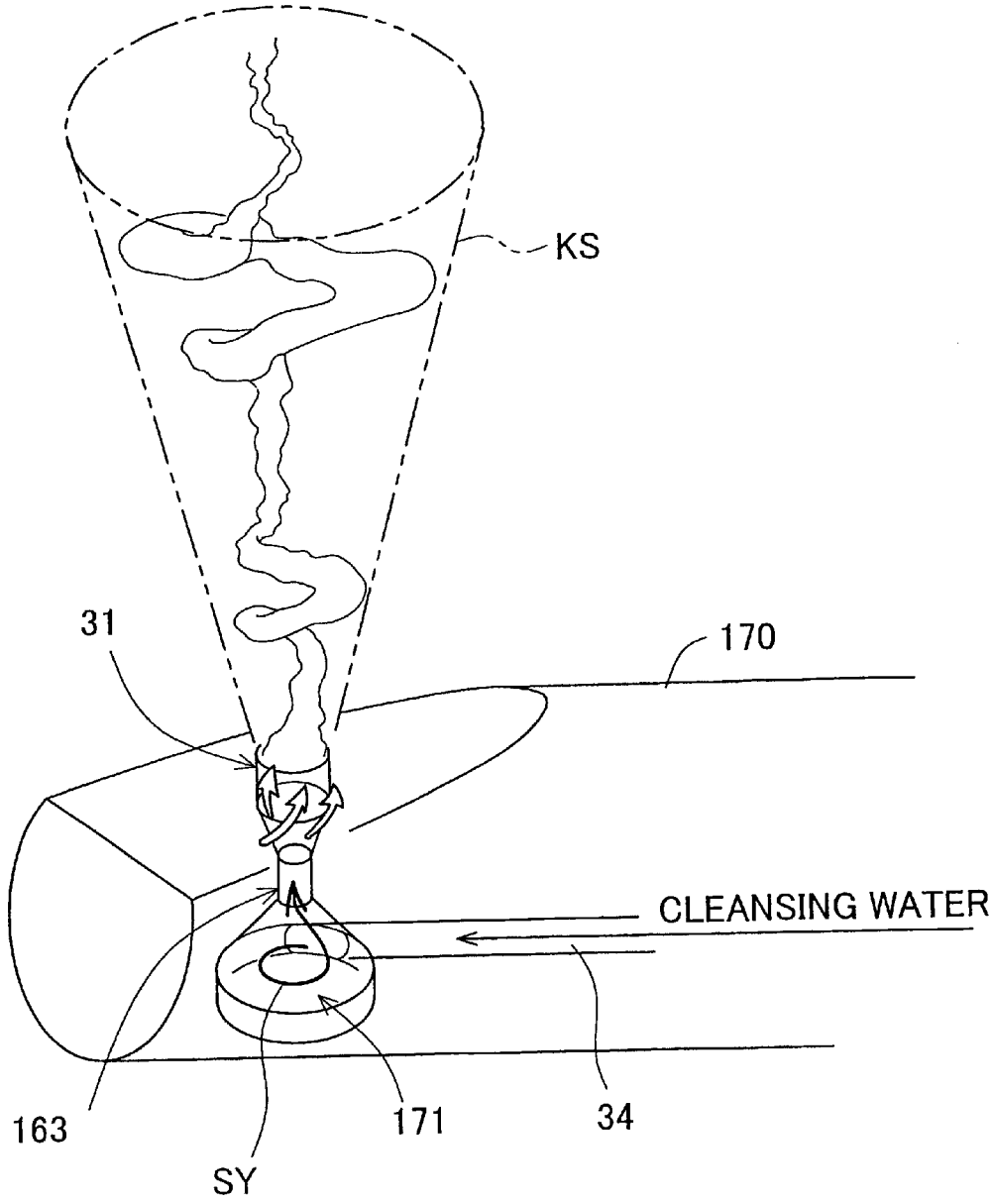
FIG. 2 is a perspective view schematically illustrating the internal structure of a nozzle head 170 of a nozzle included in the personal hygiene appliance 300.

Application of the human body cleaner according to the present invention to a personal hygiene appliance that cleanses a private part of a human body is discussed below as one embodiment. FIG. 1 is a block diagram schematically illustrating the structure of a personal hygiene appliance 300 in a first embodiment. FIG. 2 is a perspective view schematically illustrating the internal structure of a nozzle head 170 of a nozzle included in the personal hygiene appliance 300.

Referring to FIG. 1, the personal hygiene appliance 300 includes a water supply unit 302, a heat exchange unit 304, and a flow regulation valve 306, which are arranged in this sequence from the side of an external water supply source. Cleansing water having the flow rate regulated by the flow regulation valve 306 is flowed into a nozzle 308 and is sprayed from the nozzle 308 as discussed later. The nozzle 308 is moved back and forth between a standby position and a bidet-back or bidet-front position in the main body of the personal hygiene appliance, by means of a nozzle driving motor 310. The personal hygiene appliance 300 has an electronic control unit 312. The electronic control unit 312 controls the back and forth movement of the nozzle, supply and stop of cleansing water, heating of cleansing water, and the setting of the flow regulation valve, in response to operations of non-illustrated buttons like Cleanse buttons.

Cleansing water (tap water) from a water supply source (water pipe) is led to the water supply unit 302, passes through a strainer in the water supply unit 302 for trapping dust, and reaches the downstream heat exchange unit 304. The water supply unit 302 has, on its flow path, a check valve, a pressure regulation valve for pressure regulation, and a solenoid valve for opening and closing the flow path (not shown). In response to an operation of opening the circuit by the solenoid valve, cleansing water is regulated to have a predetermined pressure (primary pressure: about 0.098 MPa {about 1.0 kgf/cm$^2$}) with the pressure regulation valve and is flowed into the heat exchange unit of the instantaneous heating type. A relieve valve (not shown) is disposed in the flow path between the water supply unit 302 and the heat exchange unit 304 to prevent a heedless pressure rise in the flow path.

The heat exchange unit 304 is designed to instantaneously heat the cleansing water flowing therethrough by the power supply to an internal heater. A bimetal switch or a thermal fuse (not shown) is attached to or in the vicinity of the internal heater to mechanically cut off overheat of the heater.

The heat exchange unit 304 measures the temperatures of flow-in cleaning water and flow-out cleansing water with non-illustrated temperature sensors and heats the cleansing water to a preset temperature with the internal heater. The warm cleansing water is subjected to regulation of the flow rate by the flow regulation valve 306 and is fed to the nozzle 308. The heat exchange unit 304 is further provided with a float switch that prevents heating without water and a vacuum breaker that prevents a reverse flow of cleaning water from the nozzle.

The nozzle 308 is discussed in detail. As shown in FIG. 2, the nozzle 308 has a head flow path 34, which reaches to a nozzle head 170 and through which the flow of cleaning water from the flow regulation valve 306 passes through. The nozzle head 170 has a water swirling chamber 171 that is arranged immediately below a nozzle opening 31 and connects with the nozzle opening 31 via a small-diametral connection pipe 163. In one possible modification, the nozzle opening 31 may directly be connected with the water swirling chamber 171 without the small-diametral connection pipe 163. In another possible modification, the small-diametral connection pipe 163 may be constructed as the nozzle opening 31. Namely the nozzle opening 31 may have a cylindrical shape substantially similar to that of the small-diametral connection pipe 163.

The water swirling chamber 171 forms a hollow room having a large-diametral bottom section and a tapered inner wall extending from the bottom section toward the small-diametral connection pipe 163. The head flow path 34 is eccentrically connected to the water swirling chamber 171 as illustrated. The stream of cleansing water passing through the head flow path 34 into the water swirling chamber 171 swirls along the large-diametral inner wall and the tapered inner wall as shown by an arrow SY. The cleansing water swirled in the water swirling chamber 171 passes through the small-diametral connection pipe 163 and is sprayed from the nozzle opening 31.

The spray of cleaning water is affected by its swirling force and has a spiral (cone-shaped) form as schematically illustrated in the drawing. Namely the spray of swirled cleansing water forms a hollow cone shape KS.

In the structure of this embodiment, the water swirling chamber 171 applies the swirling force to cleansing water and causes the swirled cleansing water to be sprayed in the spiral (cone-shaped) form, thus extending the cleansing area. No movement of the nozzle opening 31 or even the nozzle 308 itself is required to extend the cleaning area. Namely this arrangement readily extends the cleansing area without any movement of the nozzle.

The swirling force of cleansing water depends upon the flow-in velocity of cleansing water into the water swirling chamber 171 (cleansing water velocity). The flow-in velocity determines the swirling degree of cleaning water in the water swirling chamber 171. Regulation of the flow-in velocity of cleansing water into the water swirling chamber 171 (cleansing water velocity), through control of the flow rate with the flow regulation valve 65 in this embodiment, thus results in controlling the spread of the spiral water spray. This structure attains the swirling water spray by simply making the stream of cleansing water flowed through the head flow path 34 into the eccentrically arranged water swirling chamber 171. This does not require any special electrical appliance, such as a motor, and thus effectively enhances the energy efficiency.

The spread of the spiral water spray defines the cleansing area and thus enables adjustment of the cleansing area. The arrangement of this embodiment allows the private part to be cleansed with a swirling water spray of various cleansing areas. The wide cleaning area gives the sufficient clean up feeling, whereas the narrow cleansing area with the swirling water spray ensures the stimulus and the enema-like action.

The fluctuating variation in cleansing area may be attained by iteratively changing the swirling degree of water spray (the spread of the spiral water spray) or more specifically by iteratively varying the cleansing water velocity. This arrangement ensures a diversity of clean up feeling due to the fluctuating variation in cleansing area and gives the massage effects.

A diversity of techniques other than the use of the flow regulation valve may be applied to vary the cleaning water velocity.

Figure 3:
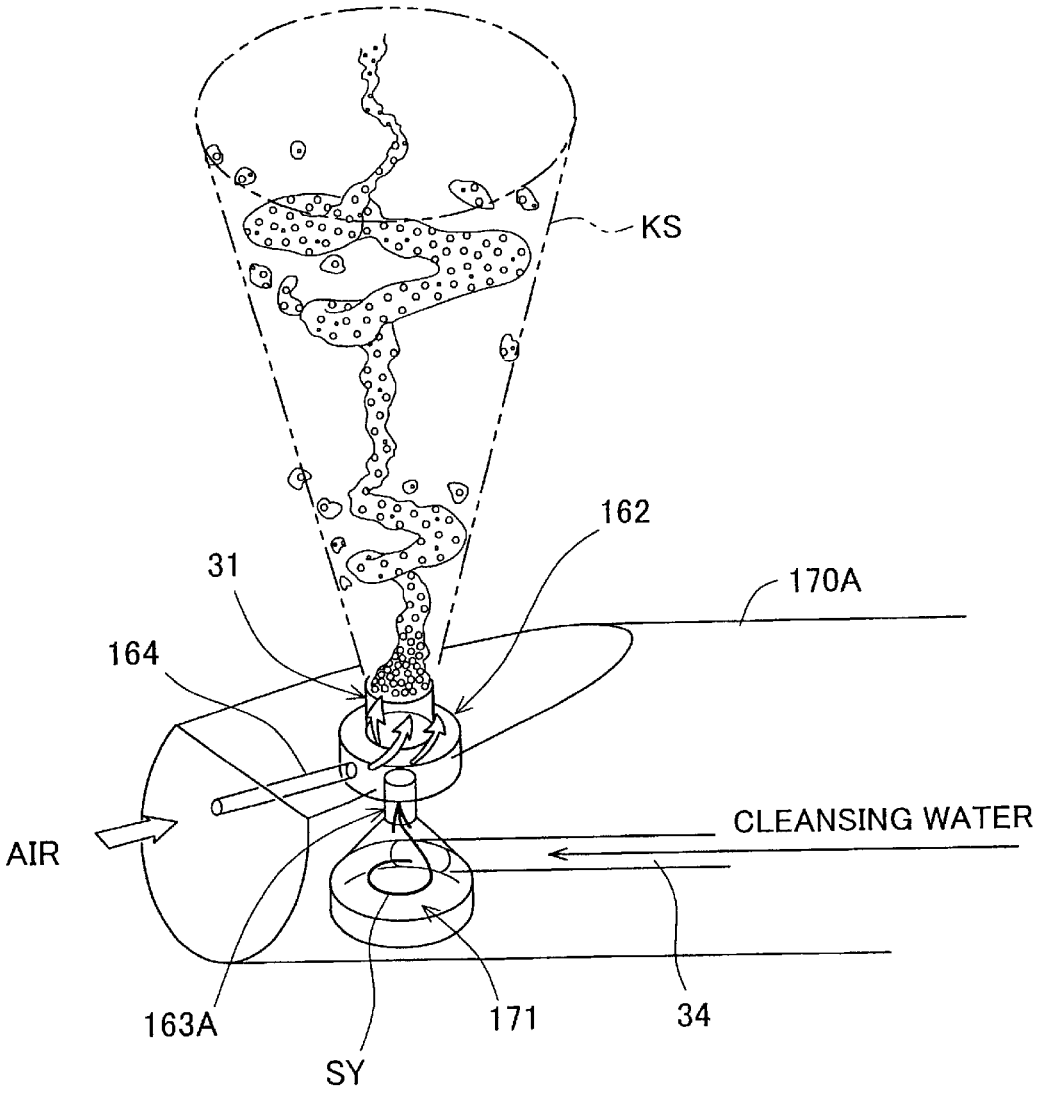
FIG. 3 is a perspective view schematically illustrating the inner structure of a nozzle head 170A in a second embodiment.

The following describes another embodiment (second embodiment) where the air is supplied into the spray of swirled cleansing water. FIG. 3 is a perspective view schematically illustrating the inner structure of a nozzle head 170A in the second embodiment.

Referring to FIG. 3, like the nozzle head 170 discussed above, the nozzle head 170A of the second embodiment has the water swirling chamber 171 to which the head flow path 34 is eccentrically connected. In the nozzle head 170A, the small-diametral connection pipe 163 is constructed as an orifice 163A that connects the water swirling chamber 171 with the nozzle opening 31. An air suction chamber 162 and an air conduit 164 are disposed upstream downstream the orifice 163A. In the nozzle head 170A, the orifice 163A faces the nozzle opening 31 across the air suction chamber 162, and the air is introduced through the air conduit 164 to the air suction chamber 162. In the nozzle head 170A, ajet pump is accordingly constructed, where the stream of cleansing water passing through the orifice 163A is a driving fluid, the air introduced through the air conduit 164 is a driven fluid, and the nozzle opening 31 is a throat. The details of the water swirling chamber 171 are identical with those discussed above with regard to the nozzle head 170.

In this nozzle head 170A, the stream of cleansing water flowed through the head flow path 34 into the eccentrically arranged water swirling chamber 171 swirls along the tapered inner wall as shown by the arrow SY. The swirled cleansing water passes through the orifice 163A and the air suction chamber 162 and is sprayed from the throat (nozzle opening 31) with a large quantity of supplied air.

As in the case of the nozzle head 170, the spray of cleansing water is affected by its swirling force and has a spiral form. In this embodiment, the spray of cleansing water in the spiral form is mixed with the spontaneously supplied air. As discussed previously, the cleansing water velocity defines the swirling degree of cleansing water as well as the air mixing rate. Regulation of the flow-in velocity of cleansing water into the water swirling chamber 171 (the cleansing water velocity) accordingly adjusts both the cleansing area and the air mixing rate. The arrangement of the second embodiment enables the water spray of various cleansing areas and diverse air mixing rates, thus ensuring comfortable and soft clean up feeling.

In the structure of the second embodiment, the orifice 163A is arranged in the direction of the spray of cleansing water, thereby relieving the damping of the water pressure. The function of the jet pump increases the quantity of air suction. This arrangement reduces the required quantity of cleansing water by the increase in quantity of air suction to enhance the water consumption efficiency, while ensuring the clean up feeling of improved softness. Since the orifice 163A is formed in the direction of the spray of cleansing water, there is no bending of the flow path in the downstream of the orifice, which accordingly causes no collision of cleansing water. This arrangement is thus free from the energy loss and does not lower the flow velocity.

FIG. 3 shows an instant of the spray of cleansing water. In the actual water spray, this state continues to form the hollow cone shape KS of cleansing water as discussed in FIG. 2.

The following describes the power of air suction in the nozzle head 170A of the second embodiment.

Figure 4:
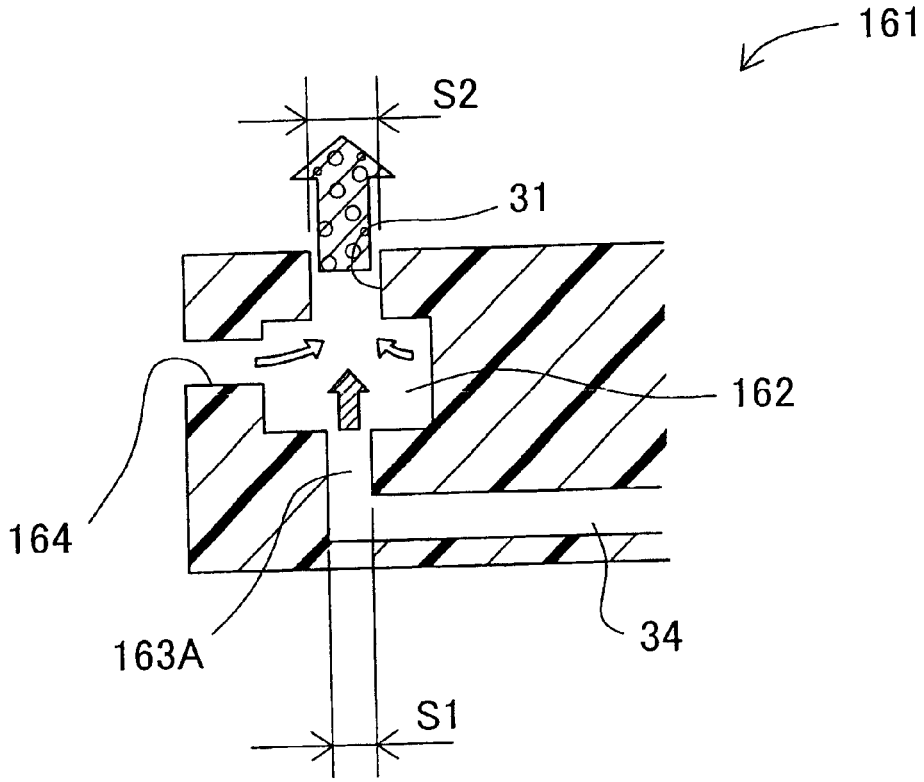
FIG. 4 schematically illustrates a nozzle head 161 as a comparative example of the nozzle head 170A.

FIG. 4 schematically illustrates a nozzle head 161 as a comparative example of the nozzle head 170A. The nozzle head 161 of the comparative example has the similar construction to that of the nozzle head 170A, except the absence of the water swirling chamber 171. In the nozzle head 161, the orifice 163A, the air conduit 164, and the nozzle opening 31 functioning as the throat form a jet pump.

Figure 5:
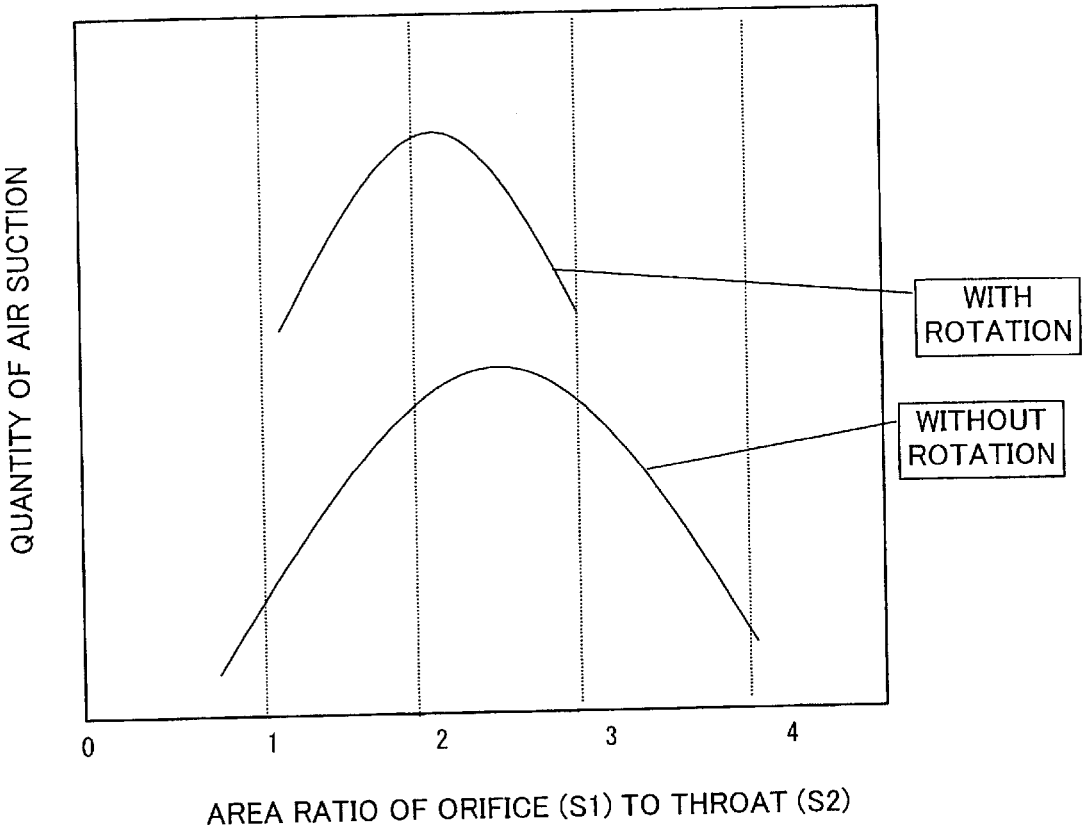
FIG. 5 is a graph showing air suction characteristics of the nozzle head 170 and the nozzle head 161 of the comparative example.

With regard to the nozzle head 170A of the second embodiment and the nozzle head 161 of the comparative example, the quantity of air suction was measured against the area ratio (S2/S1) of an orifice diameter S1 to a throat diameter S2. The quantity of air suction was expressed by the ratio of the air to the water (the air mixing rate %) and was plotted with regard to each nozzle head. This gives the results shown in the graph of FIG. 5. In the nozzle head 161 of the comparative example without the water swirling chamber, the quantity of air suction varies from 40% to 80% in a range of the area ratio of 1 to 4. The nozzle head 170A increases the quantity of air suction by about 1.3 to 2 times, compared with the nozzle head 161 of the comparative example. This arrangement thus advantageously enhances the water consumption efficiency and ensures the clean up feeling of improved softness. The preferable area ratio ranges from 1.2 to 3 for the desirable increase in quantity of air suction. The quantity of air suction was measured in the following manner. A hot-wire air flow meter was connected to an air inlet, and the flow rate of the air was directly measured. The air mixing rate was calculated from the observed flow rate of the air and the flow rate of water supplied to the nozzle, and was plotted as the quantity of air suction in the graph of FIG. 5.

Figure 6:
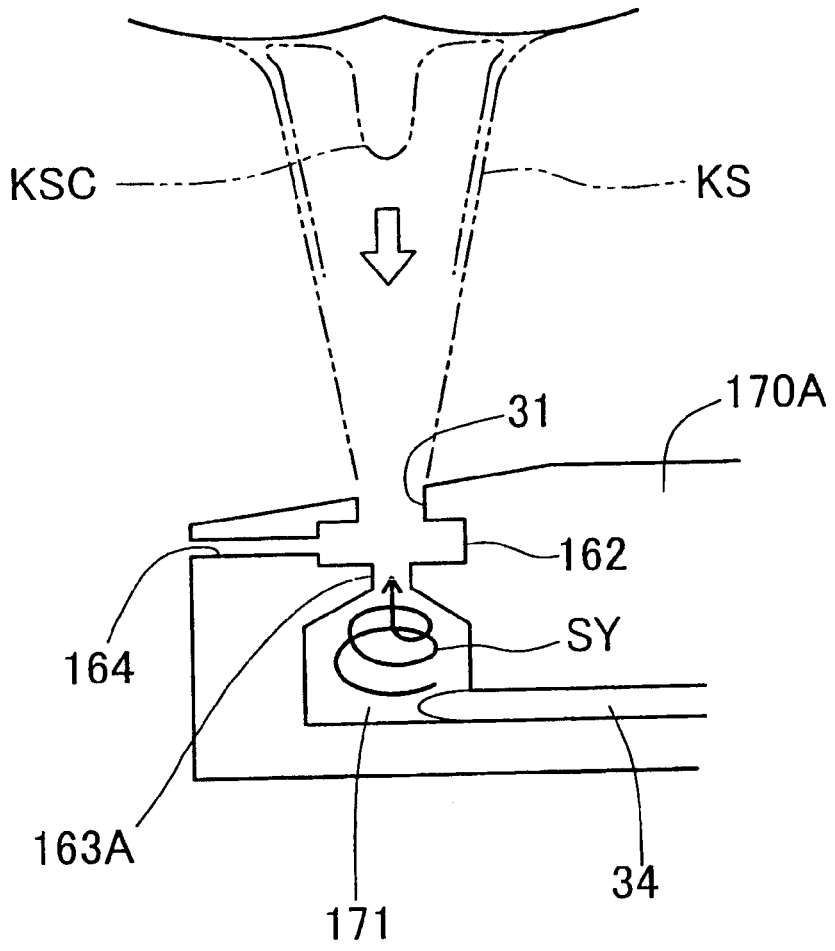
FIG. 6 schematically illustrates a process of spray of cleansing water from the nozzle head 170A.

The nozzle head 170A has the water spray in the cone shape KS as shown in FIG. 6. The water sprayed from the nozzle head 170A hits against a body cleansing surface around the center thereof. This enables the body cleansing surface to be cleansed while the dirt on the body cleansing surface is restricted in the cone shape KS, thus enhancing the cleansing efficiency. In the water spray of the cone shape KS, cleansing water is not simply spread but is subjected to rotation (swirl) along the outer face of the cone shape. This causes air suction into the cone shape as shown by the open arrow and forms a suspended portion KSC on the approximate center of he body cleansing surface, where the cleansing water hit against the body cleansing surface suspends in a quasi-columnar shape. This arrangement enables cleansing water to hit against and cleanse the body cleansing surface, while to cleanse the center of the body cleansing surface with its suspended portion KSC. This explanation is also adopted in the nozzle head 170 shown in FIG. 2.

The spiral form of water spray and the air suction are attained by simply introducing a continuous stream of cleansing water to each of the nozzle heads 170 and 170A shown in FIGS. 2 and 3 as in the case of the prior art personal hygiene appliance. By simply supplying a continuous stream of cleansing water to one of such nozzle heads at a flow rate regulated with a flow regulation valve, the arrangement of the nozzle head enables the water spray with wide variations in cleansing area and quantity of air suction, thus ensuring the comfortable and soft clean up feeling imple replacement of a nozzle head attached to an existing personal hygiene appliance, which has the water spray of a continuous stream, with this nozzle head 170 or 170A readily improves the existing personal hygiene appliance to ensure the comfortable and soft clean up feeling.

The nozzle heads 170 and 170A have further advantages discussed below.

The force of cleansing water F, which is sprayed from the nozzle opening and hits against the body cleansing surface, is expressed by an equation given below. Here p denotes the density of cleansing water, V the velocity of water spray, ρ the quantity of water spray, and S the area of the nozzle opening.

$$F=\rho\cdot V\cdot Q=\rho\cdot(Q^2/S)$$

In the nozzle heads 170 and 170A, the cleansing water sprayed from the nozzle opening 31 swirls and forms the cone shape KS. The cleansing water is thus not sprayed evenly from the whole area of the nozzle opening but is sprayed in a spiral form along the wall surface of the nozzle opening with substantially no spray of cleansing water from the center of the nozzle opening. In the nozzle heads 170 and 170A, the actual area of water spray S1 accordingly represents the area of the spiral form of cleansing water sprayed along the wall surface of the nozzle opening and is smaller than the area of the nozzle opening S.

While F denotes the force of cleansing water simply sprayed from the nozzle opening, F1 denotes the force of cleansing water sprayed in the cone shape KS. F1 is expressed by an equation given below and S is greater than Si, so that F1 is greater than F.

$$F1=\rho\cdot(Q^2/S1)$$

In the nozzle head 170A, the spray of cleansing water is mixed with the air, and the area occupied by the cleansing water is reduced corresponding to the quantity of air mixing. This decreases the actual area of water spray S1, while increasing the force of cleansing water F1. The structure of the nozzle head 170A ensures the greater force of cleansing water F1 under the condition of a fixed quantity of water spray Q. Namely the less quantity of water is sufficient for the required force F to cleanse the private part. The enhanced force F by simply narrowing the diameter of the water spray and raising the flow velocity makes the user feel painful. The technique of giving the swirling force and spraying the cleansing water in the spiral form, however, continuously shifts the hitting point of the cleansing water on the private part. This arrangement does not make the user feel painful, regardless of the narrowed diameter of the water spray and the raised flow velocity.

The structure of giving the swirling force to the cleansing water is the main factor to decrease the actual area of water spray S1 and increase the force of cleansing water F1. The arrangement of giving the swirl to the cleansing water, that is, the application of the nozzle head 170, enhances the water consumption efficiency. The nozzle head 170A with the air suction sprays the water mixed with the air and ensures the softer clean up feeling. The nozzle head 170A accordingly has the effects of the enhanced water consumption efficiency and the softer clean up feeling.

A mechanism of forcible air suction, for example, using an air pump may be applied to the nozzle head 170A. For this purpose, the orifice 163A may be composed of a porous cylindrical body, and the air is forcibly introduced into the inner flow path of the cylindrical orifice. This increases the quantity of air mixing and thus ensures the softer clean up feeling. In this case, the air pump may be used to vary the swirling force. The increase in quantity of air mixing narrows the actual flow path of cleansing water and raises the flow velocity of cleansing water. Adjustment of the output of the air pump thus results in varying the flow velocity.

Figure 7:
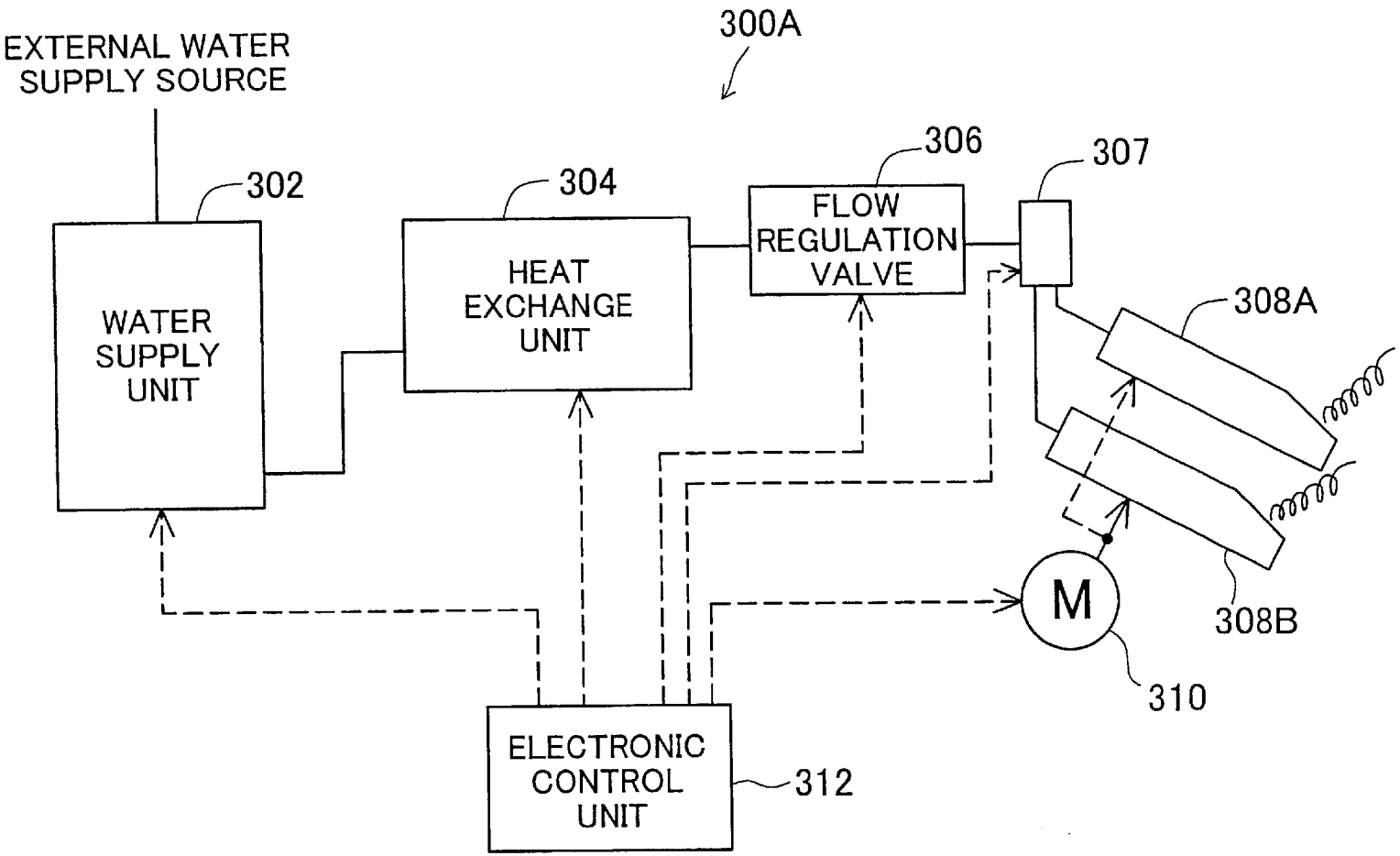
FIG. 7 is a block diagram schematically illustrating the structure of a personal hygiene appliance 300A in a third embodiment.

The following description regards a third embodiment of the present invention, which has separate nozzles for bidet-back and bidet-front. FIG. 7 is a block diagram schematically illustrating the structure of a personal hygiene appliance 300A of the third embodiment. In this personal hygiene appliance 300A, a flow path changeover valve 307 is disposed downstream the flow regulation valve 306 to supply a stream of cleansing water with the regulated flow rate to either one of nozzles 308A and 308B. The nozzle driving motor 310 moves the nozzle 308A for bidet-back between its stand-by position and the bidet-back cleansing position, while moving the nozzle 308B for bidet-front between the stand-by position and the bidet-front cleansing position. A flow regulation changeover valve that simultaneously carries out the flow regulation and the switchover of the flow path may replace the combination of the flow regulation valve and the flow path changeover valve.

Each of the nozzles 308A and 308B may have the nozzle head 170 without the air suction or alternatively the nozzle head 170A with the air suction. In a further modification, one of the nozzles has the nozzle head 170 without the air suction, whereas the other nozzle has the nozzle head 170A with the air suction.

The structure of the third embodiment uses the separate nozzles for bidet-back and bidet-front and sprays the swirled cleansing water from these nozzles, thus ensuring the wide cleansing area in both the bidet-back and the bidet-front. The bidet-front may have the greater swirling degree and the wider cleansing area than the bidet-back. This arrangement ensures the wide cleansing area for bidet-front and thus gives the sufficient clean up feeling, for example, in the menstrual period. The cleansing water is introduced into the water swirling chamber 171 of each nozzle with a fixed cleansing area, that is, at a fixed flow velocity of cleansing water. This facilitates control of the flow velocity in each nozzle.

Figure 8:
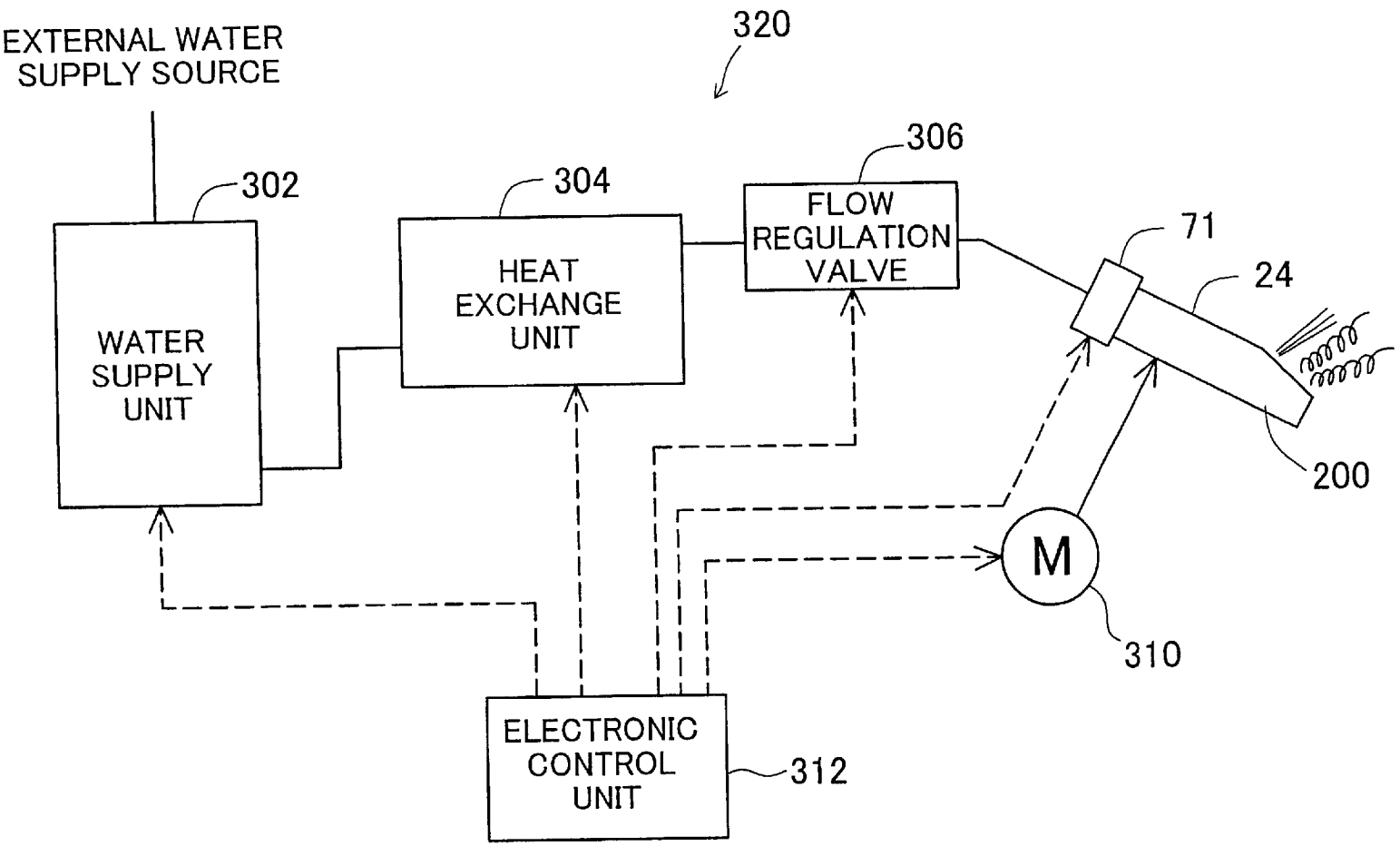
FIG. 8 is a block diagram schematically illustrating the structure of a personal hygiene appliance 320 in a fourth embodiment.
Figure 9:
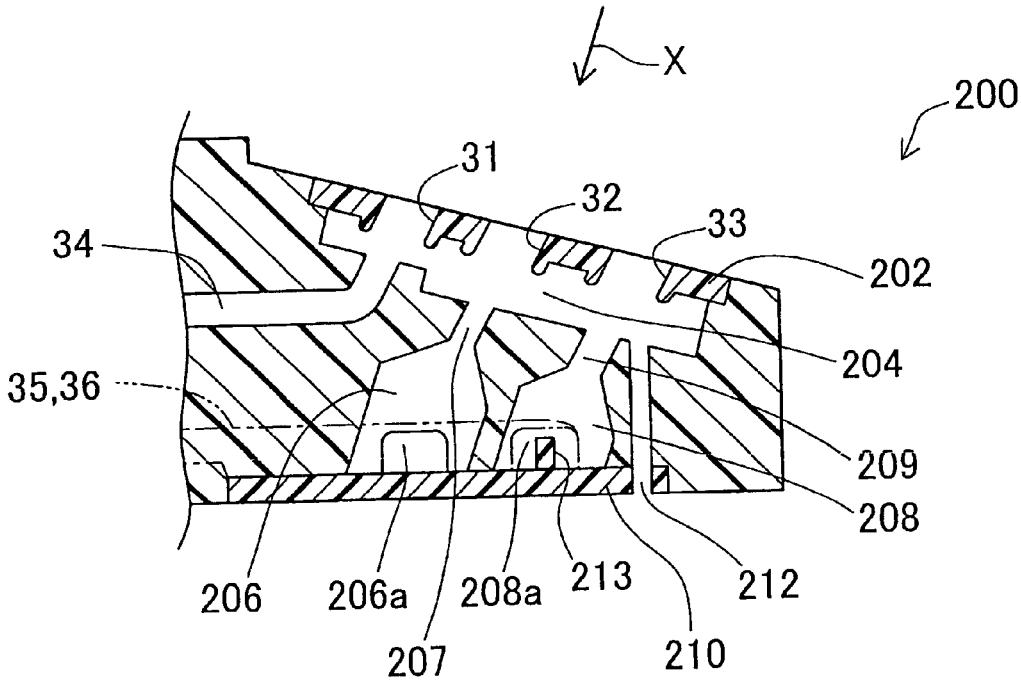
FIG. 9 is a sectional view schematically illustrating the structure of the main part of a nozzle head 200 in the fourth embodiment.
Figure 10:
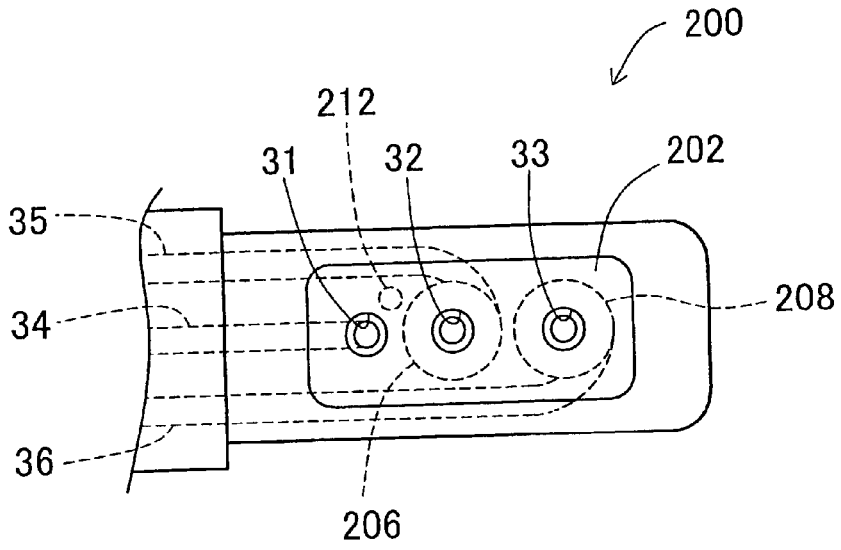
FIG. 10 is a perspective view of the nozzle head 200 taken in the direction X.
Figure 11:
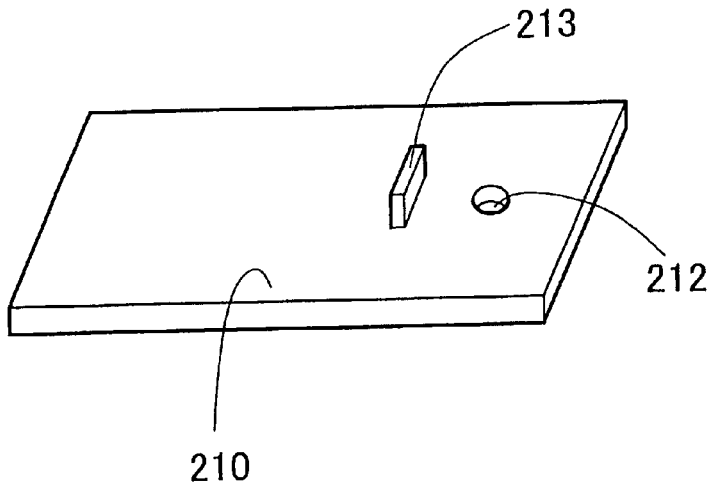
FIG. 11 is a perspective view illustrating a bottom cover 210 of the nozzle head 200.

The following describes still another embodiment (fourth embodiment) that has the water spray in the spiral form using the water swirling chamber 171 discussed above with regard to the nozzle heads 170 and 170A. The fourth embodiment has different nozzle openings for bidet-back and bidet-front formed in a single nozzle, and sprays the swirled cleansing water for bidet-back and bidet-front. FIG. 8 is a block diagram schematically illustrating the structure of a personal hygiene appliance 320 of the fourth embodiment. FIG. 9 is a sectional view schematically illustrating the structure of the main part of a nozzle head 200 in the fourth embodiment. FIG. 10 is a perspective view of the nozzle head 200 taken in the direction X. FIG. 11 is a perspective view illustrating a bottom cover 210 of the nozzle head 200.

As shown in FIG. 8, the personal hygiene appliance 320 of the fourth embodiment has a nozzle 24 and a flow path changeover valve 71 integrally attached to one end of the nozzle, in addition to the water supply unit 302 and the other constituents discussed above.

The nozzle 24 has three inner flow paths. Cleansing water flows through each flow path and is sprayed from each nozzle opening formed in the nozzle head 200 for bidet-back and bidet-front. The flow path changeover valve 71 is a disc-type changeover valve, which opens one of the three flow paths in the nozzle and introduces the cleansing water with the regulated flow rate to the open flow path.

Referring to FIGS. 9 and 10, the nozzle head 200 has nozzle openings 31 to 33 for standard bidet-back, gentle bidet-back, and bidet-front, which are formed in an upper cover 202 attached to the upper face of the nozzle head 200. The upper cover 202 is detachably attached to the nozzle head 200. There are a plurality of different upper covers with different diameters of the respective nozzle openings 31 to 33. A suitable combination of the diameters of the nozzle openings can thus be selected among the plurality of options. An air gap chamber 204 is formed in the lower part of the upper cover 202 to connect with each nozzle opening. Head flow paths corresponding to the respective nozzle openings are connected with the air gap chamber 204.

A first head flow path 34 for standard bidet-back is directly connected with the air gap chamber 204 and has an end facing the nozzle opening 31 for bidet-back. A second head flow path 35 for gentle bidet-back and a third head flow path 36 for bidet-front are formed in the lower end of the nozzle as shown in FIGS. 9 and 10. The bottom cover 210 is water-tightly attached to the lower end of the nozzle head 200. The second head flow path 35 and the third head flow path 36 are respectively connected to a gentle bidet-back water swirling chamber 206 and a bidet-front water swirling chamber 208 in an eccentric manner, which are formed in the nozzle head 200 and defined as closed spaces by attachment of the bottom cover 210. As shown in FIG. 10, the second head flow path 35 goes from the right side of the nozzle head 200 to the gentle bidet-back water swirling chamber 206. Cleansing water passing through the second head flow path 35 is thus eccentrically flowed into the water swirling chamber 206 via a connection aperture 206*a*. The third head flow path 36 goes from the left side of the nozzle head 200 to the bidet-front water swirling chamber 208. Cleansing water passing through the third head flow path 36 is thus eccentrically flowed into the water swirling chamber 208 via a connection aperture 208*a*. Like the water swirling chamber 171 discussed above, these water swirling chambers 206 and 208 have large-diametral bottom sections and tapered inner walls from the bottom sections to upper-end orifices 207 and 209.

An air conduit 212 is formed in the bottom cover 210 and the end of the nozzle head 200 to connect with the air gap chamber 204 and introduce the air into the air gap chamber 204. The air is accordingly flowed through the air conduit 212 and sucked into the air gap chamber 204, while cleansing water is flowed through each of the first through the third head flow paths 34 to 36 and reaches the corresponding nozzle opening via the air gap chamber 204. In the case of gentle bidet-back and bidet-front, cleansing water is swirled in the corresponding water swirling chamber 206 or 208, passes through the orifice 207 or 209 to the air gap chamber 204, and is sprayed with a large quantity of the supplied air from the throat (the nozzle opening 32 for gentle bidet-back or the nozzle opening 33 for bidet-front). The cleansing water mixed with the air is sprayed from the nozzle opening 31 for standard bidet-back, while the cleansing water mixed with the air and swirled is sprayed from the nozzle opening 32 for gentle bidet-back and the nozzle opening 33 for bidet-front. Each cleansing process accordingly has effects discussed above, due to the air suction and the swirl of cleansing water. For convenience of explanation, the air conduit 212 is drawn at the end of the nozzle in the sectional view of FIG. 9. The air conduit 212 may alternatively extend from the lower surface of the nozzle head to be located between the adjoining nozzle openings as shown in FIG. 10.

In the nozzle head 200, the bottom cover 210 is further provided with an upright plate 213 that is located on the center of the bottom of the bidet-front water swirling chamber 208. The upright plate 213 enters the bidet-front water swirling chamber 208 and thus interferes with the swirled cleansing water in the vicinity of the center of the water swirling chamber 208. Adjustment of the dimensions of the upright plate 213, for example, the height and the width, controls the swirling state (swirling quantity) of cleansing water in the bidet-front water swirling chamber 208. The low flow rate causes unstable swirling force and much splashes in the absence of the upright plate 213. The use of the upright plate 213, on the other hand, ensures the stable swirling force and less splashes even in the case of the low flow rate. Controlling the swirling state attains the similar bidet-front with a substantially identical quantity of air suction.

Figure 12:
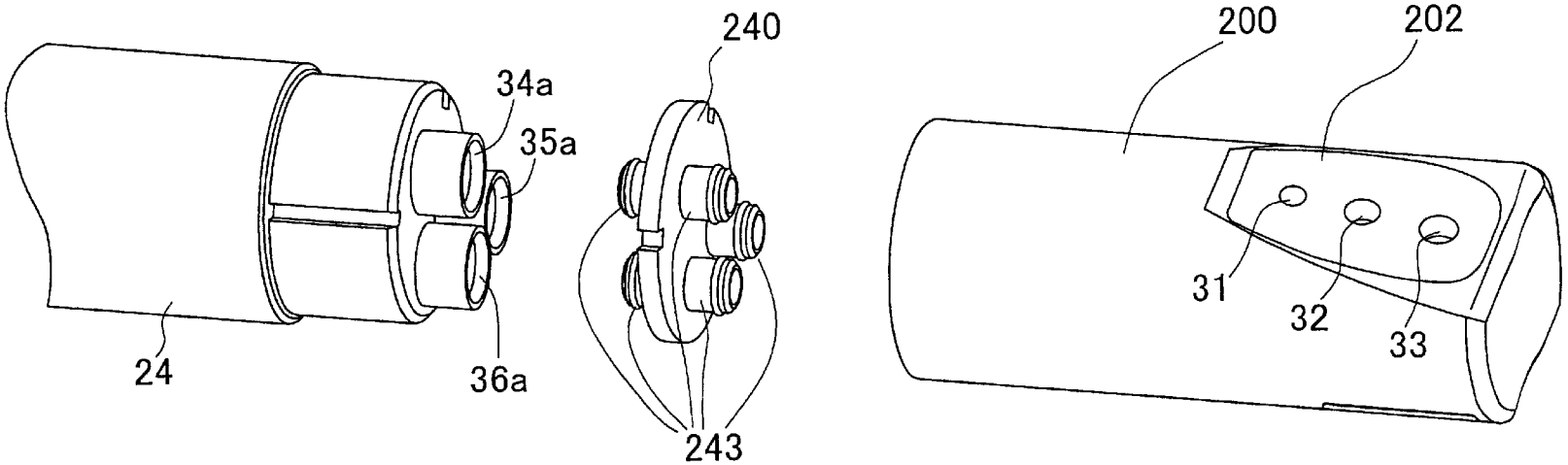
FIG. 12 is a decomposed perspective view illustrating the main part of the nozzle head 200 and a nozzle 24.
Figure 13:
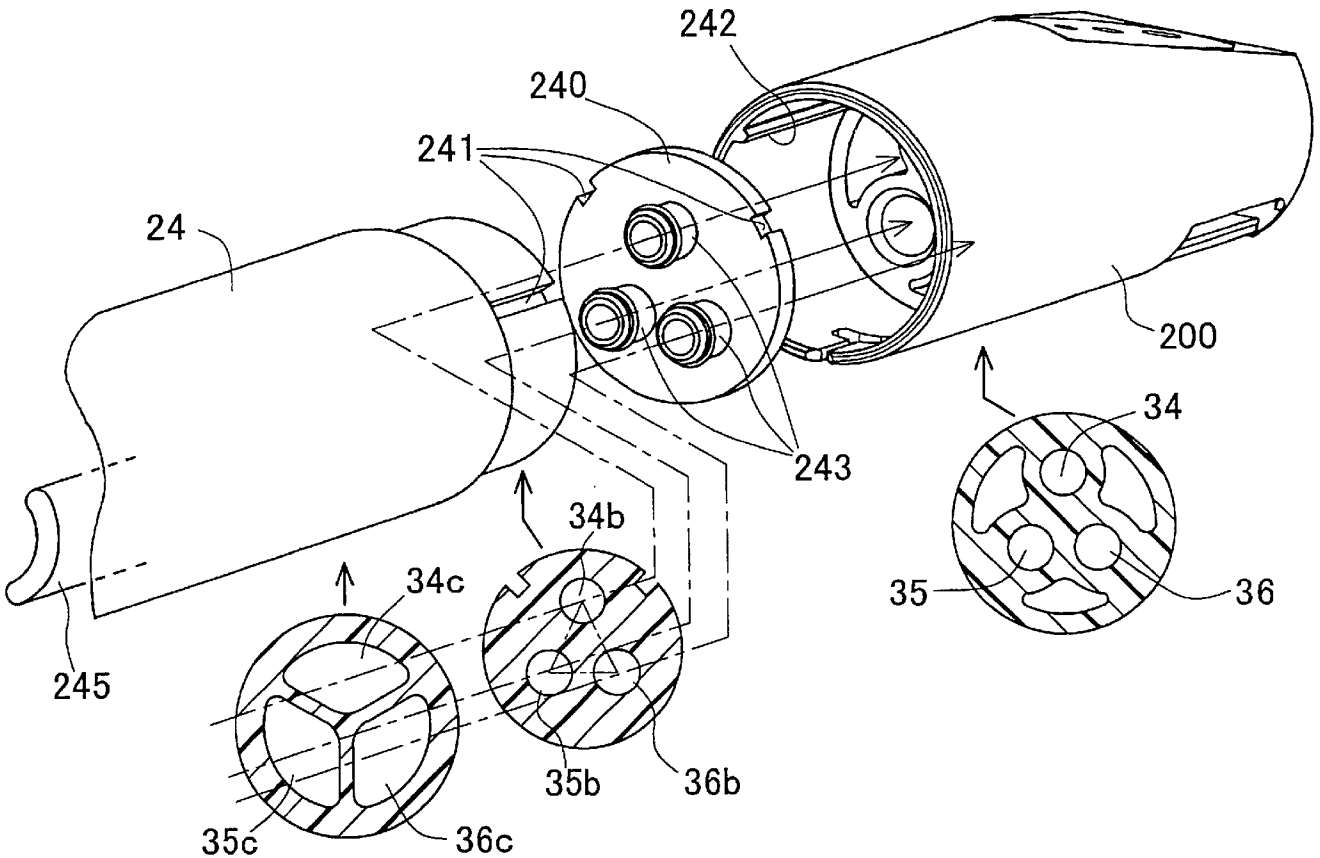
FIG. 13 is a decomposed perspective view illustrating the main part of the nozzle head 200 and the nozzle 24 seen from a different side from that of FIG. 12.

The detailed structure of the head flow paths formed in the nozzle head 200 and nozzle flow paths formed in the nozzle 24 is discussed below. FIGS. 12 and 13 are decomposed perspective views illustrating the main part of the nozzle head 200 and the nozzle 24.

As illustrated in the drawings, the nozzle head 200 is positioned at and attached to the end of the cylindrical nozzle 24 via a sealing member 240. Such positioning is attained by fitting projections 242 on the inner wall of the nozzle head 200 into grooves 241 formed in the end of the nozzle 24 and the sealing member 240.

In the nozzle head 200, the first through the third head flow paths 34 to 36 are located at respective vertexes of an isosceles triangle. The second head flow path 35 and the third head flow path 36 are positioned on both ends of the bottom side. As shown in FIG. 12, the nozzle 24 has connection conduits 34*a* to 36*a* on the free end thereof. The respective connection conduits 34*a* to 36*a* are formed at positions corresponding to the positions of the first through the third head flow paths 34 to 36. The nozzle 24 also has nozzle end flow paths 34*b* to 36*b*, which are formed in the end section thereof and connects with the connection conduits 34*a* to 36*a*, and a cylindrical section divided into three parts to form nozzle flow paths 34*c* to 36*c*. The sealing member 240 has cylindrical sealing elements 243 projected from both faces thereof to respectively receive the first through the third head flow paths 34 to 36 and the nozzle end flow paths 34*b* to 36*b* therein. The cylindrical sealing elements 243 seal the respective flow paths 34*b* to 36*b* from one another, while sealing the nozzle head 200 from the nozzle 24. The nozzle head 200 is fixed to the end of the nozzle 24, for example, by fitting non-illustrated claws in non-illustrated recesses.

The nozzle end flow paths 34*b* to 36*b* and the nozzle flow paths 34*c* to 36*c* have different shapes of cross sections. Since the nozzle 24 is a resin molded object, the nozzle end flow paths 34*b* to 36*b* are connectable with the nozzle flow paths 34*c* to 36*c* without any problem. Insertion of an arc-shaped plate member 245 (see FIG. 13) into each of the nozzle flow paths 34*c* to 36*c* to be in close contact with the curved wall of the nozzle flow path narrows the area of the nozzle flow path and enhances the flow velocity of cleansing water. In the case of gentle bidet-back via the nozzle opening 32 and the bidet-front via the nozzle opening 33, this arrangement enhances the swirling degree of cleansing water and attains the wide cleansing area, thus ensuring the sufficient clean up feeling.

Figure 14:
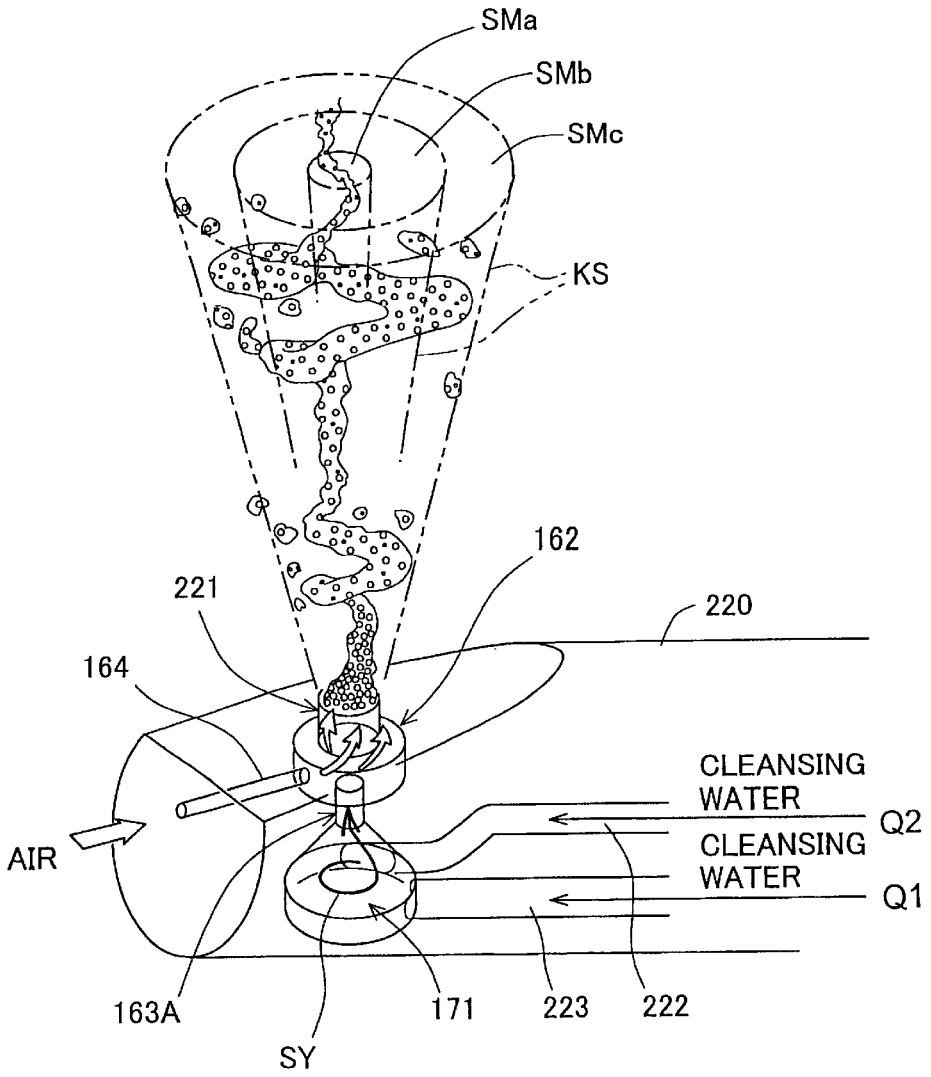
FIG. 14 is a perspective view schematically illustrating the inner structure of a nozzle head 220 in a fifth embodiment.

The following describes a fifth embodiment of the present invention, which is characterized by a variation in cleansing area. FIG. 14 is a perspective view schematically illustrating the inner structure of a nozzle head 220 in the fifth embodiment.

As illustrated in the drawing, like the nozzle head 170A discussed above, the nozzle head 220 includes a jet pump consisting of the air suction chamber 162, the orifice 163A, a nozzle opening 221 functioning as the throat, and the air conduit 164. The nozzle head 220 also has the water swirling chamber 171 disposed below the orifice 163A. The nozzle head 220 has an eccentric flow path 222, which is eccentrically connected to the water swirling chamber 171, and an axial center-directing flow path 223, which is connected to the water swirling chamber 171 with directing the axial center thereof, as cleansing water supply conduits. The nozzle head 220 is further provided with a non-illustrated cleansing water supply unit, which independently supplies cleansing water to both the eccentric flow path 222 and the axial center-directing flow path 223. The cleansing water supply unit enables supply of cleansing water only to the axial center-directing flow path 223, as well as simultaneous supply of cleansing water to both the axial center-directing flow path 223 and the eccentric flow path 222. The cleansing water supply unit regulates flow rates Q1 and Q2 of water supply in the respective flow paths. The cleansing water supply unit that allows the water supply to only the eccentric flow path 222 gives the identical structure with that of the nozzle head 170A discussed above.

The cleansing water is sprayed from the nozzle head 220 of the above construction in the following manner.

In the case of supply of cleansing water only through the axial center-directing flow path 223, cleansing water is flowed into the water swirling chamber 171 toward the axial center thereof. The stream of cleansing water flowed into the water swirling chamber 171 hardly swirls, passes through the orifice 163A, is mixed with the air in the air suction chamber 162, and is sprayed from the throat (the nozzle opening 221).

In this case, there is no swirl of cleansing water in the water swirling chamber, and the water spray accordingly has the characteristics discussed below.

(1) The quantity of air suction into the air suction chamber 162 in the absence of swirl of cleansing water is less than that in the presence of swirl of cleansing water. This results in less softer clean up feeling.

(2) The water spray does not have the cone shape KS but has a substantially cylindrical shape. This arrangement causes a narrow cleansing area SMa shown in FIG. 14 to be hardly cleansed with the cleansing water column of the cylindrical shape and the less quantity of air mixing. The water spray in the narrow cylindrical shape enables the cleansing water to forcibly enter the anus and exerts the enema-like actions in the course of bidet-back.

These phenomena also occur when the cleansing water is simultaneously supplied to both the axial center-directing flow path 223 and the eccentric flow path 222 and the flow rate Ql in the axial center-directing flow path 223>> the flow rate Q2 in the eccentric flow path 222.

The water spray has the following characteristics when the process simultaneously supplies cleansing water through both the axial center-directing flow path 223 and the eccentric flow path 222 while regulating the flow rate Q1 in the axial center-directing flow path 223 and the flow rate Q2 in the eccentric flow path 222.

In the case of regulation of the flow rates Q1 and Q2 to satisfy the relation of Q2>>Q1, the cleansing water of the high flow rate supplied through the eccentric flow path 222 practically determines the behavior of cleansing water in the water swirling chamber. The cleansing water flowed through both the flow paths into the water swirling chamber accordingly swirls in the water swirling chamber as shown by the arrow SY.

(1) The swirl increases the quantity of air suction in the air suction chamber 162 and ensures the sufficiently soft water spray.

(2) The water spray has the cone shape KS and enables a wide cleansing area SMc shown in FIG. 14 to be cleansed with water containing the large quantity of the supplied air. This gives the user the feeling of sufficiency of water stream. The water spray in the cone shape KS ensures the clean up feeling and the cleansing effects discussed above with FIG. 6.

Regulation of the flow rates Q1 and Q2 to make Q2 approach Q1 reduces the effects of cleansing water flowed through the eccentric flow path 222 on the behavior of cleansing water in the water swirling chamber. The cleansing water flowed through both the flow paths into the water swirling chamber under such regulation of the flow rates still swirls in the water swirling chamber as shown by the arrow SY but has a smaller swirling degree.

(1) The smaller swirling degree decreases the quantity of air suction in the air suction chamber 162 and reduces the softness of the water spray.

(2) The water spray still has the cone shape KS but cleanses a narrower cleansing area SMb shown in FIG. 14 with water containing the less quantity of the air.

Compared with the supply of cleansing water only through the axial center-directing flow path, this arrangement ensures the sufficient feeling of softness and the feeling of sufficiency of water stream.

In the nozzle head 220, the arrangement of simultaneous supply of cleansing water through both the flow paths and regulation of the flow rate in each flow path attains the spray of cleansing water with various settings for the quantity of air mixing, the strength of water spray, the cleansing area, and the feeling of softness. The arrangement of supply of cleansing water only through the axial center-directing flow path 223 attains the water spray that has specific settings for the quantity of air mixing, the strength of water spray, and the cleansing area and exerts the enema-like actions. Regulation of the flow rate in the case of supply of cleansing water only through the axial center-directing flow path 223 leads to variations in quantity of air mixing, strength of water spray, and cleansing area.

Another structure may be applied for the nozzle head 220 to attain the water spray of the above settings.

When the user operates a non-illustrated Bidet-Back button for standard bidet-back, cleansing water is supplied only through the axial center-directing flow path 223. The flow rate is regulated in response to operations of Water Pressure buttons. In the case of standard bidet-back, the preferable process gives a restriction to regulation of the water pressure to prevent the cleansing water column of the cylindrical shape from extremely narrowing and not to cause the enema-like actions heedlessly. An Enema button is provided separately from the standard Bidet-Back button. When the user operates the Enema button to require the enema-like actions, the cleansing water column is narrowed to exert the enema-like effects.

There are also a Soft Bidet-Back button and a Bidet-Front button. In response to operation of the Soft Bidet-Back button, the process simultaneously supplies cleansing water to both the axial center-directing flow path 223 and the eccentric flow path 222 while regulating the flow rate Q1 in the axial center-directing flow path 223 and the flow rate Q2 in the eccentric flow path 222 to make the flow rates Q1 and Q2 relatively close to each other and included in a predetermined range. In response to operation of the Bidet-Front button, the process simultaneously supplies cleansing water to both the flow paths while regulating the flow rates Q1 and Q2 to make the flow rate Q2 sufficiently greater than the flow rate Q1. The flow rate of cleansing water may be varied in the predetermined range of the relatively close flow rates Q1 and Q2 and the range of the sufficiently greater flow rate Q2 than the flow rate Q1. The water pressure may be regulated with the Water Pressure buttons in the case of gentle bidet-back and bidet-front. The flow rate or the water pressure may be varied in a periodical manner at a fixed cycle or at random cycles. This ensures the diverse clean up feeling and massage effects.

As described above, the nozzle head 220 of the fifth embodiment having a single nozzle opening enables selection of the enema-like actions and adjustment of the feeling of softness. This arrangement enables the private part to be cleansed in the different modes, that is, bidet-back, gentle bidet-back, and bidet-front, while giving different clean up feeling required for the respective cleansing modes. The structure using the single nozzle opening desirably reduces the size of the nozzle head and thereby the whole size of the appliance to be suitable for the portable use.

Figure 15:
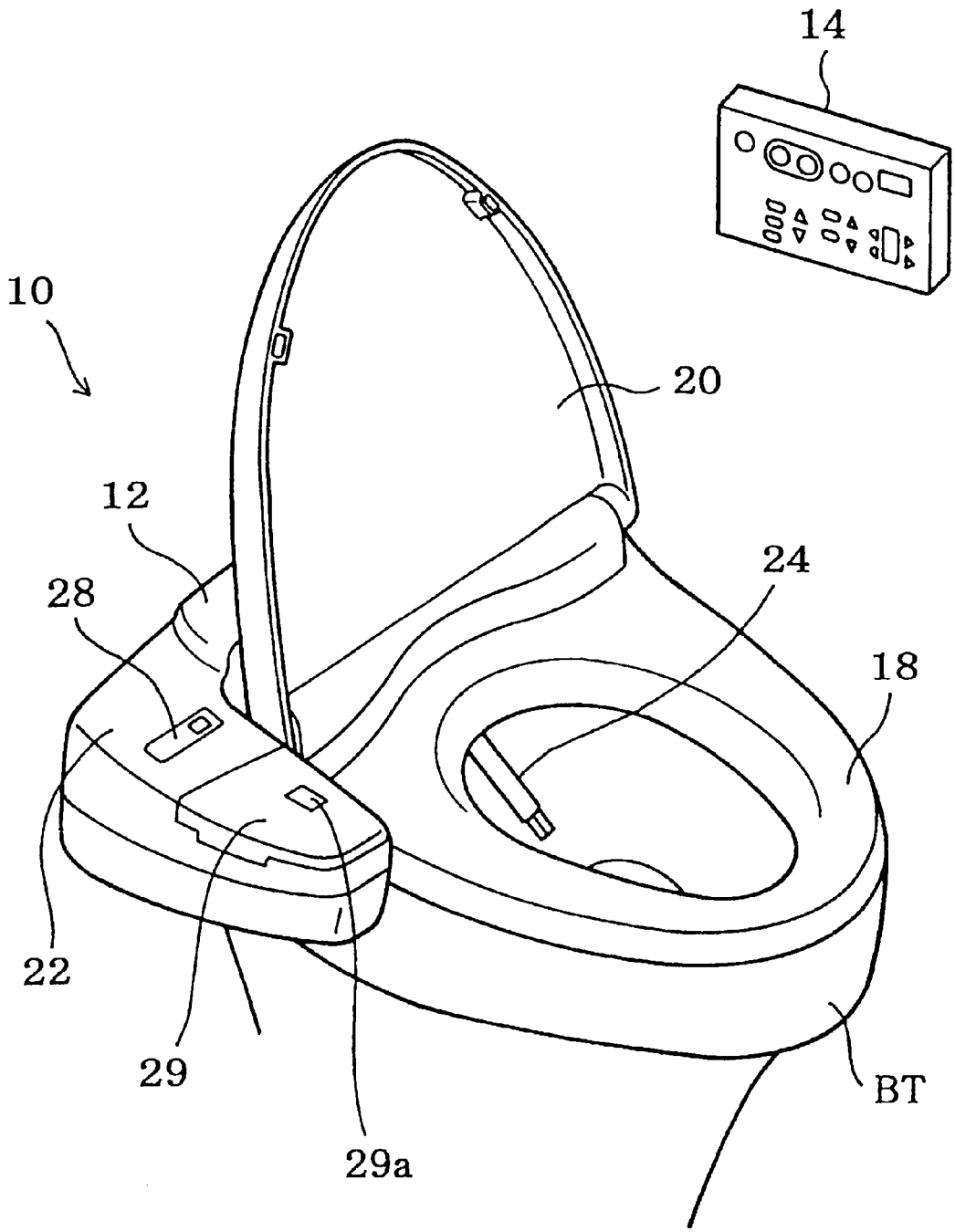
FIG. 15 is a perspective view schematically illustrating a personal hygiene appliance 10 attached to a toilet in the sixth embodiment.
Figure 16:
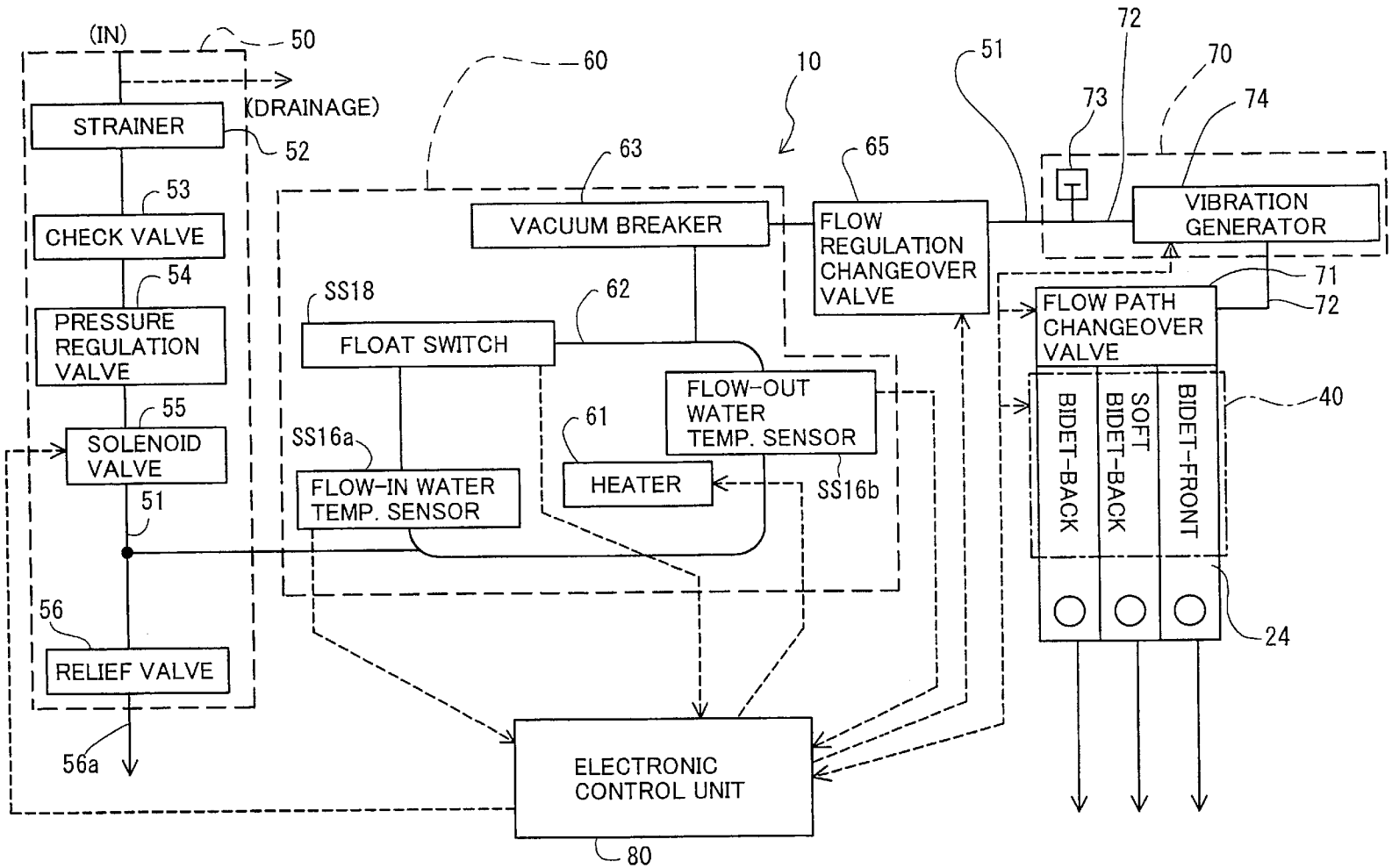
FIG. 16 is a block diagram schematically illustrating the structure of the personal hygiene appliance of the sixth embodiment, especially a water flowing line system.
Figure 17:
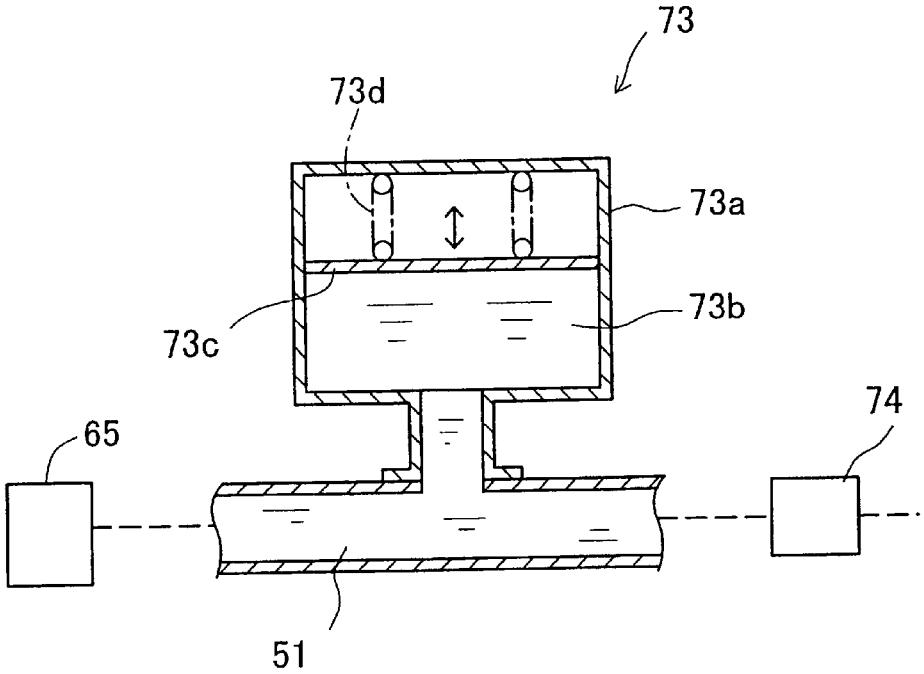
FIG. 17 is a sectional view schematically illustrating the structure of an accumulator 73 disposed in the water flowing line system.
Figure 18:
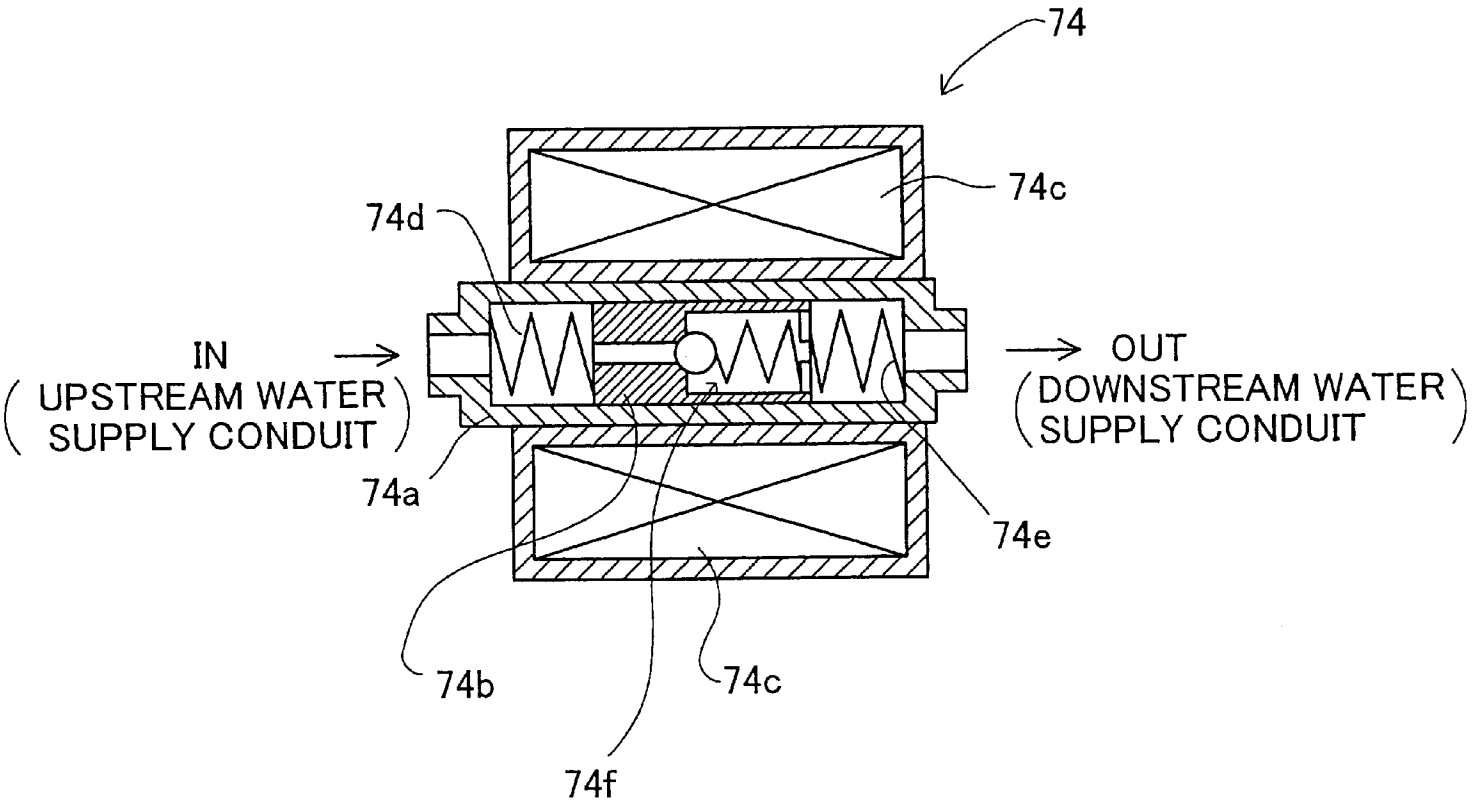
FIG. 18 is a sectional view illustrating the structure of a vibration generator 74 disposed in the water flowing line system.
Figure 19:
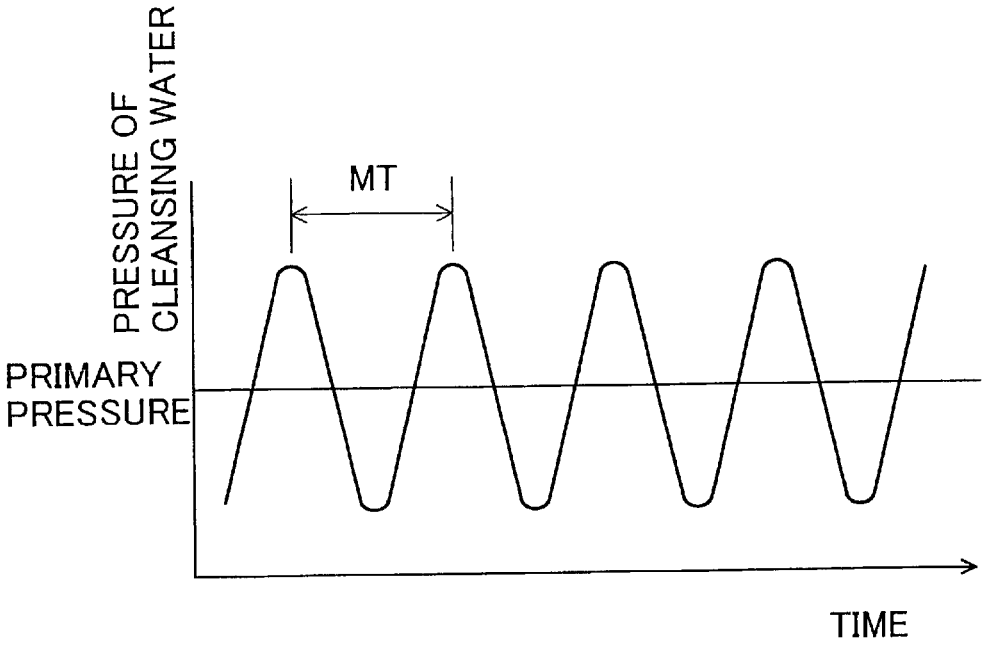
FIG. 19 shows a stream of cleansing water by the vibration generator 74.
Figure 20:
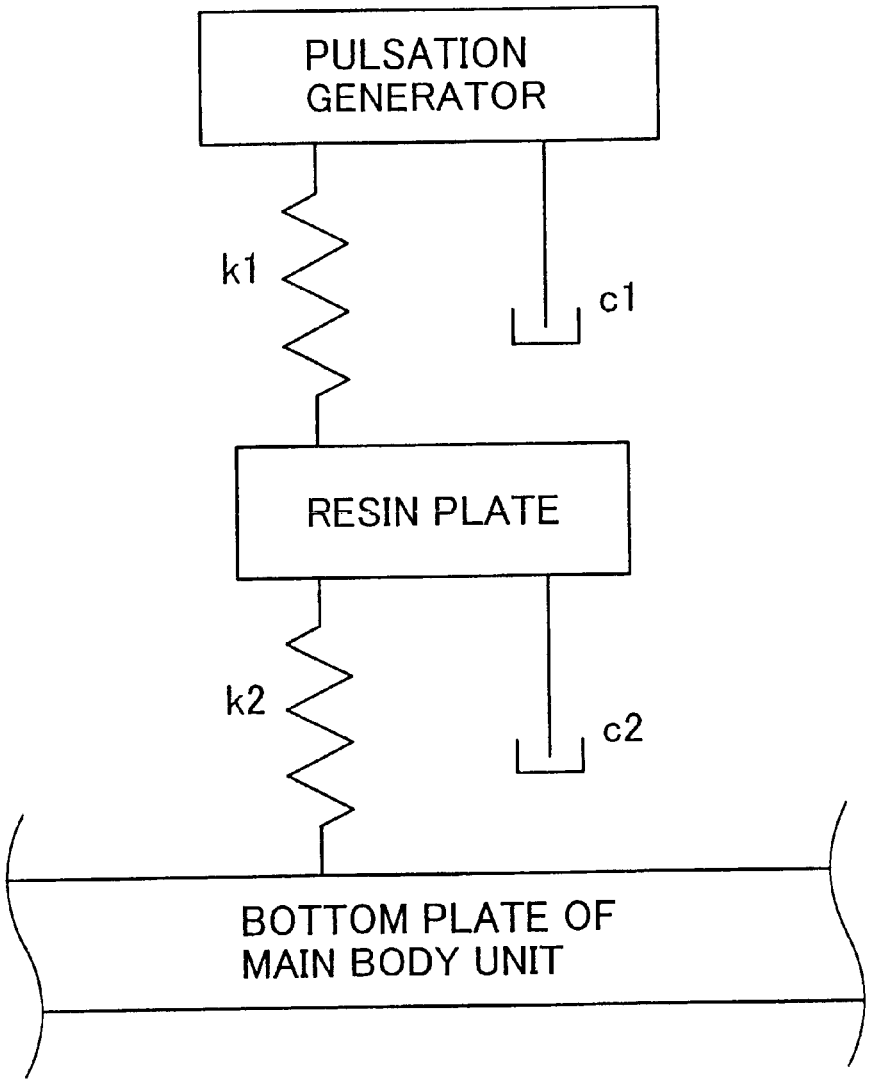
FIG. 20 schematically illustrates installation of the vibration generator 74.
Figure 21:
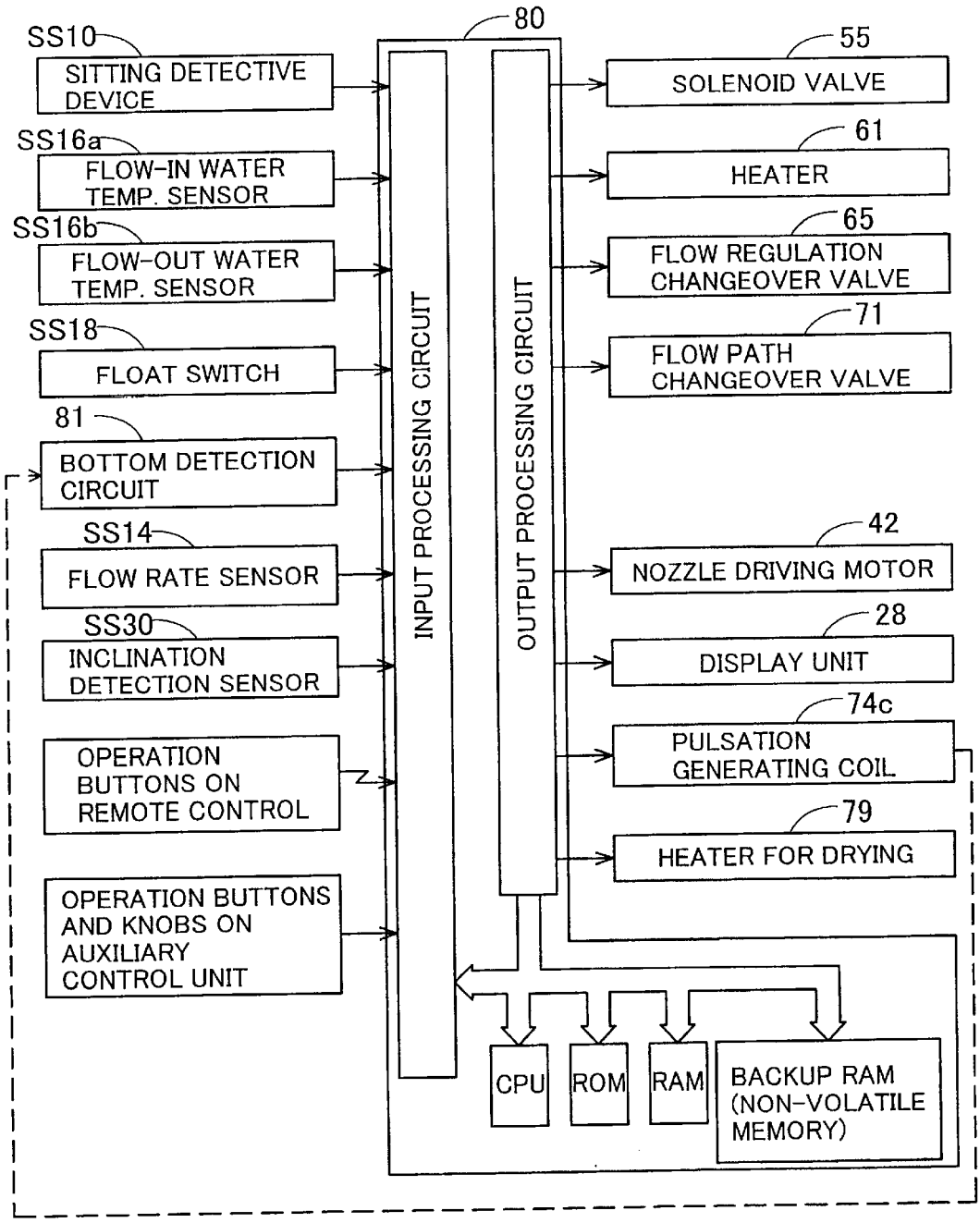
FIG. 21 is a block diagram schematically illustrating the configuration of a control system.

The following description regards still another embodiment (sixth embodiment) of the present invention. The structure of the sixth embodiment is characterized by the vibrating supply of cleansing water to the nozzle. The nozzle may be a specifically designed nozzle for swirling water or any existing nozzle. FIG. 15 is a perspective view schematically illustrating a personal hygiene appliance 10 attached to a toilet in the sixth embodiment. FIG. 16 is a block diagram schematically illustrating the structure of the personal hygiene appliance of the sixth embodiment, especially a water flowing line system. FIG. 17 is a sectional view schematically illustrating the structure of an accumulator 73 disposed in the water flowing line system. FIG. 18 is a sectional view illustrating the structure of a vibration generator 74 disposed in the water flowing line system. FIG. 19 shows a stream of cleansing water by the vibration generator 74. FIG. 20 schematically illustrates installation of the vibration generator 74. FIG. 21 is a block diagram schematically illustrating the configuration of a control system.

As illustrated, the personal hygiene appliance 10 of the sixth embodiment includes a main part unit 12 fixed to a rear upper face of a toilet BT and a remote control 14 that is used to remote control various operations, such as cleansing and drying. The main body unit 12 has a toilet seat 18 and a toilet cover 20 at the opening of the toilet bowl to be freely opened and closed. The main body unit 12 is provided with a rim unit 22 on one side of the toilet bowl and further has a nozzle unit 40 (see FIG. 22) with a nozzle 24 from which a spray of cleansing water is ejected against a private part, and a variety of other functional parts incorporated therein.

The remote control 14 has a diversity of operation buttons on the front face thereof to be generally used at the time of evacuation. Operation of each button generates corresponding signals (light signals). For example, operation of a Bidet-Back button (not shown) for standard bidet-back generates a corresponding signal, which is received by the main body unit 12 to start bidet-back. The remote control 14 has a variety of other buttons like a Stop button, a Bidet-Front button, a Dry button, water pressure regulation buttons, a Move button, but these functions are not directly related to the principle of the present invention and are thus not specifically described here.

The rim unit 22 has, on its upper face, a display unit 28 that displays the working conditions of the personal hygiene appliance and a cover 29 that freely open and closes. The display unit 28 has a light-receiving element that receives light signals transmitted from the remote control 14. Part of the cover 29 forms a light transmission window 29*a* that is colored to selectively transmit light from a sitting detective device SS10 (see FIG. 21) that detects seating of the user. A minimum number of operation buttons required for cleansing the private part are located under the cover 29 of the rim unit 22. Operation of such buttons enables the private part to be cleansed even when the remote control 14 is inoperable, for example, due to a dead battery.

The personal hygiene appliance 10 of this embodiment has a water flowing line system and a control system constructed as discussed below to carry out the required operations, such as cleansing and drying, corresponding to the respective buttons on the remote control 14 and the rim unit 22. As shown in FIG. 16, the water flowing line system of the personal hygiene appliance includes a water supply valve unit 50 that is connected to a non-illustrated external water supply source, a heat exchange unit 60, a flow regulation valve 65, and a vibration generation unit 70. A stream of cleansing water is led from the vibration generation unit 70 via a flow path changeover valve 71 to a nozzle 24 while keeping the vibration generated by the vibration generation unit 70 and is sprayed from the nozzle 24 as discussed later. These units are connected to an upstream water supply conduit 51 and a downstream water supply conduit 72 arranged across the vibration generation unit 70. The water supply valve unit 50 and the heat exchange unit 60 are connected to the upstream water supply conduit 51. The flow path changeover valve 71 downstream the vibration generation unit 70 is connected to the downstream water supply conduit 72.

The upstream water supply conduit 51 is connected to the water supply valve unit 50 to directly supply cleansing water (tap water) from the water supply source (water pipe) to the personal hygiene appliance. The cleansing water led into the upstream water supply conduit 51 passes through a strainer 52 in the water supply valve unit 50 for trapping dust and then flows into a check valve 53 and a pressure control valve 54. When a solenoid valve 55 disposed downstream the pressure control valve opens the pipe line, cleansing water of a fixed pressure regulated by the pressure control valve 54 (primary pressure: approximately 0.098 MPa or approximately 1.0 kgf/cm$^2$) is flowed into the heat exchange unit 60 of the instantaneous heating type. The flow rate of the pressure-regulated cleansing water is set to approximately 300 to 600 cc/min. The upstream water supply conduit 51 may branch off from a tank (not shown), in which water for cleansing the toilet bowl is reserved, and be connected to the water supply valve unit 50.

A first cleansing water pipe 56*a* branches off from the upstream water supply conduit 51 between the water supply valve unit 50 and the heat exchange unit 60 via a relief valve 56. In the case where the pressure in the conduit upstream the relief valve 56 rises and causes the relief valve 56 to open the pipe line, the first cleansing water pipe 56*a* leads the cleansing water out of the upstream water supply conduit 51. This arrangement prevents the inner pressure of the upstream water supply conduit 51 as well as a heat exchange section in the heat exchange unit 60 from undesirably increasing. This advantageously prevents the fatigue of the heat exchange section due to deformation, contraction, or expansion, and does not require the heat exchange section to have unnecessarily high pressure resistance.

The first cleansing water pipe 56*a* has one end facing to an air inlet for deodorization and an air outlet for drying the private part. The stream of cleansing water led out of this cleansing water pipe is sprayed against the air inlet and the air outlet as well as a gutter formed in the lower casing. The air inlet, the air outlet, and the gutter are open to the toilet bowl and may be stained with a splash of excrement. Cleansing the air inlet, the air outlet, and the gutter with the stream of cleansing water from the cleansing water pipe is desirable for the improved hygiene and the higher cleanliness. The cleansing water discharged from the cleansing water pipe flows down the inside of the toilet bowl and does not stain the vicinity of the toilet.

The heat exchange unit 60 arranged downstream the water supply valve unit 50 has a heat exchange section 62 with a heater 61 incorporated therein. The heater 61 is composed of tungsten-molybdenum having a good thermal response and is manufactured according to the procedure discussed below. The procedure first screen prints a heat pattern on a ceramic sheet with paste of tungsten and molybdenum, winds the ceramic sheet with the printed heat pattern on a ceramic cylinder, and sinters the ceramic sheet. The heater 61 is accordingly constructed as a cylindrical ceramic heater with the heat pattern insulated by an insulator layer. A Ni-plated kovar electrode is brazed to the heat pattern. A mounting flange is further fixed to the cylindrical heater by glass welding. This completes the heater 61. Since the heater 61 has the excellent thermal response, the heat exchange section 62 is required to have only the capacity sufficient for instantaneous heating of cleansing water by the heater 61. This desirably reduces the size of the heat exchange section 62 and thereby the whole size of the heat exchange unit 60. The simplified structure of the heat exchange unit 60 gives further advantages in manufacture, for example, reduction in number of assembling steps and low manufacturing cost. A bimetal switch or a thermal fuse is attached to the heater 61 or in the vicinity thereof to mechanically cut off overheat of the heater 61, although not being specifically illustrated.

In the heat exchange unit 60, the cleansing water is heated to a preset temperature with the heater 61, while the temperature of cleansing water flowed into the heat exchange section 62 and the temperature of cleansing water flowed out of the heat exchange section 62 are measured with a flow-in water temperature sensor SS16*a* and a flow-out water temperature sensor SS16*b*. The warm cleansing water is subjected to regulation of the flow rate by the flow regulation valve 65 and flows into the vibration generation unit 70 discussed later.

Covering the heat exchange unit 60 with a thermal insulating material, such as a foamed material, reduces the power consumption of the heater for heating the cleansing water, since the thermal insulating material has the heat-retaining effects. Namely this arrangement contributes to energy saving.

The heat exchange unit 60 also has a float switch SS18 that easures a water level in the heat exchange section. The float switch SS18 outputs a signal when the water level in the heat exchange section is not less than a predetermined level that enables the heater 61 to be submerged. An electronic control unit 80 supplies power to the heater 61 only in response to this signal and prevents the power from being supplied to the non-submerged heater 61. The heater 61 included in the heat exchange unit 60 is optimally controlled by a combination of feed forward control and feedback control by the electronic control unit 80 as discussed later.

The heat exchange unit 60 further includes a vacuum breaker 63 that is arranged at the outlet of cleansing water from the heat exchange section 62, that is, at the joint of the heat exchange section with the downstream water supply conduit. The vacuum breaker 63 introduces the air into the pipe line and cuts off the stream of cleansing water in the downstream water supply conduit, thereby preventing a reverse stream of cleansing water from the downstream water supply conduit.

The vibration generation unit 70 includes an accumulator 73 and a vibration generator 74. As shown in FIG. 17, the accumulator 73 includes a housing 73a connected to the upstream water supply conduit 51, which is located upstream the vibration generator 74, a damper 73*c* located in a damper chamber 73*b* in the housing 73*a*, and a spring 73*d* that applies a pressing force to the damper 73*c*.

The accumulator 73 accordingly relieves the water hammer in the upstream water supply conduit 51 upstream the vibration generator 74. This arrangement reduces the adverse effects of the water hammer on the temperature distribution of cleansing water in the heat exchange section 62, thereby stabilizing the temperature of the spray of cleansing water.

It is desirable that the accumulator 73 is arranged close to the vibration generator 74 or integrated with the vibration generator 74, since such arrangement quickly and effectively prevents the upstream propagation of the vibrating stream generated in the vibration generator 74 as discussed later. In this case, the accumulator 73 may be constructed to have only the damper chamber 73*b* functioning as a simple air chamber without the damper 73*c* and the spring 73*d* that presses the damper 73*c*, or may be formed as an air reservoir by intentionally expanding part of the upstream water supply conduit 51 in the upward direction.

Referring to FIG. 18, the vibration generator 74 includes a plunger 74*b* that is freely slidable in a cylinder 74*a*, which is connected to both the upstream water supply conduit 51 and the downstream water supply conduit 72. The plunger 74*b* moves forward to the upstream and backward to the downstream through excitation of an electromagnetic coil (vibration generating coil) 74*c*. The plunger 74*b* shifts from its illustrated original position towards the downstream under the excitation of the vibration generating coil 74*c*, and is returned to the original position by means of the pressing force of a reverse spring 74*e* when the coil excitation stops.

The movement of the plunger 74*b* is buffered by the function of a buffer spring 74*d*.

The plunger 74*b* includes a check valve 74*f* having a steel ball and a spring. Cleansing water in the cylinder 74*a* is pressurized to flow into the downstream water supply conduit 72, so that the plunger 74*b* shifts from the original position towards the downstream. Since the original position of the plunger 74*b* is fixed, a constant flow of cleansing water is fed to the downstream water supply conduit 72. When the plunger 74*b* moves back to the original position, cleansing water is flowed into the cylinder 74*a* via the check valve 74*f*. A subsequent shift of the plunger 74*b* toward the downstream thus feeds the constant flow of cleansing water again into the downstream water supply conduit 72. In the process of returning the plunger 74*b* to the original position, cleansing water is drawn from the downstream of the plunger 74*b*, that is, from the downstream water supply conduit 72. The vibration generator 74 accordingly causes a vibration of pressure that cyclically fluctuates, accompanied with the reciprocation of the plunger 74*b*, so as to flow the cleansing water in the form of a vibrating stream into the downstream water supply conduit 72.

The cleansing water regulated to the primary pressure is fed to the vibration generation unit 70 via the upstream water supply conduit 51. The cleansing water flowed into the cylinder 74*a* via the check valve 74*f* in the course of the restoration of the plunger 74*b* to the original position is fed to the downstream water supply conduit 72 with the varying pressure due to the pressure loss by the check valve 74*f* and the effects of drawing the cleansing water from the downstream water supply conduit 72.

As shown in FIG. 19, the cleansing water under the vibrating pressure around the primary pressure Pin is fed from the vibration generator 74 to the downward water supply conduit 72 and further to the nozzle 24 and is sprayed against the private part as discussed later. The pressure of cleansing water fed from the vibration generator 74 to the downstream does not reach zero, because of the stream of cleansing water into the cylinder 74*a* via the check valve 74*f* in the process of restoration of the plunger 74*b* to the original position. The vibrating variation in pressure of cleansing water leads to a variation in flow rate of the cleansing water. The primary pressure Pin on the center of the vibration is regulated by the pressure control valve 54. The vibration is accordingly shifted in the vertical direction with keeping the locus shown in FIG. 19. Since the vibrating variation in pressure of cleansing water affects the variation in flow rate of the cleansing water, the vibration shift varies the quantity of spray of cleansing water.

A vibration cycle MT shown in FIG. 19 is synchronous with an excitation cycle of the vibration generating coil 74*c* and is arbitrarily set through regulation of the excitation cycle as discussed later. The vibrating stream of cleansing water is produced only by exciting the coil for reciprocation of the plunger 74*b*. This simplifies the structure of the vibration generator 74.

In the structure of this embodiment, the vibration generator 74 is arranged downstream the heat exchange section 62 of the heat exchange unit 60 as shown in FIG. 16. The vibrating stream of cleansing water accordingly does not pass through the heat exchange section 62, which has a larger diameter than that of the water supply conduit and thereby readily causes damping of the vibrating stream. The vibrating stream of cleansing water, which is free from the possible damping of vibrating stream by the heat exchange section, is thus fed to the downstream water supply conduit 72 and further to the nozzle 24.

A rubber vibration insulator is arranged for installation of the vibration generator 74. The vibration damping properties of the rubber vibration insulator effectively relieve a vibration accompanied with the generation of the vibrating stream, as well as a resulting noise. One applicable procedure places the vibration generator 74 on a resin plate (not shown) that has a high specific gravity by mixing powder or granules of a high specific gravity, such as metal, and mounts the resin plate on a bottom plate of the main body unit via the rubber vibration insulator. This arrangement increases the total mass of the vibration source as the sum of the vibration generator 74 and the resin plate to prevent the vibration accompanied with the generation of the vibrating stream, and damps the vibration by the vibration damping properties of the rubber vibration insulator.

With a view to increasing the total mass of the vibration source, the vibration generator 74 may be attached to any member or unit of the personal hygiene appliance having a sufficiently large mass, instead of being mounted on the resin plate of the high specific gravity. This alternative arrangement does not require any resin plate, thus advantageously decreasing the number of parts and reducing the manufacturing cost and the size of the whole personal hygiene appliance. The rubber vibration insulator may be located between the vibration generator 74 and the resin plate. In this arrangement, a combination of the rubber vibration insulator between the vibration generator 74 and the resin plate with the rubber vibration insulator below the resin plate constructs a vibration insulating damper mechanism having 2 degrees of freedom as shown in FIG. 20. The rubber vibration insulators are appropriately selected to attain spring constants k1 and k2 and coefficients of damping c1 and c2 effective for relieving the vibration.

This ensures the high vibration damping effects and effectively prevents the vibration from being propagated to the toilet seat. The vibration damping effectively prevents a noise resulting from the vibration.

The use of the rubber vibration insulators combined with the arrangement of the accumulator 73 between the vibration generator 74 and the heat exchange section 62 desirably protects the heat exchange section 62 from the non-required vibrating pressure. This prevents an unintentional increase in internal pressure of the heat exchange section 62. The heat exchange section is accordingly free from deformation or untimely fatigue by repeated contraction and expansion and is not required to have an excessively high pressure resistance.

In the structure of the water flowing line system of this embodiment, both the upstream and downstream water supply conduits 51 and 72 are composed of pipes of high hardness and flexibility. Here the downstream water supply conduit 72 is designed to have a higher hardness than that of the upstream water supply conduit 51. Coupler joints are used to connecting these water supply conduits to the respective units. The respective units are arranged close to one another, in order to shorten the required length of each water supply pipe between adjoining units. This arrangement effectively prevents the expansion and contraction of the water supply conduits and thereby relieves the possible damping of the vibrating stream due to the expansion and contraction. Under the condition of the relieved damping of the vibrating stream, the vibrating stream of cleansing water is fed into the nozzle 24. Especially the close arrangement of the vibration generator 74 to the flow path changeover valve 71 in combination with the application of the material having high hardness and flexibility to the downstream water supply conduit 72 effectively relieves the damping of the vibrating stream while the vibrating stream of cleansing water passes through the downstream water supply conduit 72.

Any other suitable structure may be applied for the upstream and downstream water supply conduits 51 and 72. In one example, both the water supply conduits are composed of an identical material of high hardness and flexibility. The downstream water supply conduit 72 is designed to have a greater wall thickness than that of the upstream water supply conduit 51. This gives a difference in hardness between these two water supply conduits. The two water supply conduits may be composed of different materials having different hardnesses.

The control system of the personal hygiene appliance of this embodiment has the electronic control unit 80 including a microcomputer as an essential device as shown in FIG. 21. The electronic control unit 80 receives signals from a variety of sensors including the sitting detective device, the flow-in water temperature sensor, and the flow-out water temperature sensor, the float switch, an inclination detection sensor SS30, and a flow rate sensor SS14 (discussed later), as well as the operating conditions of the diversity of operation buttons and knobs, such as Bidet buttons on the remote control 14 via an input circuit by wire or in a wireless manner (that is, in the form of light signals). The flow rate sensor SS14 measures a flow rate of cleansing water in the downstream water supply conduit 72 and outputs the results of the measurement to the electronic control unit 80. The inclination detection sensor SS30 detects the state of inclination of the personal hygiene appliance and outputs the results of the detection to the electronic control unit 80.

The electronic control unit 80 regulates, based on the input signals, the on-off state of the solenoid valve in the water supply valve unit 50, the power supply to the heater in the heat exchange unit 60, the switching operation of the flow regulation valve, the display in the display unit on the main body unit, the power supply to a dry unit 79 including a heater and a fan motor for drying the private part, the power supply to a deodorization unit (not shown) including an ozonizer and a suction fan motor for removal of odor, and the power supply to a room heater unit (not shown) including a heater and a fan motor for heating the room. The electronic control unit 80 also regulates, based on the input signals, a nozzle driving motor in the nozzle unit 40 and the frequency of the vibrating stream through control of the excitation of the vibration generating coil 74*c*. The details of the process of regulating the frequency of the vibrating stream will be discussed later. One heater may be used commonly for drying the private part and heating the room. In a similar manner, one fan motor may be used commonly for drying the private part, removing odor, and heating the room.

Figure 22:
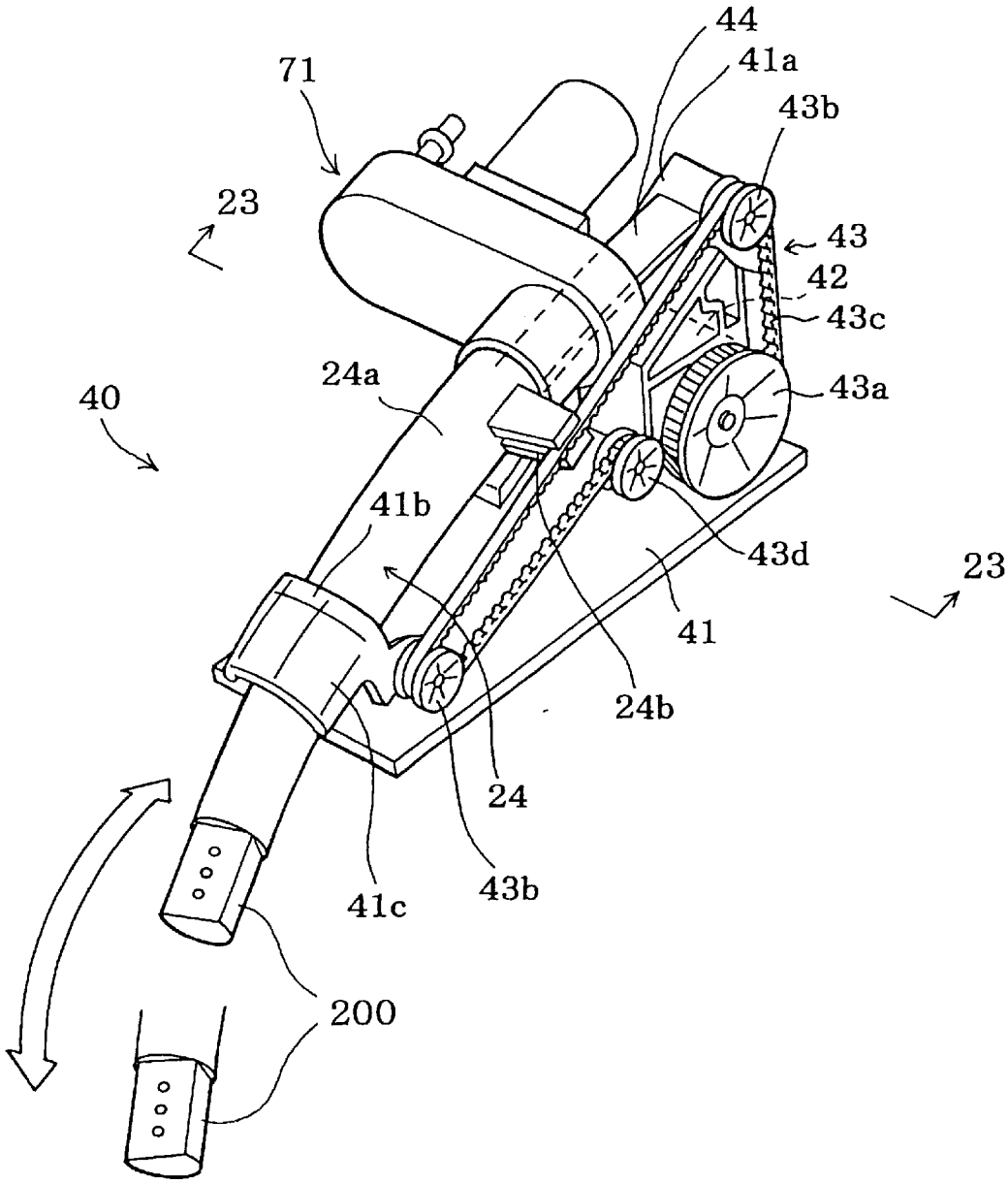
FIG. 22 is a perspective view schematically illustrating a nozzle unit 40.
Figure 23:
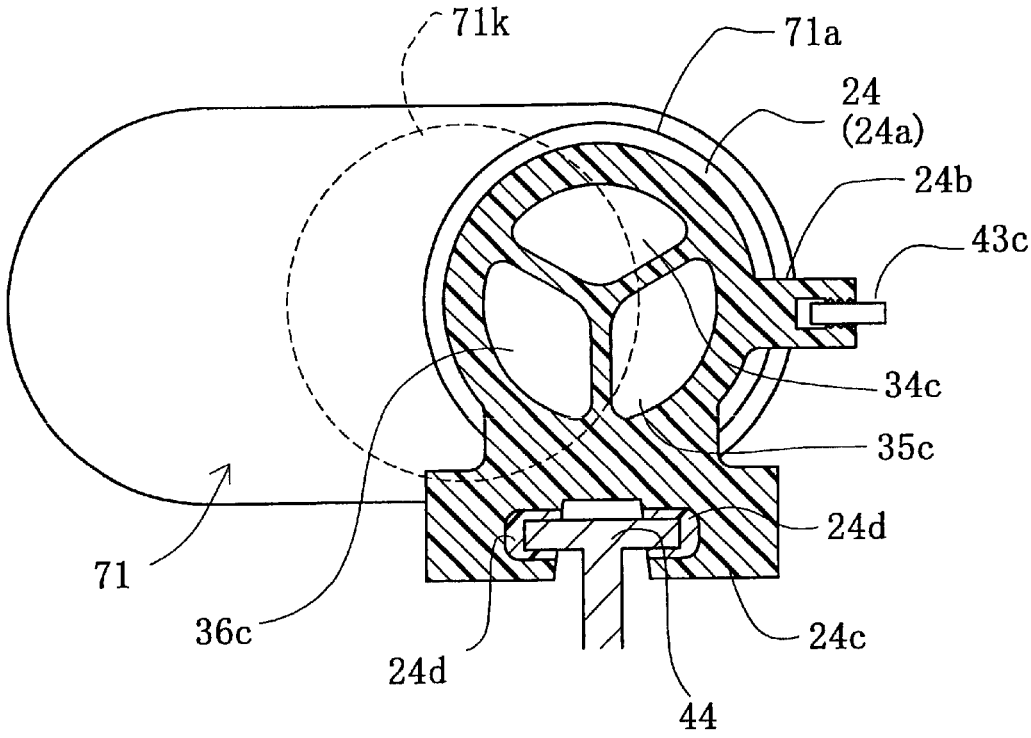
FIG. 23 is a sectional view taken on the line 23—23 in FIG. 22.
Figure 24:
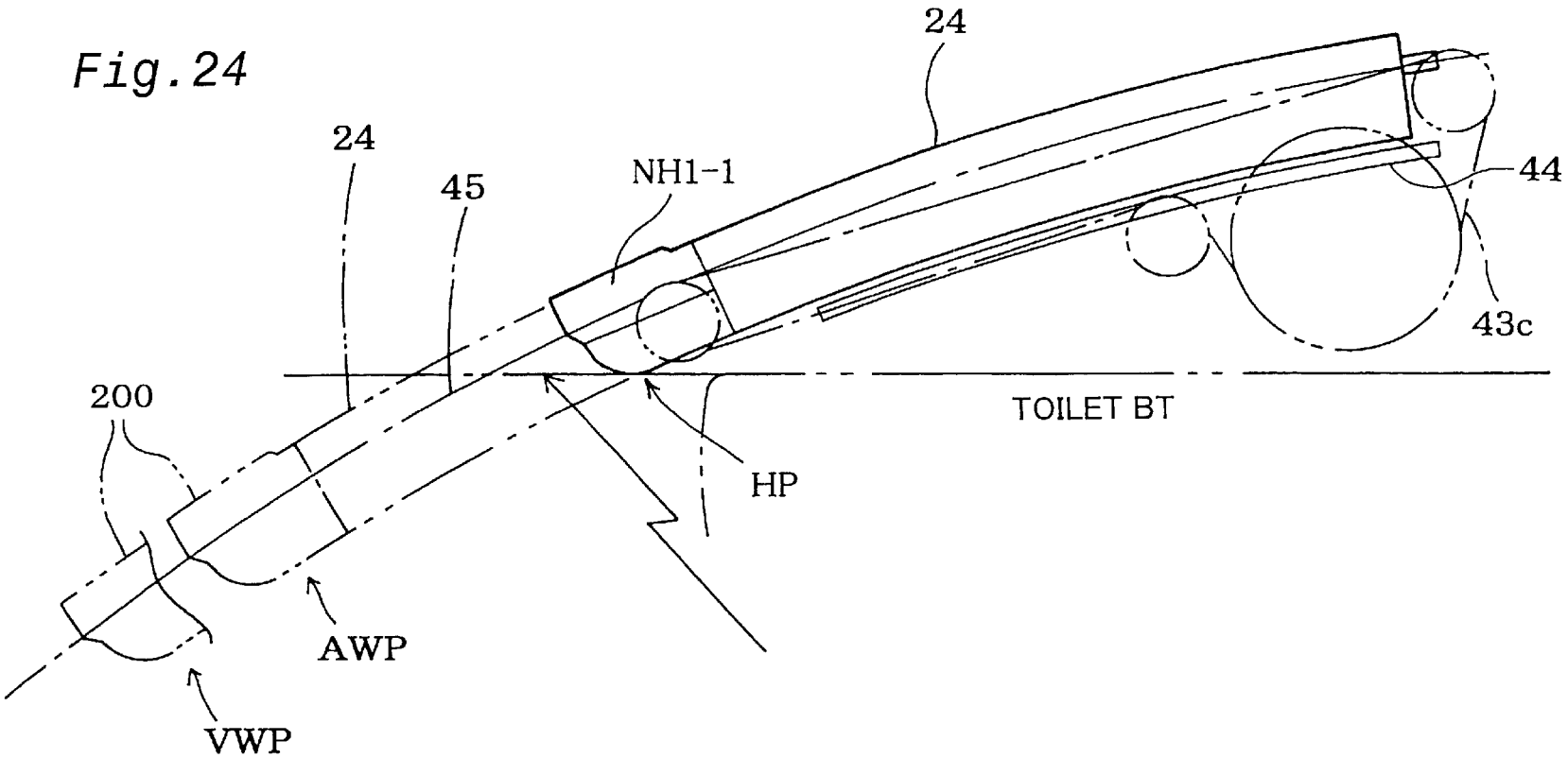
FIG. 24 shows a route along which the nozzle 24 extends and retracts.

The following describes the nozzle unit 40 included in the personal hygiene appliance 10 of this embodiment. FIG. 22 is a perspective view schematically illustrating the nozzle unit 40. FIG. 23 is a sectional view taken on the line 23—23 in FIG. 22. FIG. 24 shows a route along which the nozzle 24 extends and retracts.

The nozzle unit 40 is disposed in the main body unit of the personal hygiene appliance 10. The nozzle unit 40 includes a base 41 that is fixed to the main body unit, a nozzle driving motor 42 that is arranged in a stand 41*a* on the upper surface of the base 41, a transmission mechanism 43 that converts the normal and reverse rotations of the motor 42 into forward and backward movements and transmits the movements to the nozzle 24, a nozzle support member 41*b* that is formed upright on the upper surface of the base 41 and supports the nozzle 24 to be slidable in the toilet bowl, and a guide rail unit 44 that guides the nozzle 24 along a nozzle reciprocation track as discussed below.

The transmission mechanism 43 includes a driving pulley 43*a* that is fixed to a rotating shaft of the nozzle driving motor 42, a pair of driven pulleys 43*b* that are disposed along the nozzle reciprocation track, a timing belt 43*c* that is laid on these pulleys, and a tension roller 43*d* that gives a tension to the timing belt 43*c*. The timing belt 43*c* is fixed to the nozzle 24 via a belt fitting member 24*b* that extends from a cylindrical section 24*a* of the nozzle 24. The nozzle 24 accordingly extends and retracts in response to the normal and reverse rotations of the timing belt 43*c*.

The guide rail unit 44 is curved to follow an arc-shaped nozzle reciprocation track 45 shown in FIG. 24, and is located below the nozzle 24. The guide rail unit 44 is engaged with the nozzle 24 via a track support member 24*c* disposed below the rear end of the nozzle 24 as shown in FIG. 23. The track support member 24*c* vertically holds the left and right ends of a rail of the guide rail unit 44 and is provided with a support element 24*d*, which is formed at the rail holding position as a track supporting surface having the same radius of curvature as that of the nozzle reciprocation track 45. The support element 24*d* has slidability relative to the rail and the vibration-absorbing function, and is composed of a rubber material mixed with oil, wax, or another equivalent material or a surface-treated rubber material by, for example, Teflon coating, halogenation or satin finish. Even when a vibration occurs on the nozzle due to the vibrating stream of cleansing water, which is flowed from the vibration generator 74 into the nozzle, the rubber material effectively prevents the propagation of the vibration to the other parts, as well as a noise resulting from the vibration.

The nozzle support member 41*b* in the toilet bowl supports the nozzle 24 in such a manner as to allow free sliding movements thereof. The nozzle 24 is driven to extend and retract along the guide rail unit 44 by means of the timing belt 43*c*, and the locus of the moving nozzle is coincident with the arc-shaped nozzle reciprocation track 45. The cylindrical section 24*a* of the nozzle 24 is also curved in the axial direction to have the same radius of curvature as that of the nozzle reciprocation track 45. The nozzle 24 is accordingly driven to extend and retract along the arc-shaped nozzle reciprocation track 45 and move forward and backward between a stand-by position HP in the main body unit and cleansing positions (a bidet-back cleansing position AWP and a bidet-front cleansing position VWP) in the toilet bowl. The nozzle support member 41*b* is designed to be only partly in contact with the outer wall of the nozzle, in order to reduce the sliding resistance of the nozzle. Arrangement of the specific member, which is composed of the mixed rubber material or the surface-treated rubber material and has the slidability and the vibration-absorbing function, at the position of contact enhances the effects of preventing the propagation of the vibration and the resulting noise.

The nozzle 24 at the stand-by position HP is attached to the nozzle unit 40 such as to become gradually closer to the upper face of the toilet in the axial direction as shown in FIG. 24. The height of the rear end of the nozzle from the upper face of the toilet (that is, the nozzle height) in this arrangement is thus lower than the nozzle height in the arrangement where a cylindrical nozzle extends and retracts along an inclined linear track. The height of the main body unit is lowered by the reduction of the nozzle height. This advantageously reduces the size of the whole personal hygiene appliance. The extension of the nozzle along the arc-shaped nozzle reciprocation track changes the angle of the upper face of the nozzle head and thereby varies the spray angle of cleansing water from the nozzle head. This arc-shaped track enables the cleansing area to be varied significantly only by a slight shift of the nozzle. For example, even when the nozzle reciprocating range is relatively narrow in the process of move cleansing discussed later, this arrangement ensures the spray of cleansing water over the cleansing area required for the move cleansing. In another example, even when the moving distance of the nozzle from the bidet-back cleansing position AWP to the bidet-front cleansing position VWP is relatively short, the effective cleansing position with the spray of cleansing water is changed from the bidet-back to the bidet-front.

In another possible arrangement, the nozzle 24 and the nozzle reciprocation track 45 may respectively be formed as a linear pipe and a linear track. In this arrangement, the nozzle 24 may extend and retract along the linear track.

In the nozzle unit 40 of this embodiment, the vertically overlapping layout of the nozzle 24 and the guide rail unit 44 desirably reduces the dimension of the whole nozzle unit 40 along the width of the nozzle. This allows the nozzle unit 40 to be arranged closer to the vibration generator 74, thus enhancing the effects of relieving the damping of the vibrating stream in the downstream water supply conduit 72. The base 41 (see FIG. 22) of the nozzle unit 40 is mounted on the bottom plate of the main body unit via the rubber vibration insulator. The vibration damping properties of the rubber vibration insulator effectively relieve a vibration due to the vibrating stream, which may be propagated to the nozzle unit 40, as well as a noise resulting from the vibration.

Figure 25:
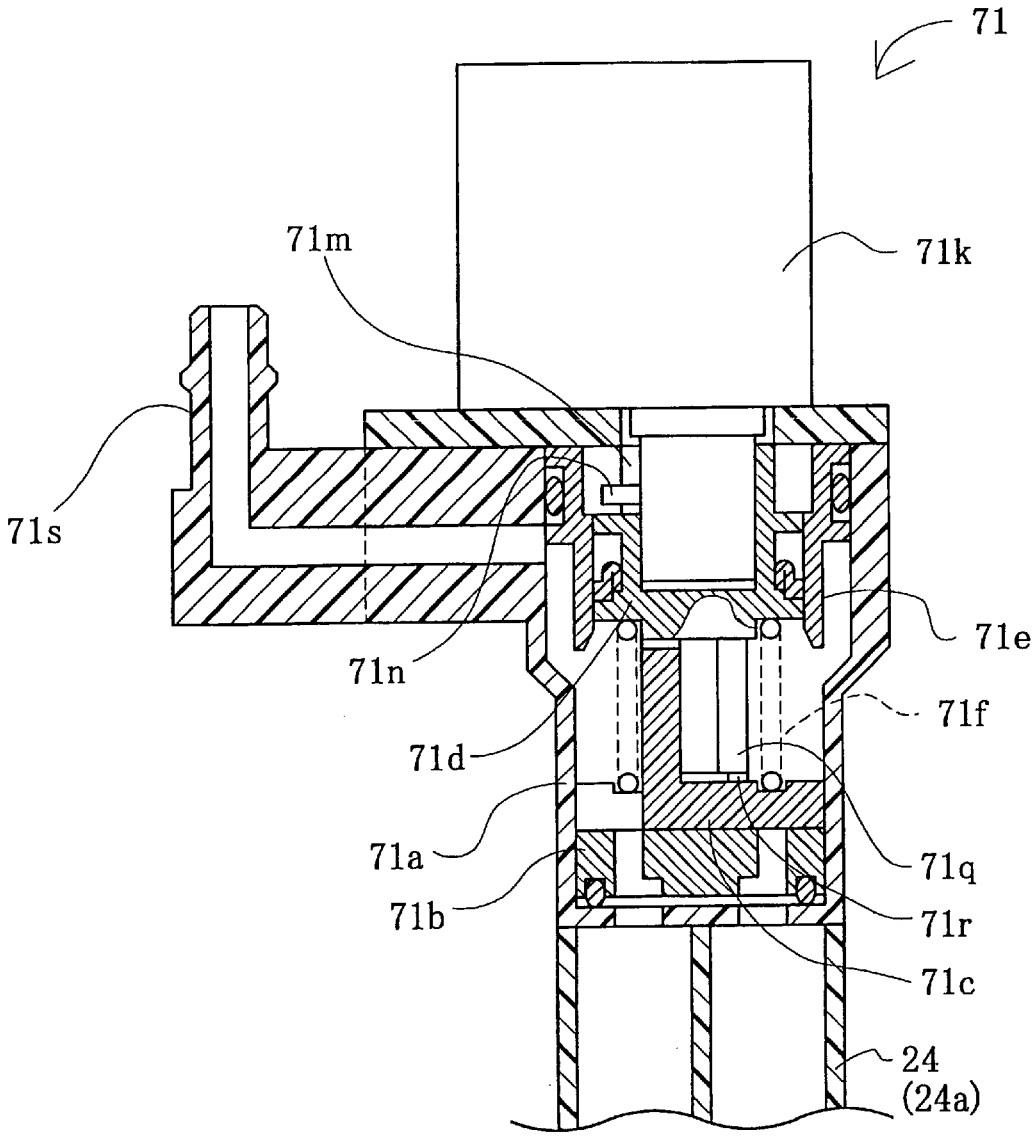
FIG. 25 is a sectional view schematically illustrating the structure of a flow path changeover valve 71 included in the nozzle 24.
Figure 26:
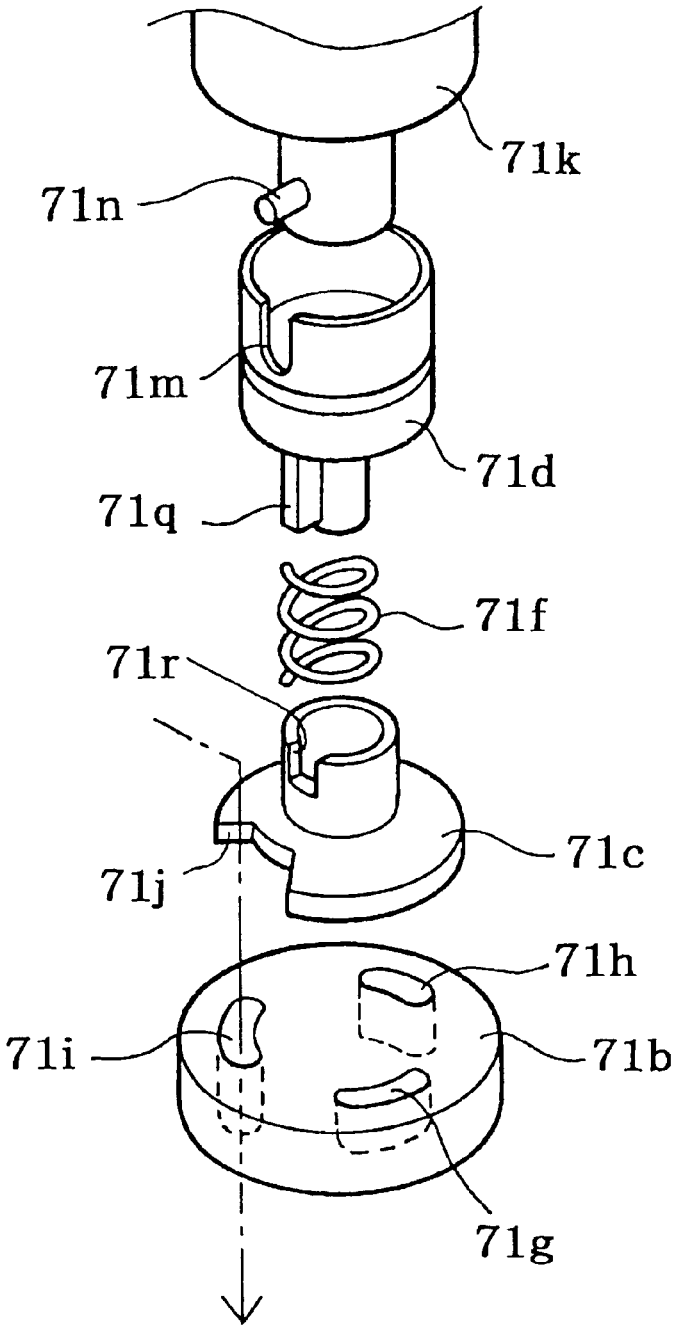
FIG. 26 is a decomposed perspective view illustrating the main part of the flow path changeover valve 71.
Figure 27:
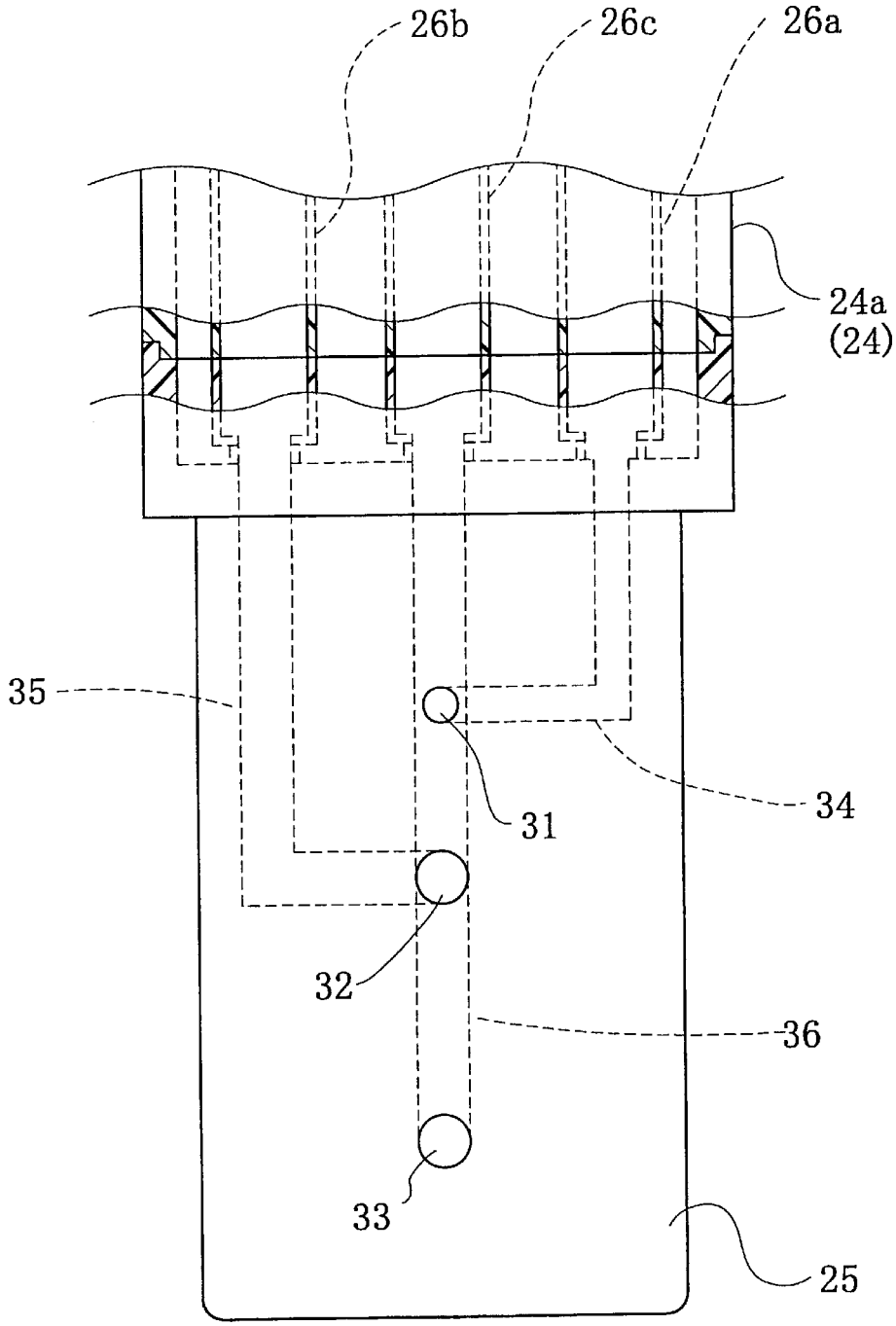
FIG. 27 is a partly broken plan view illustrating a nozzle head 25 and its periphery.
Figure 28:
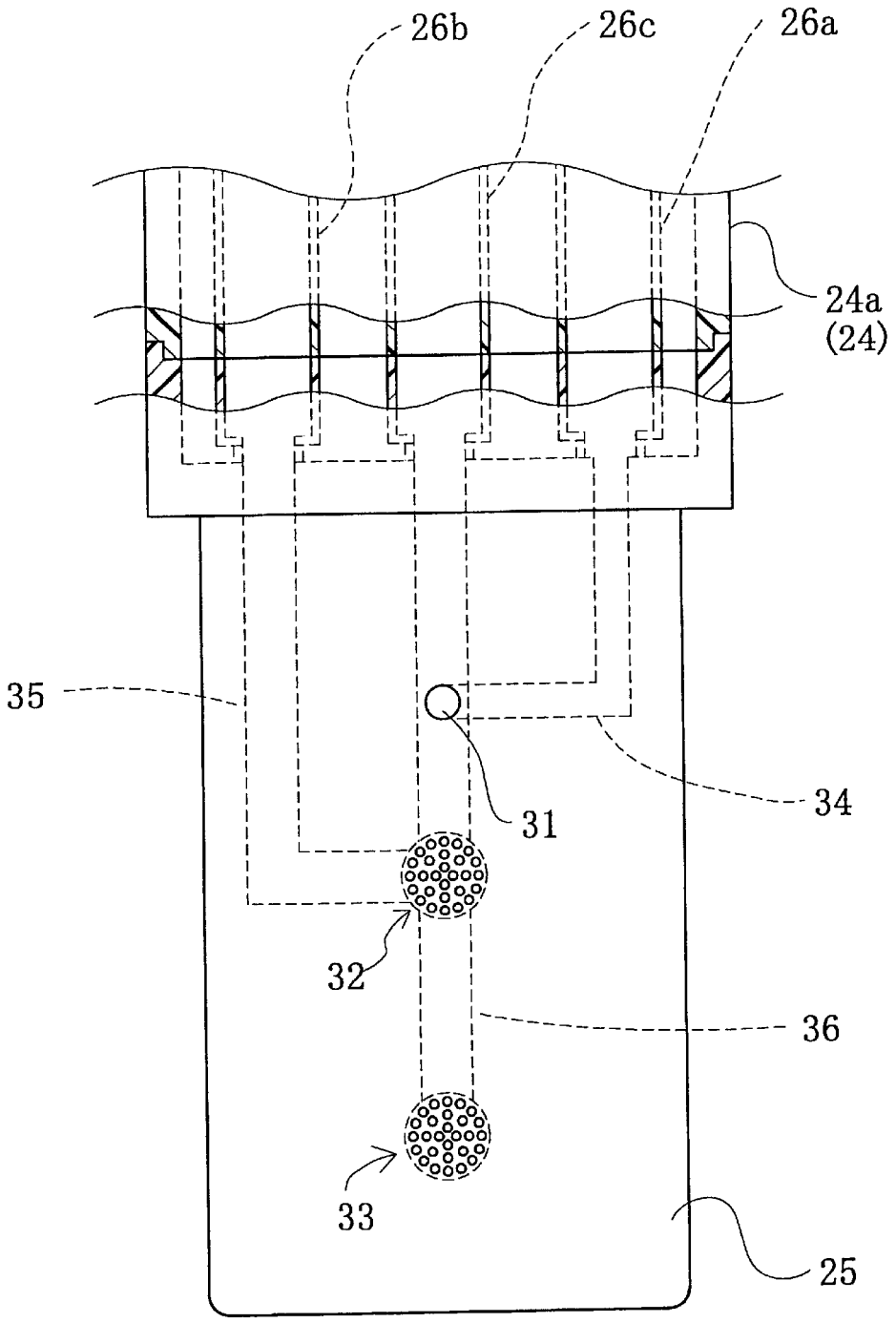
FIG. 28 is a plan view illustrating a modified example of the nozzle head 25.

The nozzle 24 of the sixth embodiment is discussed in detail. FIG. 25 is a sectional view schematically illustrating the structure of the flow path changeover valve 71 included in the nozzle 24. FIG. 26 is a decomposed perspective view illustrating the main part of the flow path changeover valve 71. FIG. 27 is a partly broken plan view illustrating a nozzle head 25 and its periphery. FIG. 28 is a plan view illustrating a modified example of the nozzle head 25. The structure of the nozzle head and the configuration of the flow path discussed above with reference to FIGS. 9 through 13 may alternatively be applied for the nozzle 24.

Referring to FIGS. 22, 23, and 25, the flow path changeover valve 71 is located on the rear end of the nozzle 24 and is constructed as discussed below to change over the destination of supply of cleansing water in the form of the vibrating stream fed from the vibration generator 74 among a nozzle flow path for bidet-back, a nozzle flow path for gentle bidet-back, and a nozzle flow path for bidet-front in the nozzle 24.

The flow path changeover valve 71 has a casing 71*a* with a switching mechanism incorporated therein as discussed later. The casing 71*a* of the flow path changeover valve 71 is welded to the rear end face of the cylindrical section 24*a* of the nozzle 24, so that the flow path changeover valve 71 is integrated with the nozzle 24. The flow path changeover valve 71 accordingly extends and retracts with the nozzle 24 along the track as discussed above.

The casing 71*a* includes a stator 71*b* that has connection apertures 71*g* to 71*i* connecting with the respective nozzle flow paths, a rotor 71*c* that rotates for changing over the flow path and alternatively opens a selected one of the connection apertures formed in the stator 71*b*, a coupling 71*d* that transmits rotations to the rotor 71*c*, a housing 71*e* that receives therein the coupling 71*d* in a freely rotatable manner, and a spring 71*f* that presses the rotor 71*c* against the stator 71*b*. As shown in FIG. 26, the connection apertures 71*g* through 71*i* of the stator 71*b* are formed to be equally open to the side facing the rotor 71*c* and respectively connect with nozzle flow paths shown in FIG. 23, that is, a first nozzle flow path 34*c* for bidet-back, a second nozzle flow path 35*c* for gentle bidet-back, and a third nozzle flow path 36*c* for bidet-front. Namely the connection apertures are curved in the stator. The connection apertures are arranged corresponding to the openings of the respective nozzle flow paths on the rear end of the nozzle. The first through the third nozzle flow paths 34*c* through 36*c* are formed to be separate from one another along the longitudinal axis of the cylindrical section 24*a* to the nozzle head 200 (see FIGS. 9 to 13) on the end of the nozzle.

The rotor 71*c* has a notch 71*j* to open one of the connection apertures that are equally open to the upper surface of the stator 71*b*. The notch 71*j* may be laid upon the opening of a selected connection aperture, so as to open the selected connection aperture. The rotor 71*c* may locate the notch 71*j* between the adjoining connection apertures, so as to block all the connection apertures. When the rotor 71*c* slightly rotates from the position where the notch 71*j* is located between the adjoining connection apertures, a fstream of cleansing water is fed into the corresponding nozzle flow path via the open connection aperture. For the purpose of discharging water that remains in the nozzle (for convenience of drainage), the rotor 71*c* may have another notch that is laid upon the openings of all the connection apertures. This notch opens all the connection apertures for the drainage.

The coupling 71*d* is attached to a rotating shaft of a driving motor 71*k* included in the flow path changeover valve 71, and has a slit 71*m* that receives a rotating shaft pin 71*n*. The coupling 71*d* also has a rotation key 71*q* located at a slit 71*r* of the rotor 71*c*. When the driving motor 71*k* is rotated in a normal direction or in a reverse direction, the rotation is transmitted to the coupling 71*d* via the rotating shaft pin 71*n* and further to the rotor 71*c* via the rotation key 71*q*. The rotation of the rotor 71*c* then positions the notch 71*j* to selectively open one of the connection apertures and cause the vibrating stream of cleansing water supplied from the vibration generator 74 to be fed into the nozzle flow path corresponding to the selected connection aperture.

The vibrating stream of cleansing water fed from the vibration generator 74 is flowed into the flow path changeover valve 71 via the downstream water supply conduit 72 (see FIG. 16) and a connection joint 71*s* formed on the casing 71*a* of the flow path changeover valve 71. In the process of coupling the downstream water supply conduit 72 with the connection joint 71*s*, the vibration generator 74 should be located below the connection joint 71*s* to prevent an air reservoir from being formed in the middle of the downstream water supply conduit 72. The arrangement of no air reservoir in the flow path of the vibrating stream of cleansing water from the vibration generator 74 to the flow path changeover valve 71 and the high hardness of the conduit effectively relieve damping of the vibrating stream. The vibrating stream of cleansing water generated by the vibration generator 74 passes through only the downstream water supply conduit 72 between the vibration generator 74 and the flow path changeover valve 71 to reach the nozzle unit 40. Cushioning media like rubber vibration insulators are attached to places where the downstream water supply conduit 72 possibly comes into contact with peripheral members. In a concrete example, rubber vibration insulators are attached to the peripheral members, and a sheet of rubber vibration insulator is wound on the water supply conduit. This arrangement in combination with application of the material of, high hardness for the downstream water supply conduit 72 more effectively relieves damping of the vibrating stream.

The respective constituents of the flow path changeover valve 71 including the casing are composed of engineering plastics having durability and heat resistance, such as polyphenylene sulfide (PPS), polyacetal (POM), polybutylene terephthalate (PBT), or glass fiber-reinforced polybutylene terephthalate (GF-PBT). The flow path of cleansing water inside the flow path changeover valve accordingly functions as a conduit of sufficiently high strength and is not readily contracted or expanded to cause damping of the vibrating stream. Since the flow path changeover valve 71 is integrated with the nozzle 24 and there is no piping between the flow path changeover valve 71 and the nozzle 24, damping of the vibrating stream hardly occurs in the process of supplying the vibrating stream of cleansing water fed from the vibration generator 74 into the nozzle flow path. The destination of supply of cleansing water is changed over by utilizing the rotation of the rotor 71*c*. Compared with a conventional flow path changeover valve utilizing resilience of a resilient body, such as a diaphragm, the flow path changeover valve 71 of the embodiment more effectively relieves damping of the vibrating stream.

The flow path changeover valve 71 has advantages discussed below. The flow path changeover valve 71 is integrated not with the vibration generator 74 but with the nozzle 24 located downstream the vibration generator 74. Namely the flow path changeover valve 71 is separated from the vibration generator 74, which may work as a vibration source at the time of generating the vibrating stream. Here the vibration generator 74 is the only vibration source. The flow path changeover valve 71 extends and retracts with the nozzle 24. Since the driving motor 71*k* of the flow path changeover valve 71 has a resin-molded coil winding, a splash of cleansing water over the driving motor 71*k* does not interfere with the normal drive of the motor 71*k* when the nozzle 24 extends to one of the cleansing positions. There is only one downstream water supply conduit 72 leading to the nozzle unit 40. This arrangement effectively reduces the loading applied by the conduit in the course of nozzle extension and retraction, thus decreasing a loading torque applied to the nozzle driving motor 42.

The nozzle head 25 of the nozzle 24 has a nozzle opening 31 for standard bidet-back, a nozzle opening 32 for gentle bidet-back, and a nozzle opening 33 for bidet-front. The nozzle head 25 is water-tightly fixed to an end of the cylindrical section 24*a* of the nozzle 24. A first head flow path 34, a second head flow path 35, and a third head flow path 36 formed in the nozzle head are respectively connected to a first nozzle flow path 26*a*, a second nozzle flow path 26*b*, and a third nozzle flow path 26*c* formed in the nozzle. As illustrated in the drawings, these nozzle flow paths reach the respective nozzle openings formed in the upper face of the nozzle head. When the destination of supply of cleansing water is changed over by the flow path changeover valve 71 (see FIG. 22) located on the rear end of the nozzle among the first through the third nozzle flow paths 26*a* to 26*c*, cleansing water flows through the selected nozzle flow path and the corresponding head flow path and is sprayed from the corresponding nozzle opening. Since the vibrating stream of cleansing water is supplied from the vibration generator 74, a vibrating spray of cleansing water is ejected from the nozzle opening.

Among the respective nozzle openings 31 to 33 formed in the nozzle head 25, the nozzle opening 31 for bidet-back has a smallest diameter, whereas the nozzle opening 32 for gentle bidet-back and the nozzle opening 33 for bidet-front have greater diameters. Under the condition that a fixed water pressure is set through the operations of the non-illustrated water pressure regulation buttons on the remote control 14 (see FIG. 15), the nozzle opening 31 for bidet-back has a highest spray speed of cleansing water, and the nozzle opening 33 for bidet-front and the nozzle opening 32 for gentle bidet-back have lower spray speeds. Compared with the standard bidet-back through the nozzle opening 31, the gentle bidet-back through the nozzle opening 32 having the lower spray speed gives the user the softer clean up feeling by at least the difference in spray speed. The nozzle opening 33 for bidet-front and the nozzle opening 32 for gentle bidet-back may not be restricted to single apertures, but may respectively include a plurality of small-diametral holes as shown in FIG. 28. In the latter case, the total area of the nozzle opening for gentle bidet-back or bidet-front, that is, the sum of the areas of the small-diametral holes, is set to be not less than the area of the nozzle opening for bidet-back. This arrangement ensures the gentler spray of cleansing water from the total of the small-diametral holes than the spray from the nozzle opening for bidet-back.

In the case where the nozzle 24 has the nozzle head 200 discussed previously with FIGS. 9 through 13, the vibrating stream of cleansing water, which simultaneously has the swirl added by the water swirling chamber 171, is sprayed for gentle bidet-back and bidet-front.

As clearly shown in FIGS. 9 and 10, among the nozzle openings 31 to 33 formed in the nozzle head 200, the nozzle opening 31 for bidet-back has a smallest diameter, whereas the nozzle opening 32 for gentle bidet-back and the nozzle opening 33 for bidet-front have greater diameters. Under the condition of a fixed water pressure, the difference in spray speed gives the softer clean up feeling as described above.

Figure 29:
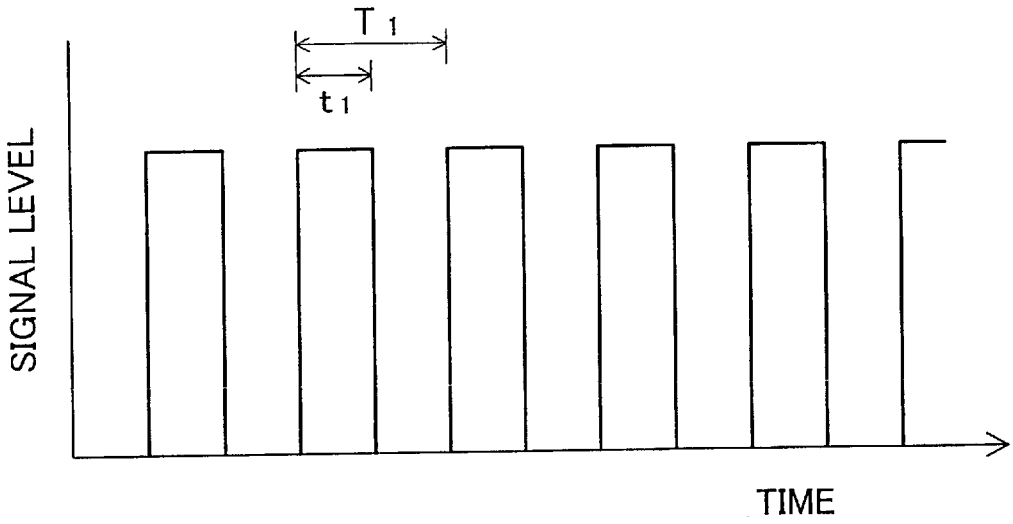
FIG. 29 shows a state of excitation of a vibration generating coil 74*c* in the vibration generator 74 that generates the vibrating stream in the course of spraying the cleansing water.
Figure 30A:
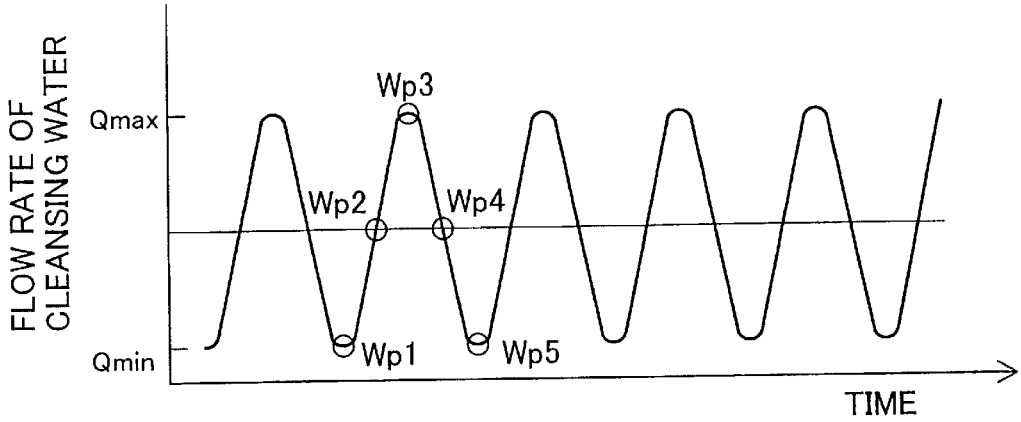
FIG. 30 is a timing chart showing the flow rate and the flow velocity of cleansing water supplied from the vibration generator 74.
Figure 30B:
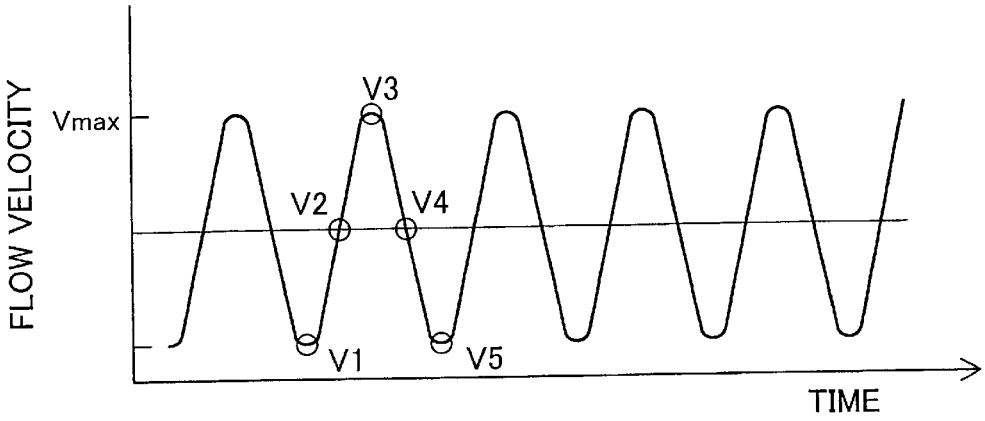

The following describes the characteristics of the spray of cleansing water in the personal hygiene appliance 10 of the sixth embodiment for bidet-back as an example. FIG. 29 shows a state of excitation of the vibration generating coil 74*c* in the vibration generator 74 that generates the vibrating stream in the course of spraying the cleansing water. FIG. 30 is a timing chart showing the flow rate and the flow velocity of cleansing water supplied from the vibration generator 74. FIG. 31 schematically illustrates a process of spraying the cleansing water from the nozzle opening 31 for bidet-back in the nozzle head 25 or the nozzle head 200. For convenience of explanation, the following discussion regards the nozzle head. These characteristics are, however, also applicable for the nozzle head 200.

The electronic control unit 80 outputs a pulse signal to excite the vibration generating coil 74*c* and cause the vibration generator 74 to generate a vibration. The pulse signal is output to a switching transistor 86 (see FIG. 43) that is connected with the vibration generating coil 74*c* and switches on the vibration generating coil 74*c*. The vibration generating coil 74*c* is repeatedly excited by the on-off operations of the switching transistor 86 in response to the pulse signal and cyclically reciprocates the plunger 74*b* as discussed above. This causes cleansing water in the state of a vibrating stream having the cyclically fluctuating pressure to be supplied from the vibration generator 74 to one of the nozzle openings formed in the nozzle head 25 and sprayed from the nozzle head. The electronic control unit 80 here varies the frequency of the pulse signal in a specific frequency domain and controls the duty ratio to control the on-off state of the coil excitation pulse. This procedure leads to a diversity of vibrations. In accordance with one preferable arrangement, a pressure sensor is disposed immediately after the vibration generator 74 to measure the pressure of the vibration generated by the vibration generator 74, and the duty ratio is under feedback control with the observed values of the pressure sensor.

The position of the pressure sensor is not restricted as long as it can reflect the vibrating pressure. For example, the pressure sensor may be disposed in the vicinity of the nozzle or may be arranged close to or substantially integral with the vibration generator 74.

As shown in FIG. 29, when the vibration cycle MT shown in FIG. 19 is set equal to a cycle Ti, and the on time of the pulse signal is set equal to a time t1, the duty ratio is expressed as (t1/T1)×100(%). Compared with a continuous flow, the flow rate of the cleansing water under the vibrating pressure as shown in FIG. 19 decreases to the value expressed by the duty ratio. The flow rate of the vibrating stream varies in a range of a maximum flow rate Qmax to a minimum flow rate Qmin, whereas the flow velocity varies in a range of a maximum flow velocity Vmax to a minimum flow velocity Vmin as shown in FIG. 30. In the example of FIG. 30, neither the minimum flow rate Qmin nor the minimum flow velocity Vmin is equal to zero, since the minimum vibrating pressure by the vibration generator 74 does not reach zero as mentioned previously.

When the primary pressure Pin is regulated by the pressure control valve 54 as described previously, the vertical shift of the vibration varies the maximum flow rate Qmax, the minimum flow rate Qmin, the maximum flow velocity Vmax, and the minimum flow velocity Vmin shown in FIG. 30. Namely the flow rate of the water spray is adjusted by regulating the primary pressure Pin.

Figure 31A:
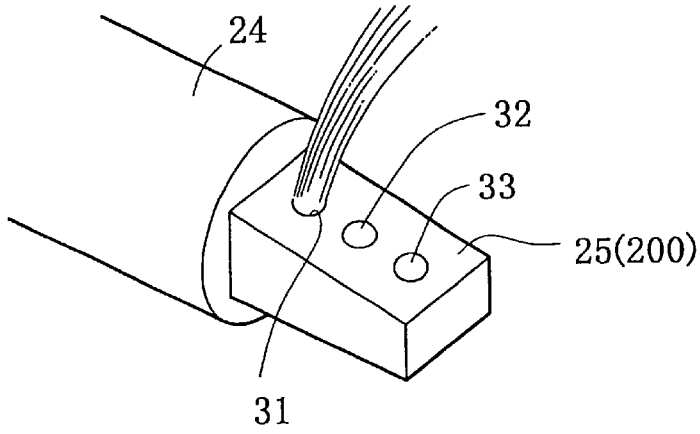
FIG. 31 schematically illustrates a process of spraying the cleansing water from a nozzle opening 31 for bidet-back in the nozzle head 200.
Figure 31B:
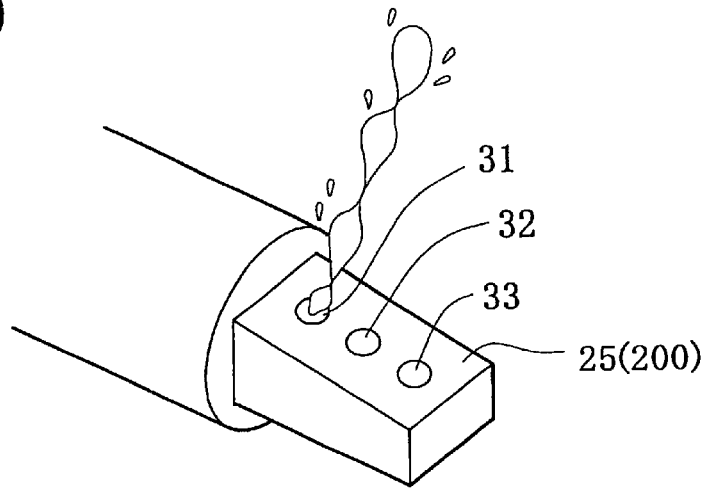

In the conventional technique, cleansing water is sprayed in the form of a continuous flow from the nozzle opening (for example, the nozzle opening 31 for bidet-back) as shown in FIG. 31(A). In the technique of this embodiment, on the other hand, the vibrating stream of cleansing water is sprayed in the form of a discrete flow or in the form of water masses as shown in FIG. 31(B). The reason why the vibrating stream of cleansing water generated by the vibration generator 74 is sprayed from the nozzle opening in the nozzle in the form of a discrete flow or in the form of water masses is discussed below with the drawings of FIGS. 30 and 32.

Figure 32A:
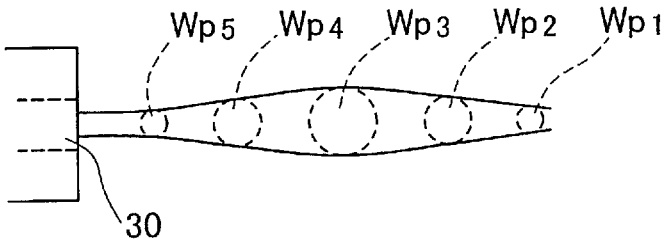
FIG. 32 shows a process of amplifying the cleansing water sprayed from a nozzle opening 30 to the vibrating stream.
Figure 32B:
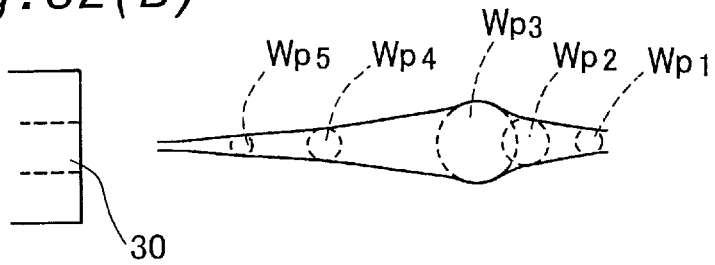
Figure 32C:
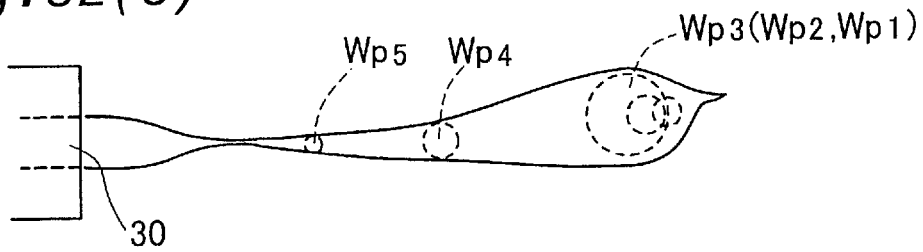

FIG. 32 shows a process of amplifying the cleansing water sprayed from a nozzle opening 30 to the vibrating stream. As shown in FIG. 30(A), when the vibration generator 74 causes a vibration of the flow rate of the cleansing water, the flow velocity V similarly varies to cause a vibration. Namely the sprayed cleansing water has the maximum flow velocity Vmax at the point of the maximum flow rate Qmax. Both the instantaneous flow velocity and the instantaneous flow rate vary with time. In the example of FIG. 30, it is assumed that the vibrating stream of cleansing water has respective sites Wp1, Wp2, Wp3, Wp4, and Wp5. Here their flow rates hold a relation of Wp1(≈Wp5)<Wp2(≈Wp4)<Wp3, and the corresponding flow velocities hold a relation of V1(≈V5)<V2(≈V4)<V3. With a shift of the time from the time point immediately after the water spray to the time points of FIGS. 32(A) to 32(C), the site Wp3 having the higher velocity than the site Wp2 is integrated with Wp2 and then further with the site Wp1 to form a large water mass.

In this manner, the site Wp3 having the maximum flow velocity successively joins with the preceding sites Wp2 and Wp1 to form a large water mass, which hits against the private part (body-cleansing surface to be cleaned). The spray of cleansing water hitting against the private part forms the water mass having a large collision energy (cleansing power). The flow velocity V3 of the water mass is equal to the maximum flow velocity Vmax shown in FIG. 30. The vibrating stream of cleansing water is accordingly sprayed from the nozzle openingsuch that the integrated water mass appears at every vibration cycle MT. The water mass formed by joining the site Wp3 of the maximum flow velocity with the preceding sites repeatedly appears, and the water mass appearing at a certain spray timing and the water mass appearing at a next spray timing are shifted (sprayed) at a substantially identical velocity (maximum velocity). The respective water masses are further joined with the sites Wp4 and Wp5 that are sprayed after the site Wp3 having the maximum flow velocity.

The following describes a difference in cleansing power between the spray of cleansing water from the nozzle opening 31 for bidet-back in the form of a continuous flow and that in the form of a vibrating stream. Compared with the continuous flow of the prior art technique, the vibrating stream has a two-fold or greater cleansing power at a fixed flow rate. This is ascribed to the following reason. When cleansing water having a mass m collides against a wall surface at a velocity V, energy E is expressed by Equation (1) given below:

$$E=(1/2)mV^2 \quad (1)$$

Where f denotes a force of collision against the wall surface and Δt denotes a time cycle until the stream of cleansing water at the velocity V gradually slows down to disappear, the energy E is expressed as an impulse by Equation (2) and the force f is expressed with a deceleration a by Equation (3) given below:

$$E=f\Delta t \quad (2)$$

$$F=m\alpha \quad (3)$$

Figure 33:
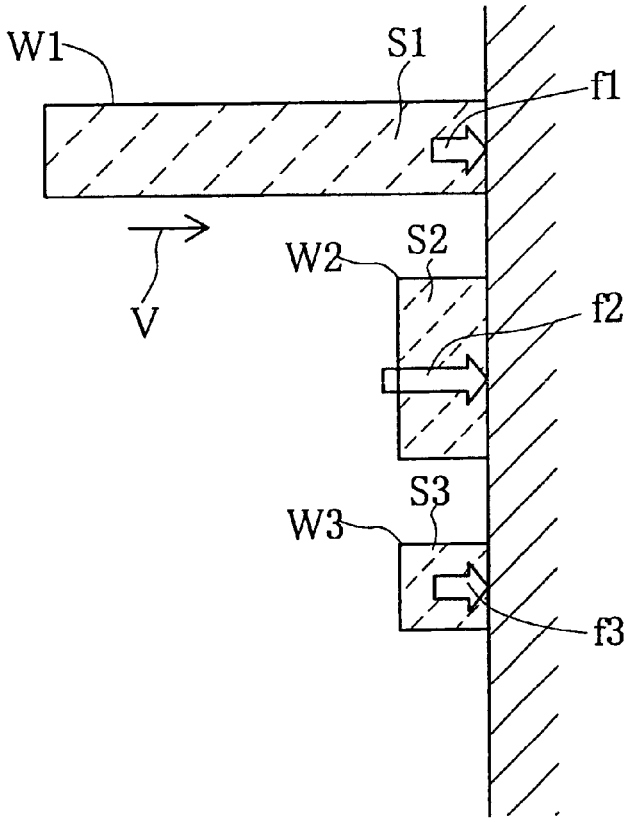
FIG. 33 shows a stream of cleansing water hit against a wall surface.

FIG. 30 shows a stream of cleansing water hit against a wall surface. In the example of FIG. 33, it is assumed that the stream of cleansing water forms three different types of water masses W1, W2, and W3, and the cleansing power of these water masses is discussed. The water mass W1 is long and has a sectional area S1. The water mass W2 is short and has a sectional area S2, which is twice the sectional area S1. The water mass W3 has the sectional area S1 and a length of one half the length of the water mass W1. Here the water mass W1 corresponds to a continuous flow, and the water mass W3 corresponds to a vibrating stream . Time cycles Δt1 and Δt2, in which the water masses W1 and W2 respectively collide against the wall surface and disappear, hold a relation of Δt1>Δt2. According to Equation (3) given above, this means that the water mass having the greater deceleration a disappears with the greater force in the shorter time cycle. Forces f1 and f2 of the water masses W1 and W2 accordingly hold a relation of f1<f2. Compared with the water mass W1 of the continuous flow, the water mass W2 disappears in the shorter time cycle and applies the greater force f2 to the private part. The water mass W3 corresponding to the vibrating stream has a mass m/2, which is half the mass m of the water mass W1, while having a force f3 substantially equivalent to the force f1. The spray of vibrating stream collides against the private part with a substantially equivalent force but a smaller quantity of water, compared with the continuous flow, and thus enables the excrement on the private part to be removed with a sufficiently strong power.

Figure 34:
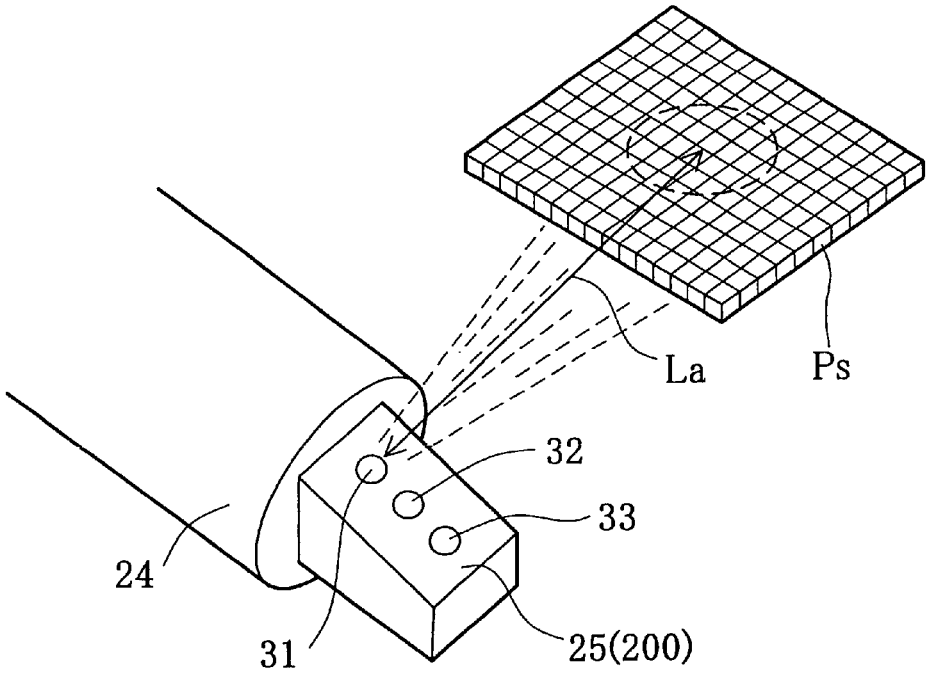
FIG. 34 shows a pressure sensor plate Ps disposed to face the nozzle opening 31 for bidet-back across a predetermined distance La.
Figure 35A:
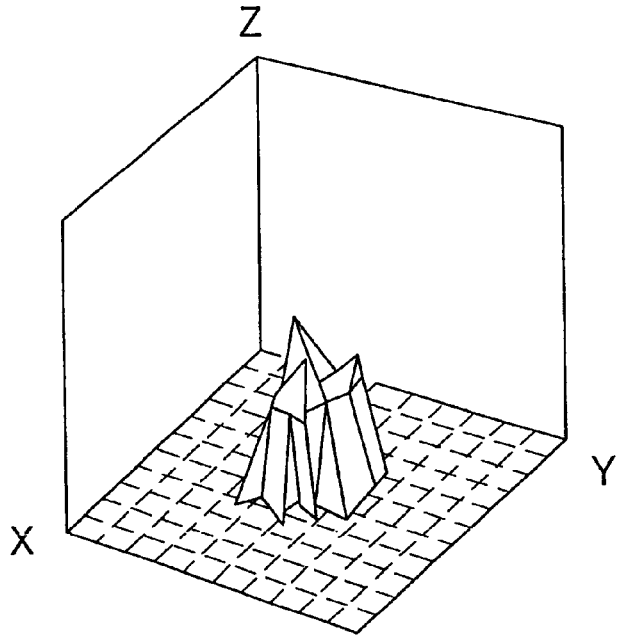
FIG. 35 shows the relationship between the position on the pressure sensor plate Ps and the peak pressure value in a three dimensional manner.
Figure 35B:
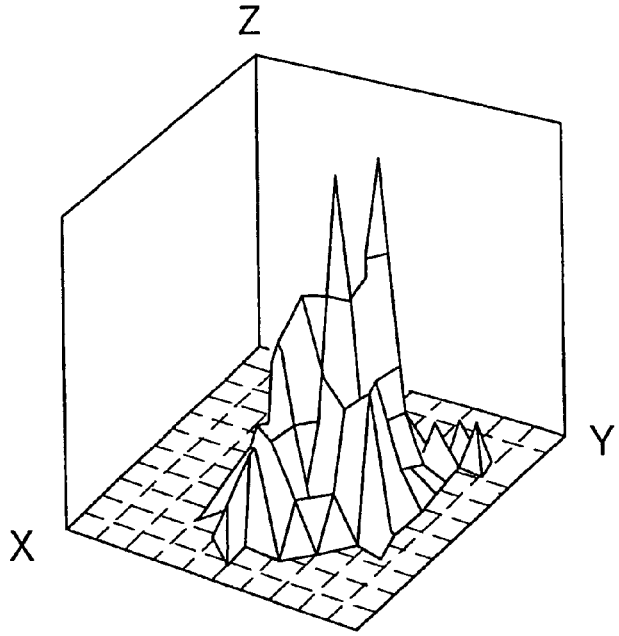

The following describes the relationship between the cleansing power and the feeling of quantity, which are indexes defining the clean up feeling on the private part. FIG. 34 shows a pressure sensor plate Ps disposed to face the nozzle opening 31 for bidet-back across a predetermined distance La. The predetermined distance La corresponds to the cleansing position where the private part is actually cleaned. The pressure sensor plate Ps has detection elements in the form of a two-dimensional matrix and outputs the observed values of the respective detection elements independently. The peak pressure values output from the respective detection elements of the pressure sensor plate were measured when cleansing water was sprayed from the nozzle opening 31 for bidet-back formed in the nozzle 24. The results of the measurement are shown in FIG. 35. FIG. 35 shows the relationship between the position on the pressure sensor plate Ps and the peak pressure value in a three dimensional manner. An X-Y plane represents the position on the pressure sensor plate Ps, that is, the position of an object to be measured. A Z axis represents the peak pressure value at each position. FIG. 35(A) shows the results of the measurement in the case where cleansing water fed to the nozzle opening was a continuous flow at a flow rate of 1.1 liter/min. FIG. 35(B) shows the results of the measurement in the case where cleansing water fed to the nozzle opening was a vibrating stream at a flow rate of 0.5 liter/min. In the graphs of FIG. 35, the cleansing power and the feeling of quantity, which are the factors to define the clean up feeling, are respectively expressed by the peak pressure value and by the total volume of heaps in a pressure distribution.

Figure 36A:
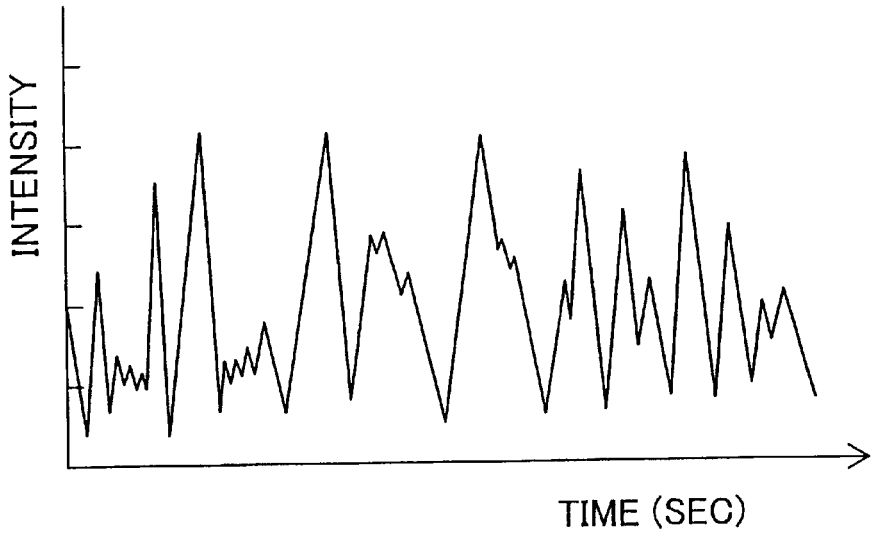
FIG. 36 is timing charts showing detection signals observed at one detection element.
Figure 36B:
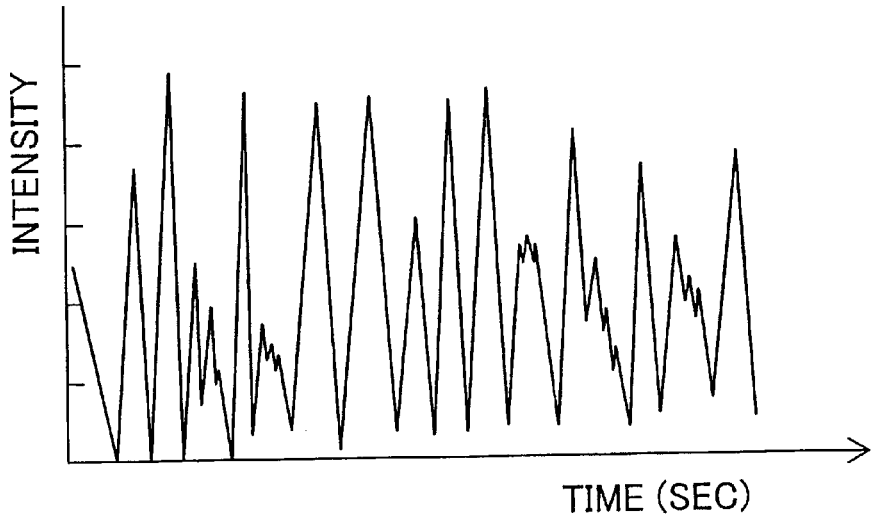

These results show that the vibrating stream of FIG. 35(B) has a half flow rate of the cleansing water but a significantly enhanced peak pressure value, compared with the continuous flow of FIG. 35(A). This shows a greater cleansing pressure against an object to be cleaned, that is, a greater cleansing power. FIG. 36 is timing charts showing detection signals observed at one detection element. FIG. 36(A) shows the detection signal of the continuous flow, and FIG. 36(B) shows the detection signal of the vibrating stream. The vibrating stream has a higher peak and a greater intensity than the continuous flow. The vibrating stream shown in FIG. 35(B) has a significantly greater total volume of heaps in the pressure distribution than the continuous flow shown in FIG. 35(A). The vibrating stream gives the feeling of an extremely greater quantity than the continuous flow. When the clean up feeling, which is a sensual factor, is expressed numerically, the vibrating stream has the better cleansing power.

Figure 37:
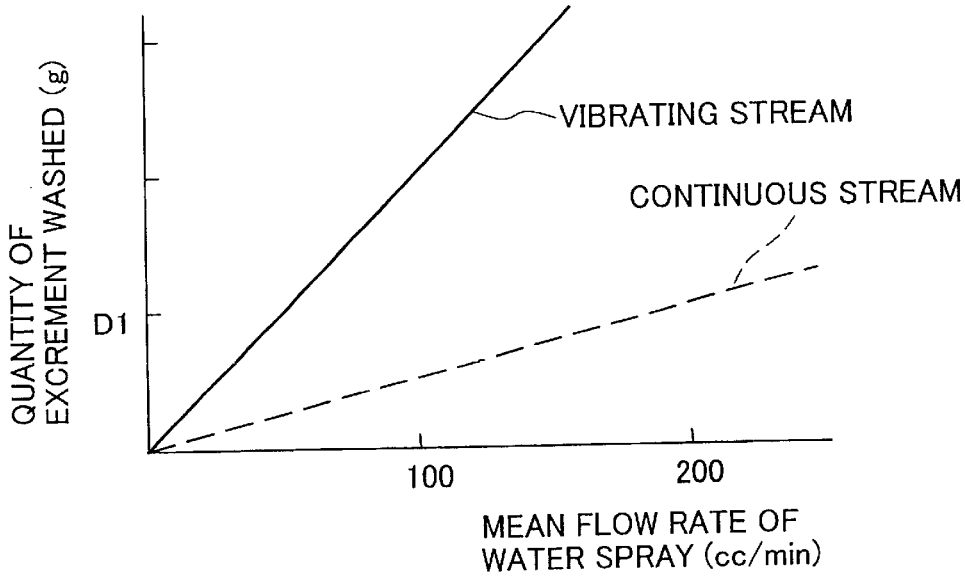
FIG. 37 is a graph showing the relationship between the mean flow rate of water spray and the quantity of excrement cleaned.

The comparison between the actual quantity of excrement cleansed by the vibrating stream and that by the continuous flow is shown in FIG. 37. FIG. 37 is a graph showing the relationship between the mean flow rate of water spray and the quantity of excrement cleaned. Namely each plot shows the mean flow rate of water spray required when the excrement on the private part is cleansed out with the spray of cleansing water. As clearly understood from the graph of FIG. 37, the vibrating stream cleanses out a quantity D1 of excrement on the private part with a flow rate that is approximately one quarter of the flow rate of the continuous flow in the prior art technique. The method of spraying the vibrating stream of cleansing water from the nozzle opening remarkably enhances the cleansing power and improves the clean up feeling of the user.

The vibrating stream of cleansing water has the enhanced cleansing power and applies a greater stimulus to the private part. This is ascribed to the following reason. It is here assumed that application of perceptible stimuli (in this embodiment, stimuli by the collision of the water masses W1, W2, and W3 shown in FIG. 33) is intentionally repeated to a fixed part on the skin of the body part. People perceive the repeated stimuli as vibrating stimuli when the stimuli have a long interval of repetition (the vibration cycle MT in this embodiment) and a low frequency of repetition. When the stimuli have a short interval of repetition and a high frequency of repetition, on the other hand, people perceive the intentionally repeated stimuli not as vibrating stimuli but as a continuous stimulus. There is accordingly a range of unperceptible frequency, in which people are not capable of perceiving the repeated stimuli applied to the skin of the body part as vibrating stimuli.

Here it is assumed that the spray of cleansing water is sprayed against the skin of the private part while the flow rate or the flow velocity of cleansing water is repeatedly changed (hereinafter referred to as the repeated water spray). In this case, the strength and weakness of the stimulus by the water spray varies in a repeated manner. The repeated water spray is accordingly perceived by the vibrating stimuli on the skin of the private part. When the repeated water spray occurs at a frequency of not lower than about 5 Hz in the unperceptible frequency range, the user hardly perceives the vibrations due to the intentional repeated water spray. Since the user hardly perceives the form of the intentionally repeated water spray (that is, the spray of cleansing water in the vibrating stream), it is achieved to reduce the discomfort of the user due to the useless vibrations. The higher frequency of repeated water spray makes it more difficult for the user to perceive the vibrations due to the intentional repeated water spray. When the repeated water spray occurs at the frequency of not lower than about 10 Hz, most people having the standard sensibility hardly perceive the vibrations due to the intentional repeated water spray. This makes it difficult for the user to perceive the intentional repeated water spray (that is, the spray of cleansing water in the vibrating stream), and further reduces the discomfort of the user due to the useless vibrations.

When the frequency of repetition is not lower than about 15 Hz, which exceeds the vibration-perceivable frequency in the average site of the skin, most people having the standard sensibility do not feel any discomfort. When the frequency of repetition is not lower than about 20 Hz, which exceeds the vibration-perceivable frequency in the sensitive site of the skin, most people having the standard sensibility feel the continuous, good clean up feeling. When the frequency of repetition is not lower than about 30 Hz, which exceeds the vibration-perceivable frequency in the extremely sensitive site of the skin with the concentrated nerves, most people having the standard sensibility feel the soft clean up feeling. When the frequency of repetition is made coincident with the commercial frequency (for example, 50 Hz in the area having the commercial frequency of 50 Hz and 60 Hz in the area having the commercial frequency of 60 Hz), this facilitates the driving process. As discussed above, the higher frequency makes the user more securely feel the continuous clean up feeling and ensures the sufficient effects on the user who requires the softer clean up feeling.

In the low frequency domain of 5 to 20 Hz in the unperceptible frequency range, the user does not generally perceive the variation in stimulus against the private part as mentioned above. The user who suffers from hemorrhoids or is in a menstrual period may, however, slightly perceive the variation in stimulus in the process of the spray of cleansing water in such a low frequency domain. The low frequency domain may thus be set as a boundary zone of the unperceptible frequency range. For example, the frequency domain of about 5 Hz to about 60 Hz or 80 Hz may be set as the boundary zone, and the frequency domain higher than this boundary zone may be set as the real unperceptible frequency range. This arrangement ensures the user's non-perception of the variation in stimulus.

In the course of the intentionally repeated water spray in the form of the vibrating stream of cleansing water, the higher frequency of repetition makes it more difficult for people to perceive vibrations due to the intentional repeated water spray. When the frequency of repetition is not lower than about 10 Hz, most people having the standard sensibility hardly perceive the vibrations due to the intentional repeated water spray. The form of the intentionally repeated water spray (that is, the spray of cleansing water in the vibrating stream) is thus practically imperceptive. In this embodiment, the users who receive the collisions of the water masses shown in FIG. 33, that is, most people having the standard sensibility, do not feel the collisions of the water masses as intermittent but feel a continuous flow of cleansing water.

Figure 38A:
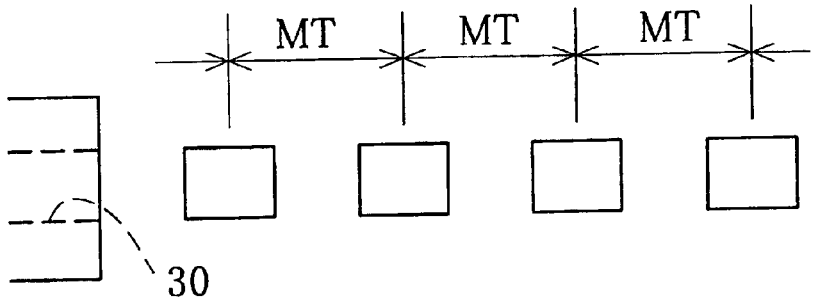
FIG. 38 shows a reason why the cleansing power varies with a variation in frequency.
Figure 38B:
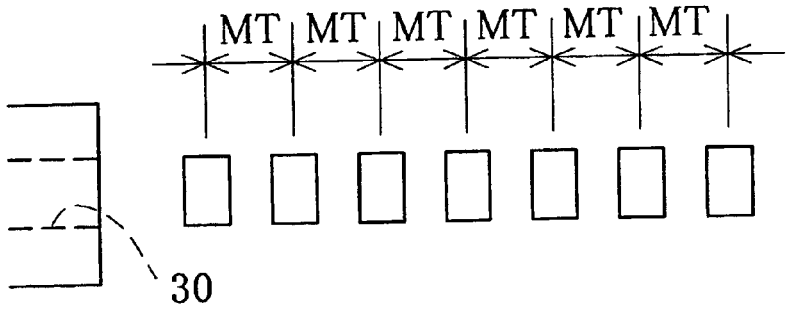

This is further explained with the drawing. FIG. 38 shows a reason why the cleansing power varies with a variation in frequency. FIG. 38(A) shows a state having a longer vibration cycle MT and thereby a lower vibration frequency fmt (=1/MT) defined by this cycle than the state of FIG. 38(B) under the condition of a fixed flow rate of the cleansing water. The state of FIG. 38(A) and the state of FIG. 38(B) have different vibration cycles and thereby cause different sizes of water masses. In the case of FIG. 38(A) having the longer vibration cycle MT and the lower vibration frequency, the water mass at one collision has a greater mass and greater collision energy and accordingly gives a stronger stimulus to the private part. This means that the private part receives a large, strong stimulus at once in the case of FIG. 38(A). In the case where the vibration frequency fmt is lower than or rather close to the unperceptible frequency like FIG. 38(A), the private part repeatedly receives strong stimuli, which are perceived by the user each time. The user accordingly feels strongly stimulated.

Figure 39:
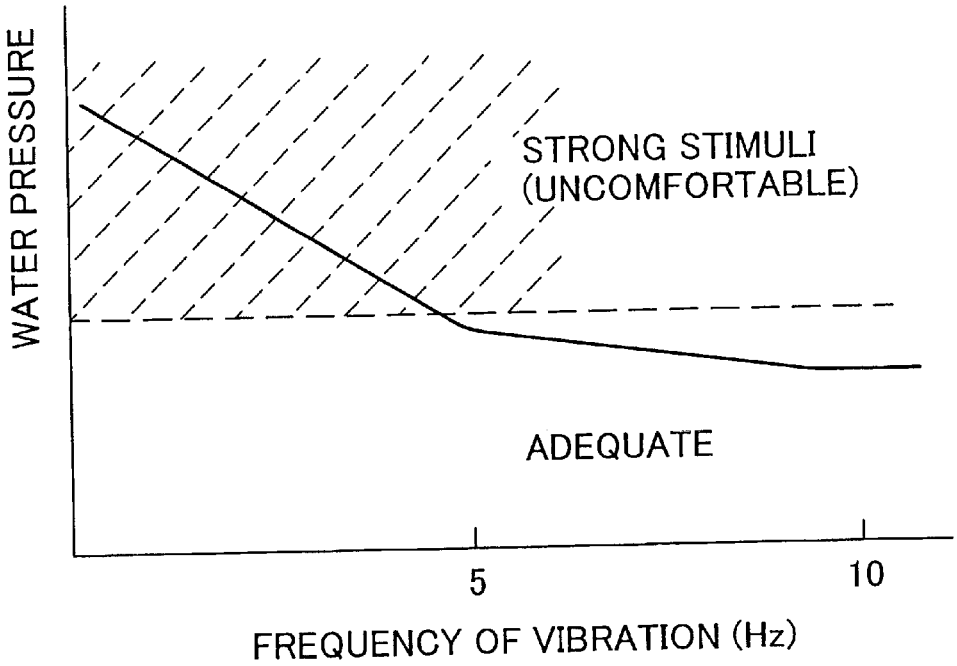
FIG. 39 is a graph showing the relationship between the vibration frequency of the vibrating stream, the cleansing power, and the uncomfortable feeling due to the stimulus applied to the private part.

In the case where the vibration frequency fmt is higher to be in the range of unperceptible frequency like FIG. 38(B), on the other hand, the private part receives weak stimuli as a continuous stimulus as discussed above. The user accordingly feels weakly stimulated. Under the condition of a fixed flow rate of water spray, the higher frequency causes a greater water mass and gives a stronger stimulus (cleansing power) to the private part. FIG. 39 is a graph showing the relationship between the vibration frequency of the vibrating stream, the cleansing power, and the uncomfortable feeling due to the stimulus applied to the private part. The skin of the body part feels the vibrating stream having a vibration frequency of higher than 5 Hz similar to a continuous flow and has soft clean up feeling. The vibrating stream having a vibration frequency of higher than about 30 Hz is not distinguishable from the continuous flow. It is accordingly preferable that the vibrating stream has the frequency of not lower than 5 Hz. When the frequency of the commercial power source having the upper limit of 50 or 60 Hz is utilized for excitation of the vibration generating coil 74*c* of the vibration generator 74, the structure of the control procedure is simplified.

In the technique of this embodiment, from the viewpoint of the unperceptible frequency, the excitation cycle of the vibration generating coil 74*c*, that is, the vibration cycle MT, is varied such that the vibration frequency ftm (=1/MT) is in a specific frequency range of not lower than about 5 Hz. This causes the stimuli of the water masses to the private part to be perceived as a continuous stimulus. Although the masses of cleansing water are only intermittently sprayed against the private part at the vibration frequency MT to reduce the flow rate of the cleansing water, the user feels a continuous spray of cleansing water against the private part. Even when the maximum flow rate of the cleansing water is decreased to about 500 cc/min, which is approximately ½ to ⅓ the flow rate in the conventional technique, by means of the flow regulation valve 65, the arrangement of the embodiment ensures the sufficiently high cleansing power and desired clean up feeling by the spray of cleansing water up to this maximum flow rate. This arrangement enables the user to feel a continuous water spray, while enhancing the water consumption efficiency.

Even when the vibration frequency ftm is set in the range of unperceptible frequency, the lower vibration frequency ftm gives the user less continuous feeling of sprayed cleansing water. The method of intentionally lowering the vibration frequency ftm in the range of unperceptible frequency gives the user the clean up feeling (stimuli) of little intermissions.

Figure 40:
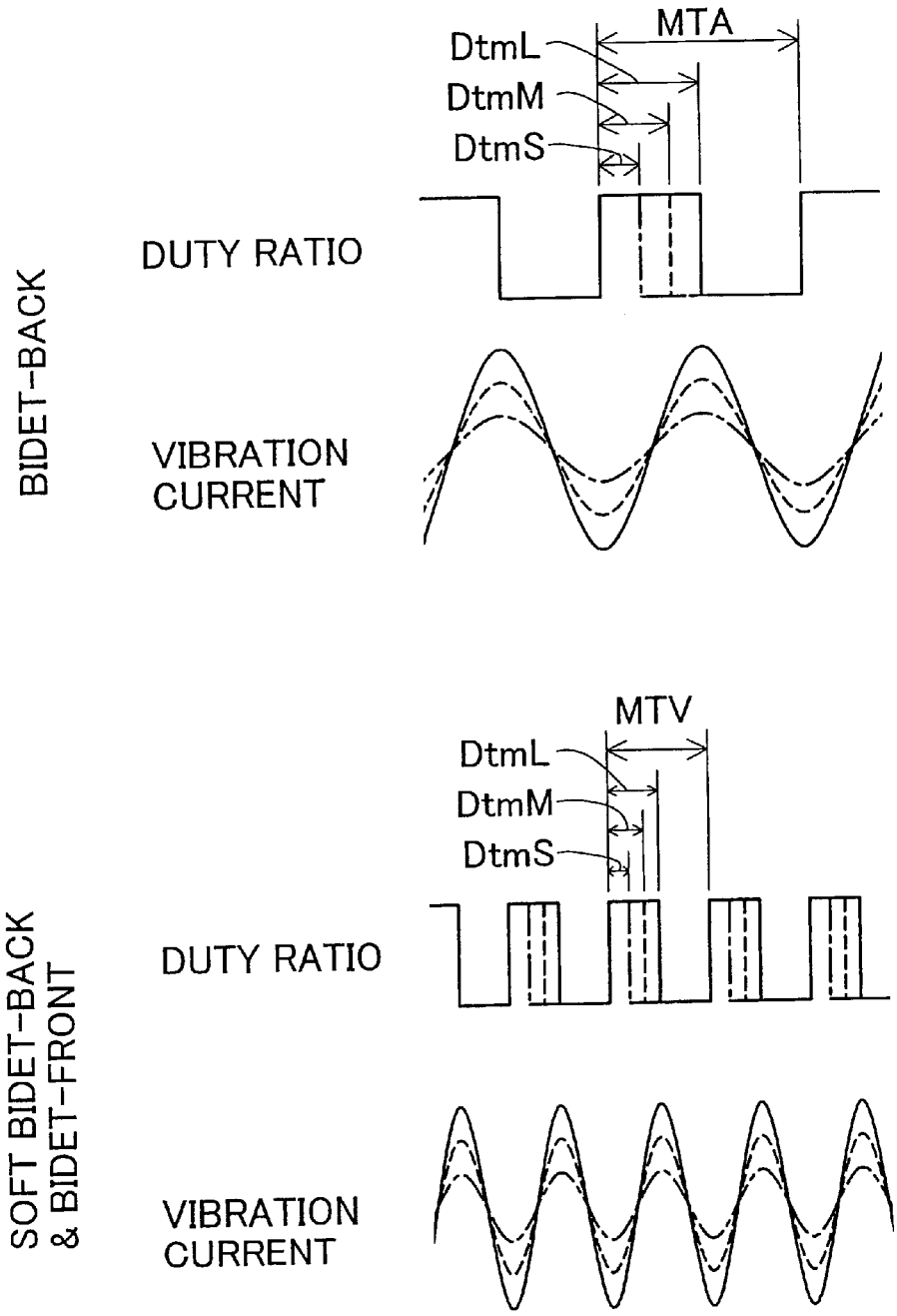
FIG. 40 shows an example of regulation in which different values are set to the vibration frequency in the vibrating stream of cleansing water for bidet-back and for bidet-front.
Figure 41A:
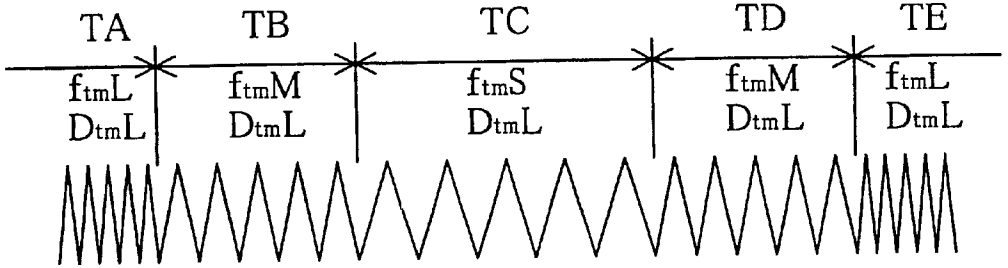
FIG. 41 shows an example of regulating the vibration frequency ftm and the duty ratio Dtm.
Figure 41B:
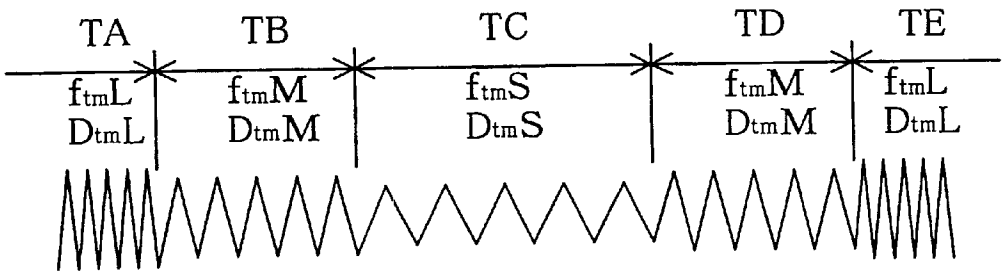

The vibration frequency and the duty ratio for coil excitation may be regulated in the following manner. FIG. 40 shows an example of regulation in which different values are set to the vibration frequency in the vibrating stream of cleansing water for bidet-back and for bidet-front. FIG. 41 shows an example of regulating the vibration frequency ftm and the duty ratio Dtm.

Referring to FIG. 40, different values are set to a vibration cycle MTA for bidet-back and to a vibration cycle MTV for gentle bidet-back and bidet-front, so that the vibration frequency ftm has different values. Here a vibration frequency ftmA for bidet-back is set to be lower than a vibration frequency ftmV for gentle bidet-back and bidet-front. Both the vibration frequencies ftmA and ftmV are in the range of unperceptible frequency. For example, the vibration frequency may be set equal to 50 Hz for bidet-back, equal to 60 Hz for gentle bidet-back, and equal to 70 Hz for bidet-front. In another example, the vibration frequency may be set equal to about 71 Hz for bidet-back, equal to about 71 Hz for gentle bidet-back, and equal to about 83 HZ for bidet-front. This leads to the smaller water pressure in the case of bidet-front than that in the case of bidet-back and gentle bidet-back as discussed below.

The control of the frequency corresponding to the private part to be cleansed as shown in FIG. 40 attains the water spray process close to FIG. 38(A) in the case of bidet-back as discussed previously with FIG. 38. This continually gives the sufficiently strong stimuli, so that the user has relatively hard clean up feeling. In the case of gentle bidet-back or bidet-front, on the other hand, the frequency control attains the water spray process shown in FIG. 38(B). This continually gives the relatively weak stimuli, so that the user has soft clean up feeling. The higher vibration frequency ftm is set in the case of gentle bidet-back or bidet-front to prevent the user feel intermittent stimuli. This arrangement ensures the continuous soft clean up feelinguch diverse clean up feeling may be attained while the flow rate is reduced as discussed previously.

As shown by the dotted line or the one dot chain line, the duty ratio Dtm may be varied under the condition of a fixed vibration frequency ftm for each cleansing. The duty ratio Dtm defines the excitation force of the coil, that is, the moving speed and the moving distance of the plunger 74*b* in the vibration generator 74, and varies the amplitude of the vibration. The flow rate of the cleansing water and the flow velocity shown in FIG. 30 are thus regulated according to the duty ratio Dtm. This leads to control of the water mass shown in FIG. 38 for each cleansing and enables regulation of the intensity of stimulus and cleansing power on either soft clean up feeling or hard clean up feeling. The water pressure is also regulated with a variation in flow velocity. In other words, regulation of the duty ratio or the frequency of the vibrating stream ensures the user desired clean up feeling and water pressure. This arrangement significantly reduces the total required quantity of cleansing water as discussed previously. Control of the duty ratio and control of the frequency are irrespective of the regulation of the flow rate with the flow regulation valve 65, and thus ensure a certain level of adjustment of the water pressure, which is not attained by regulating the flow rate with the flow regulation valve 65. Namely control of the duty ratio and control of the frequency compensate for regulation of the flow rate with the flow regulation valve 65. Combination of adjustment of the water pressure through the regulation of the flow rate with the flow regulation valve 65 with adjustment of the water pressure through the control of the duty ratio and the control of the frequency enables fine adjustment of the water pressure.

As the duty ratio Dtm is changed among DtmS, DtmM, and DtmL for each cleansing of bidet-back or bidet-front as shown in FIG. 40, the duty ratio Dtm affects the stroke length of the plunger (the moving distance), that is, the size of the water mass shown in FIGS. 33 and 38. The greater duty ratio Dtm results in the greater water mass. The size of the water mass specifies the cross section of the water mass shown in FIG. 33. The cleansing area as the hitting range of the water mass is widened with an increase in duty ratio Dtm. Regulation of the duty ratio Dtm accordingly adjusts the intensity of stimulus, cleansing power, the water pressure, as well as the cleansing area.

As shown in FIG. 41, only the vibration frequency ftm may be regulated, or both the vibration frequency ftm and the duty ratio Dtm may be regulated simultaneously. In the example of FIG. 41(*a*), the duty ratio Dtm is fixed to a value DtmL in cleansing time cycles TA, TB, TC, . . . in the course of cleansing process, and the vibration frequency ftm is varied in the respective cleansing time cycles. In the illustrated example, the vibration frequency ftm is changed among ftmS, ftmM, and ftmL (where ftmS<ftmM<ftmL). The vibration frequency ftm may otherwise be changed between two stages, among four stages, or in a stepless manner. This allows a change of the hard-soft clean up feeling over the different cleansing time cycles and varies the intensity of stimulus, thereby attaining the diverse clean up feeling.

The different frequencies lead to different time intervals of the continuous collision of the water mass. Namely the water pressure due to the collision of the water mass is adjusted by regulating the frequency. The control of the frequency is regardless of the regulation of the flow rate with the flow regulation valve, and thus enables a certain level of adjustment of the water pressure, which is not attained by regulating the flow rate with the flow regulation valve. Namely control of the frequency compensates for regulation of the flow rate with the flow regulation valve. Combination of adjustment of the water pressure through the regulation of the flow rate with the flow regulation valve with adjustment of the water pressure through the control of the frequency enables fine adjustment of the water pressure.

The respective cleansing time cycles may be an identical time interval or different time intervals. In the latter case, the time interval may be varied in a regular manner or in an irregular manner. For example, when the different time intervals are tS, tM, and tL (where tS<tM<tL), the time interval may be varied regularly like tS, tM, tL, tS, tM, . . .

or irregularly like tL, tS, tS, tM, tL, tM, . . . The irregular variation in time interval may be based on random digits generated according to a loaded random digit generating program.

In the example of FIG. 41(*b*), the duty ratio Dtm is varied in cleansing time cycles TA, TB, TC, . . . in the course of cleansing process. In the illustrated example, the duty ratio Dtm may be changed among DtmS, DtmM, and DtmL (where DtmS<DtmM<DtmL). The duty ratio Dtm may otherwise be changed between two stages, among four stages, or in a stepless manner. In addition, the vibration frequency ftm is varied in the respective cleansing time cycles as discussed above. This further enhances the diversity of clean up feeling. In this case, the respective cleansing time cycles may be an identical time interval or different time intervals varied in a regular manner or in an irregular manner.

Figure 42:
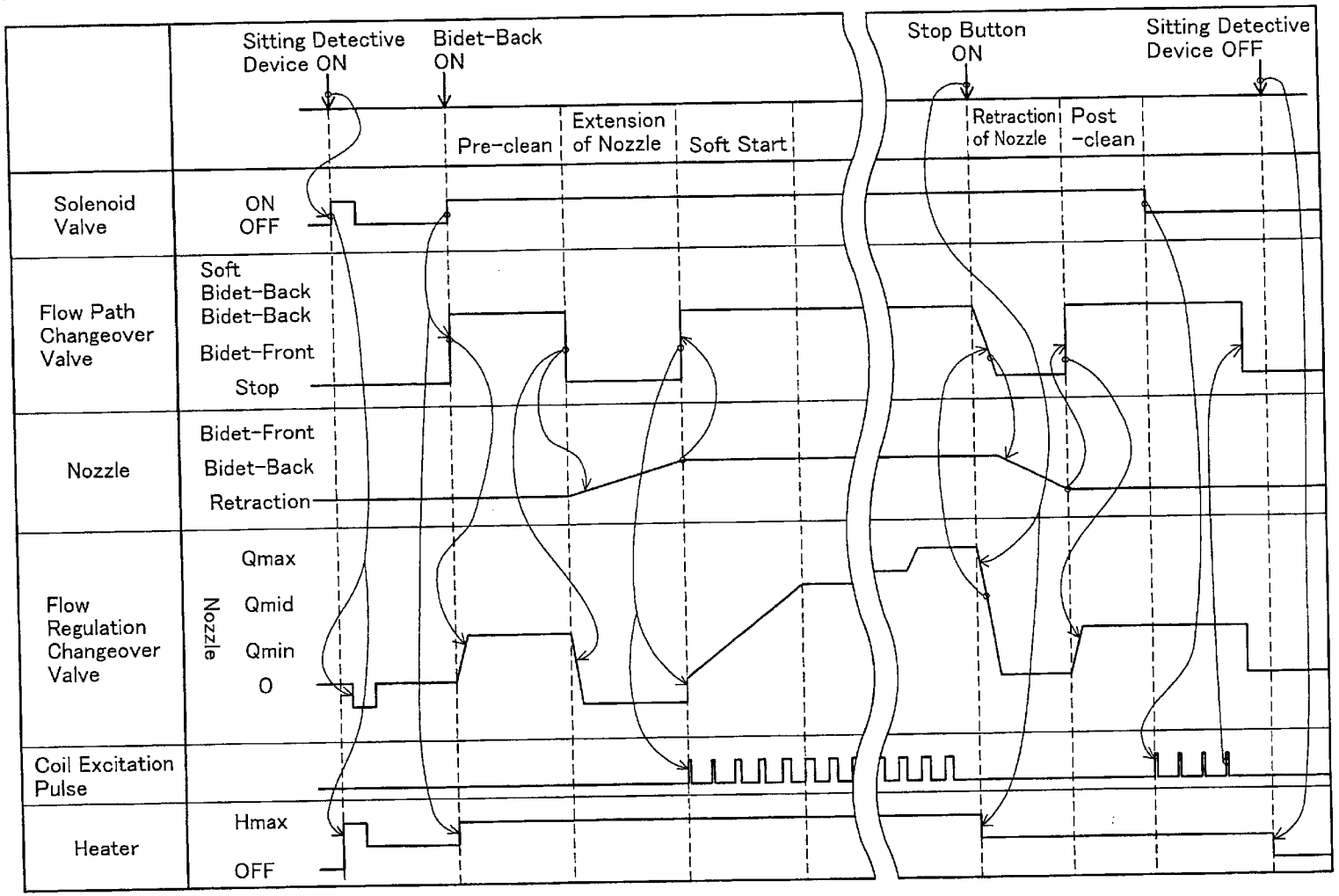
FIG. 42 is a time chart showing cleansing operations carried out by the personal hygiene appliance of the embodiment.

The following describes cleansing operations carried out by the personal hygiene appliance 10 of the embodiment having the configuration discussed above. FIG. 42 is a time chart showing cleansing operations carried out by the personal hygiene appliance of this embodiment.

As illustrated, in the personal hygiene appliance of the embodiment, when the user sits on the toilet seat 18 (see FIG. 15) to turn the sitting detective device SS10 (see FIG. 21) ON, the solenoid valve 55 (see FIG. 16) in the water supply valve unit 50 opens in response to the ON signal. This starts a supply of cleansing water into the personal hygiene appliance. For the purpose of preliminary heating of cleansing water before an actual cleansing operation, the full power is supplied to the heater 61. The supply of cleansing water immediately after the user's seating action in response to the ON position of the solenoid valve flows through a non-illustrated pipe and is discharged to the toilet bowl or to the surface of the nozzle head for cleaning the nozzle head.

The process of feeding and heating a supply of cleansing water carried out immediately after the user sits on the toilet seat is stopped after elapse of a predetermined time cycle since the ON detection of the sitting detective device or when the observed temperature of the flow-out water temperature sensor SS16*b* reaches a preset level (for example, a temperature of two or three degrees below the temperature of warm cleansing water for cleansing the private part). The stopping process closes the solenoid valve and reduces the power supply to the heater (for example, approximately 2% of the full power supply), before the personal hygiene appliance is set in the stand-by state to wait for a subsequent operation of any Cleanse button. The full power supply to the heater for a short time cycle immediately after the user sits on the toilet seat and the subsequent reduced power supply to the heater enable the cleansing water to be heated preliminarily and keep the heated temperature. This does not require any abrupt control of power supply to the heater in the subsequent process of cleansing the private part. As discussed above, the technique of this embodiment effectively reduces the flow rate of the cleansing water and thereby reduces the power consumption of the heater.

In response to an ON operation of any Cleanse button, for example, the Bidet-Back button SWb, the process opens the solenoid valve 55 to supply cleansing water for bidet-back, and supplies the full power to the heater 61. The full power supply to the heater 61 continues until the Stop button SWa is operated. The process of closing the solenoid valve will be discussed later.

When the solenoid valve 55 opens, prior to the actual cleansing of the private part, the nozzle pre-clean is carried out to cleanse the nozzle head 25. After the solenoid valve 55 is open, the destination of the supply of cleansing water is changed over to the nozzle flow path for bidet-back formed in the nozzle 24 with the flow path changeover valve 71. The flow regulation valve 65 is then actuated to set the flow rate of cleansing water. This causes the cleansing water of the regulated flow rate to be fed to the nozzle 24 and sprayed from the nozzle opening 31 for bidet-back. In this state, the nozzle 24 is located at its stand-by position, and the nozzle head 25 is covered with a chamber 41c (see FIG. 22) on the end of the nozzle support member 41*b*. The nozzle head 25 is cleansed with a splash of water spray against the chamber 41*c*. The water supply at the nozzle pre-clean step causes the cleansing water preliminarily heated to the appropriate temperature through the full power supply to the heater to run through the conduit leading to the nozzle head 25.

The cleansing water of the appropriate temperature is thus sprayed against the private part from the beginning of a main cleansing process, which will be discussed later. This arrangement effectively prevents the user from feeling uncomfortable due to the spray of cold cleansing water. Subsequent to the change-over of the flow path with the flow path changeover valve 71 located downstream the flow regulation valve 65, the flow regulation valve 65 is actuated to set the flow rate. The flow path changeover valve 71 is accordingly driven in a practically non-loading state, which is substantially free from the pressure of cleansing water, and thereby applies no overload to the driving motor 71*k*. In the nozzle pre-clean process, the vibration generator 74 may be driven to cause the nozzle head 25 to be cleansed with the vibrating stream of cleansing water. In this case, the vibration frequency ftm of the coil may be in the range of unperceptible frequency or out of the range.

The nozzle pre-clean stops after elapse of a preset time cycle. As illustrated, the stopping process first sets the upstream flow regulation valve 65 in the zero flow position to cut off the stream of cleansing water to the nozzle 24. The process then changes over the position of the flow path changeover valve to stop the water supply and concludes the nozzle pre-clean. At the time of concluding the nozzle pre-clean, the flow path changeover valve 71 is driven in the practically non-loading state and thereby applies no overload to the driving motor 71*k*.

Subsequent to the nozzle pre-clean, the nozzle driving motor 42 of the nozzle unit 40 is driven in the normal direction to extend the nozzle 24 from the stand-by position to the bidet-back cleansing position. In the course of the extension of the nozzle, the solenoid valve is kept open, and the supply of cleansing water runs through the non-illustrated pipe and is discharged to the toilet bowl. In one possible modification, the pipe for the water discharge may be connected to a flow regulation changeover valve, which is used instead of the flow regulation valve 65, and the flow path may be changed over with this flow regulation changeover valve. In another possible modification, the discharged water may be led to a non-illustrated value-added water unit for generating value-added water (free chlorine water), and the value-added water may be sprayed from the chamber 41*c*. The cylindrical section 24*a* of the nozzle 24 is thus cleansed and sterilized with the value-added water in the course of nozzle extension.

The similar series of processing is carried out before completion of the extension of the nozzle in response to an operation of the Soft Bidet-Back button or the Bidet-Front button, with only differences in nozzle flow path specified by the flow path changeover valve and in extended position of the nozzle (the bidet-front cleansing position in the case of the Bidet-Front button) corresponding to the operated Cleanse button.

After completion of the extension of the nozzle 24 to the required cleansing position, the main cleansing process to cleanse the private part (bidet-back, gentle bidet-back, or bidet-front) is performed in response to the operated Cleanse button. As illustrated, in the case of bidet-back, a series of soft start processing is carried out to start spraying the vibrating stream of cleansing water from the nozzle opening 31 for bidet-back. The procedure first actuates the flow path changeover valve 71 to select the nozzle flow path for bidet-back and regulates the flow rate of the cleansing water to gradually increase from zero to a specific level corresponding to a preset water pressure with the flow regulation valve 65. The flow rate may alternatively be regulated to gradually increase from a predetermined value, which is less than the specific level by a fixed quantity, to the specific level corresponding to the preset water pressure.

The soft start process also activates the vibration generator 74 to start generation of the vibrating stream. In accordance with one concrete procedure, the electronic control unit 80 outputs a pulse signal to repeatedly excite the vibration generating coil 74*c* and thereby reciprocate the plunger 74*b*. This leads to generation of the vibrating stream as discussed previously. In the case of bidet-back, the excitation of the coil is repeated at the lower vibration frequency ftm than that in the case of gentle bidet-back or bidet-front as shown in FIG. 40. In the process of coil excitation, the duty ratio Dtm of the pulse signal is controlled to gradually increase to a specific value corresponding to the preset water pressure. The series of soft start processing controls the water spray from the gentle vibrating stream with the smaller quantity of water and the smaller duty ratio Dtm to the vibrating stream corresponding to the preset water pressure. Even when the preset water pressure is relatively large, this arrangement desirably prevents the user from feeling uneasy or uncomfortable. On completion of the soft start process, the procedure shifts to the main cleansing process to spray the vibrating stream of cleansing water corresponding to the preset water pressure. In the event that the setting of the water pressure is changed during the main cleansing process, the flow rate is regulated with the flow regulation valve 65 and the conditions of the vibrating stream from the vibration generator 74 are controlled (regulation of the duty ratio and the vibration frequency), in order to attain the newly set water pressure.

In the case of regulating the low flow rate of the cleansing water, there is generally a low reliability in accuracy of fine adjustment. This is one of the reasons why the prior art personal hygiene appliance, which adjusts the water pressure by regulation of the flow rate, does not attain the water spray of the low flow rate. The personal hygiene appliance of this embodiment, however, adjusts the water pressure by controlling the conditions of the vibrating stream (namely by controlling the duty ratio and the vibration frequency) as discussed above. This arrangement enables the water pressure to be minutely adjusted under the condition of the reduced flow rate of the cleansing water. The personal hygiene appliance 10 of this embodiment combines the regulation of the flow rate with the control of the conditions of the vibrating stream in the case where the water pressure is drastically changed from a minimum level to a maximum level, and otherwise adjusts the water pressure by controlling the conditions of the vibrating stream. Namely the personal hygiene appliance specifies the degree of the change in water pressure in response to operations of a Water pressure Up button SWhu and a Water pressure Down button SWhd, and controls the conditions of the vibrating stream (that is, controls the duty ratio and the vibration frequency) according to the result of specification. In order to increase the water pressure, the concrete procedure increases the duty ratio Dtm and/or lowers the vibration frequency ftm. The control in the reverse direction is carried out to decrease the water pressure.

The actual flow rate of the cleansing water to the vibration generator 74 is measured with a flow sensor (not shown), and the conditions of the vibrating stream are controlled (that is, the duty ratio and the vibration frequency are regulated), based on the observed flow rate and the newly set water pressure. This ensures the fine adjustment of the water pressure. A pressure sensor may be used for the flow sensor, or the flow rate may be observed indirectly with a signal from a switch relating to the setting of the flow rate. The flow sensor may be disposed upstream the vibration generator 74 or at any position that enables the flow rate of the cleansing water to be observed. The flow sensor is located arbitrarily according to the layout of the respective constituents in the personal hygiene appliance, so as to reduce the size of the whole personal hygiene appliance.

The main cleansing process is terminated in response to an operation of the Stop button, and retraction of the nozzle and nozzle post-clean are subsequently carried out. In response to the ON signal of the Stop button, the flow regulation valve 65 is set in the zero flow position to stop the water spray from the nozzle for bidet-back. The procedure then stops the water supply by driving the flow path changeover valve 71, ceases the output of the pulse signal for excitation of the coil, and reduces the power supply to the heater. The reduced power supply to the heater continues until the sitting detective device SS10 is set in OFF position. Thus the temperature of cleansing water does not lower heedlessly before the sitting detective device is off, but is maintained at the preset level that is a little lower than the appropriate level as discussed above. This arrangement desirably enables the cleansing water to be quickly heated to the appropriate temperature when the user on the toilet seat requires the repeated clean on the private part. In the process of stopping the water spray for bidet-back, the flow regulation valve and the flow path changeover valve are driven in this order. Namely the flow path changeover valve 71 is driven under substantially no loading. This favorably protects the driving motor 71*k* of the flow path changeover valve 71 from any overload. The main cleansing process (the main cleansing process for bidet-back) is also terminated when the user rises from the toilet seat to set the sitting detective device SS10 off prior to the operation of the Stop button or when the Soft Bidet-Back button or the Bidet-Front button is operated during the bidet-back.

After the flow path changeover valve 71 is driven to stop the water supply, the nozzle driving motor 42 of the nozzle unit 40 is driven in the reverse direction to retract the nozzle 24 to the stand-by position. In the course of the retraction of the nozzle, the solenoid valve 55 is kept open, and the supply of cleansing water is discharged as described previously. In the case where the supply of cleansing water is converted to the value-added water by the value-added water unit and sprayed from the chamber 41*c*, the cylindrical section 24*a* of the nozzle 24 is sterilized and cleansed with the value-added water during the retraction of the nozzle.

When the nozzle 24 is restored to the stand-by position, the nozzle post-clean is carried out. After the flow path changeover valve 71 is activated to select the nozzle flow path for bidet-back, the flow regulation valve 65 is driven to set the flow rate. This causes the cleansing water of the regulated flow rate to be fed to the nozzle 24 at the stand-by position and sprayed from the nozzle opening 31 for bidet-back. As in the case of the nozzle pre-clean, the nozzle head 25 is cleansed with a splash of water spray against the chamber 41*c*. In the structure that sprays the value-added water during the retraction of the nozzle, the water supply in the nozzle post-clean cleanses out the value-added water sprayed over the nozzle head 25 during the retraction of the nozzle. In the nozzle post-clean, the flow path changeover valve and the flow regulation valve are driven in this order. Namely the flow path changeover valve 71 is driven under substantially no loading. This favorably protects the driving motor 71*k* of the flow path changeover avalve 71 from any overload.

After the nozzle post-clean for a predetermined time cycle, the process closes the solenoid valve 55 and stops the supply of cleansing water to the personal hygiene appliance 10, in order to prepare for a subsequent operation of cleansing the private part. The process then drains the cleansing water remaining in the downstream water supply conduit, the flow path changeover valve 71, and the nozzle 24 disposed downstream the flow regulation valve 65. When the solenoid valve 55 closes, the vibration-generating coil 74*c* in the vibration generator 74 is repeatedly excited at the small duty ratio Dtm to reciprocate the plunger 74*b*. At this moment, the vibration frequency ftm may be a low level. During the reciprocation of the plunger 74*b*, no cleansing water is supplied to the vibration generator 74. The reciprocation of the plunger 74*b*, however, causes the upstream cleansing water to be drawn into the cylinder 74*a* and flowed out. The cleansing water remaining on the downstream side including the downstream water supply conduit is successively flowed down by the stream of cleansing water pumped out by the plunger 74*b*, passes through the selected nozzle flow path (in this case, the nozzle flow path for bidet-back) set by the flow path changeover valve 71, and is discharged from the nozzle opening for bidet-back in the nozzle at the stand-by position to the toilet bowl. On completion of drainage of the remaining cleansing water, the flow regulation valve 65 and the flow path changeover valve 71 are driven to stop the water supply. This completes the series of the bidet-back process.

The similar series of processing is carried out on and after the retraction of the nozzle in response to an operation of the Soft Bidet-Back button or the Bidet-Front button, with only differences in nozzle flow path specified by the flow path changeover valve 71 and in extended position of the nozzle 24 (the bidet-front cleansing position in the case of the Bidet-Front button) corresponding to the operated Cleanse button.

The technique of this embodiment drains the remain of cleansing water with the vibration generator 74 as discussed below.

When electric power is supplied to excite the vibration generating coil 74*c* in the vibration generator 74 and move the plunger 74*b*, a counter electromotive force is produced on the coil with the movement of the plunger 74*b*. This temporarily decreases the quantity of electric current, which is generally called the bottom phenomenon. The bottom phenomenon is observed in the waveform of electric current flowing through the coil. The waveform of electric current thus correlates with the movement of the plunger 74*b*. The vibration generating coil 74*c* is excited in the process of drainage of the remaining cleansing water. Namely the plunger 74*b* moves in the presence of cleansing water in the cylinder 74*a* before the complete drainage of the remaining cleansing water and in the absence of cleansing water after the drainage. The cleansing water in the cylinder 74*a* works as a resistance against the movement of the plunger 74*b*. The excitation of the coil under a fixed condition (under a fixed duty ratio Dtm in this embodiment) causes the plunger 74*b* to move at a higher speed in the absence of cleansing water than that in the presence of cleansing water. At the time point when the circumstance, in which the plunger 74*b* moves, changes from the presence of cleansing water in the cylinder 74*a* to the absence of cleansing water, that is, at the time point when the remain of cleansing water is completely drained, the appearance of the bottom phenomenon changes. In the personal hygiene appliance 10of the embodiment, a bottom detection circuit 81 (see FIG. 21) is used to monitor the bottom phenomenon and detect the completion of drainage of the remaining cleansing water. Subsequent to the detection, the procedure drives the flow path changeover valve 71 to stop the water supply, and concludes the series of the bidet-back process.

Figure 43:
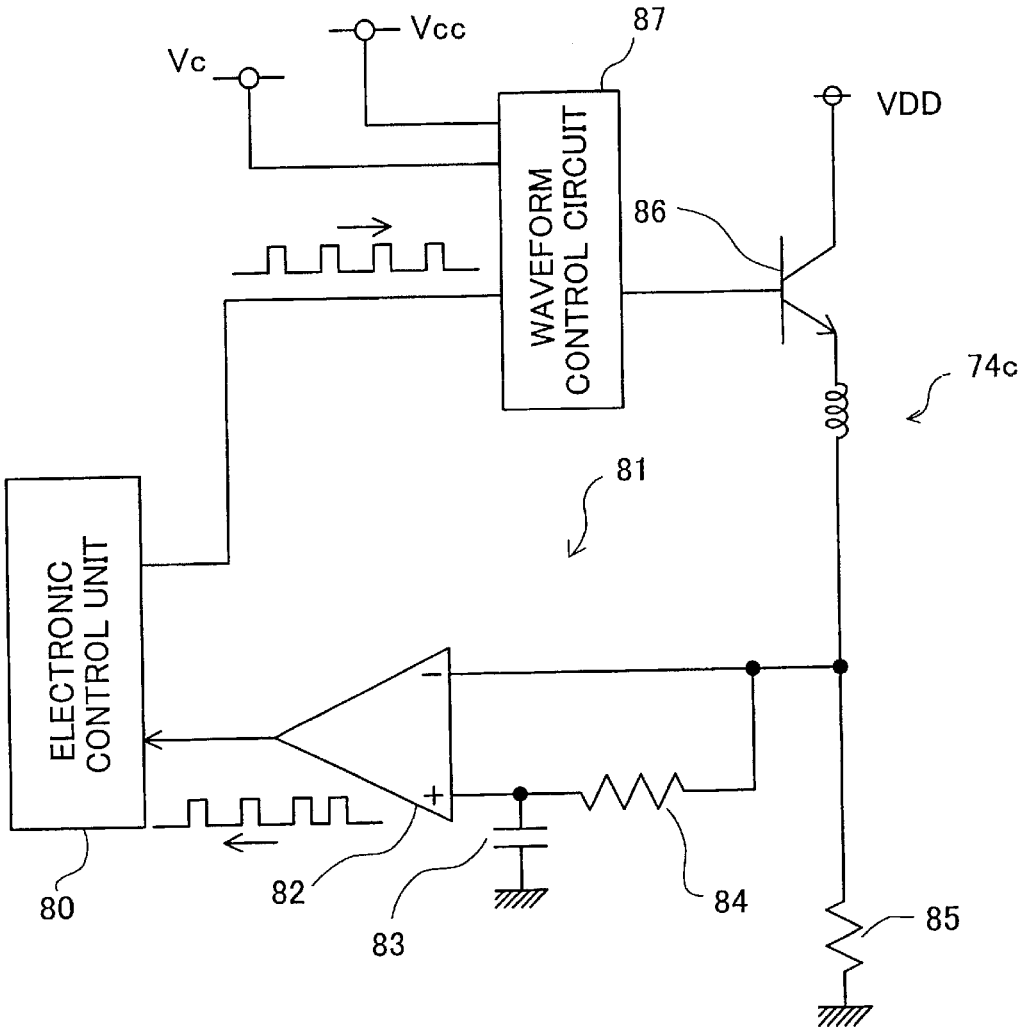
FIG. 43 is a circuit diagram showing the construction of a bottom detection circuit 81 for the vibration generating coil 74*c;*
Figure 44:
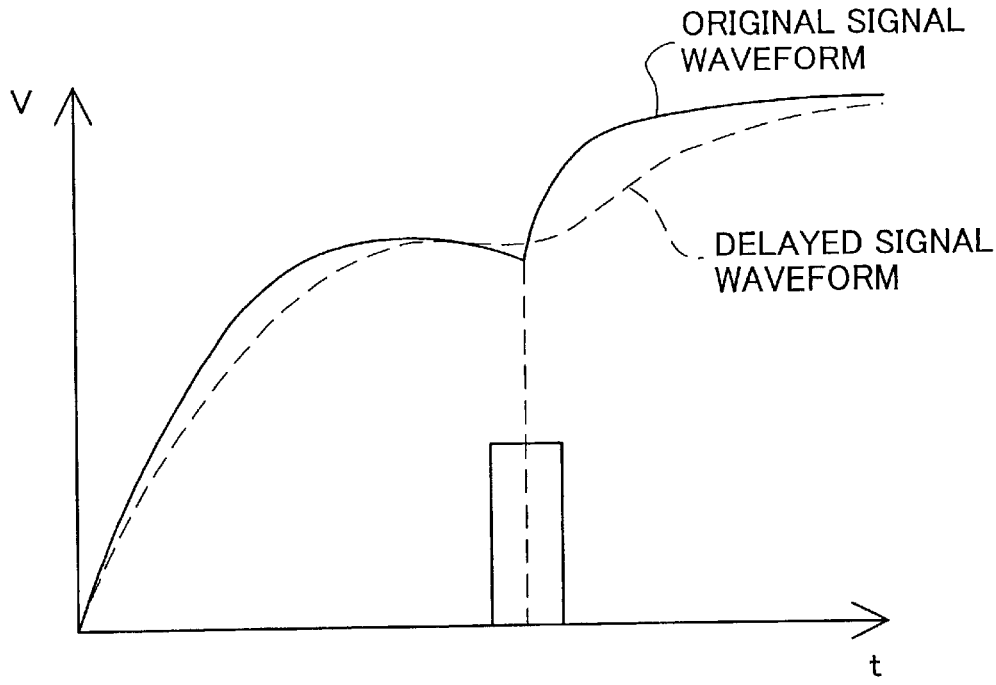
FIG. 44 is a graph showing a waveform of electric current in the course of excitation of the vibration generating coil 74*c;*

FIG. 43 is a circuit diagram showing the construction of the bottom detection circuit 81 for the vibration generating coil 74*c*. FIG. 44 is a graph showing a waveform of electric current in the course of excitation of the vibration generating coil 74*c*.

Referring to FIG. 43, the bottom detection circuit 81 includes a comparator 82, a capacitor 83, and a resistance 84. The bottom detection circuit 81 comprises a delay circuit constituted by a CR filter circuit with the resistance 84 and the capacitor 83. The CR filter circuit outputs an input signal with a delay defined by the resistance 84 and the capacitor 83. In the bottom detection circuit 81, the comparator 82 compares an input signal at its minus terminal (that is, a voltage generated on a detection resistance 85 to reflect the electric current) with a delay signal obtained by delaying the input signal. The bottom detection circuit 81 then outputs a pulse-like signal (a bottom detection signal) representing completion of the movement of the plunger 74*b* to the electronic control unit 80 as discussed below.

After completion of the nozzle post-clean, an illustrated pulse signal of a fixed cycle (fixed duty ratio Dtm) is output to a switching transistor 86 connected to the vibration generating coil 74*c*. Thus the electricity is supplied to the coil in response to each pulse. The electric current, which is responded to the pulse signal and flows through the vibration generating coil 74*c*, increases with time. When a predetermined time cycle has elapsed since the start of the pulse signal output, the plunger 74*b* starts moving and a counter electromotive force is generated on the vibration generating coil 74*c* with the movement of the plunger 74*b*. The counter electromotive force leads to the bottom phenomenon that temporarily decreases the electric current as shown by the solid line in FIG. 44. The waveform of this electric current (original signal waveform) is input in the form of a voltage into the minus terminal of the comparator 82. The delay signal shown by the broken line is generated by the CR filter circuit and input into the plus terminal. The comparator 82 carries out the operation by taking into account the polarity of the input terminals and generates a pulse-like signal.

The pulse-like signal (bottom detection signal) is generated in response to each pulse output to the switching transistor 86, and is input into the electronic control unit 80 at the fixed cycle. As described previously, the plunger 74*b* moves at the higher speed after the complete drainage of the remaining cleansing water. The bottom detection signal is accordingly input at a different cycle after the drainage. The electronic control unit 80 determines the completion of drainage of the remaining cleansing water based on the input signal, and stops outputting the pulse signal to terminate the series of bidet-back process according to the result of determination. Instead of determining the completion of drainage of the remaining cleansing water based on the result of the bottom detection, another possible procedure stops outputting the pulse signal to cease the coil excitation and terminate the cleansing process when a predetermined time cycle has elapsed since the excitation of the coil for drainage of the remaining water.

Figure 45:
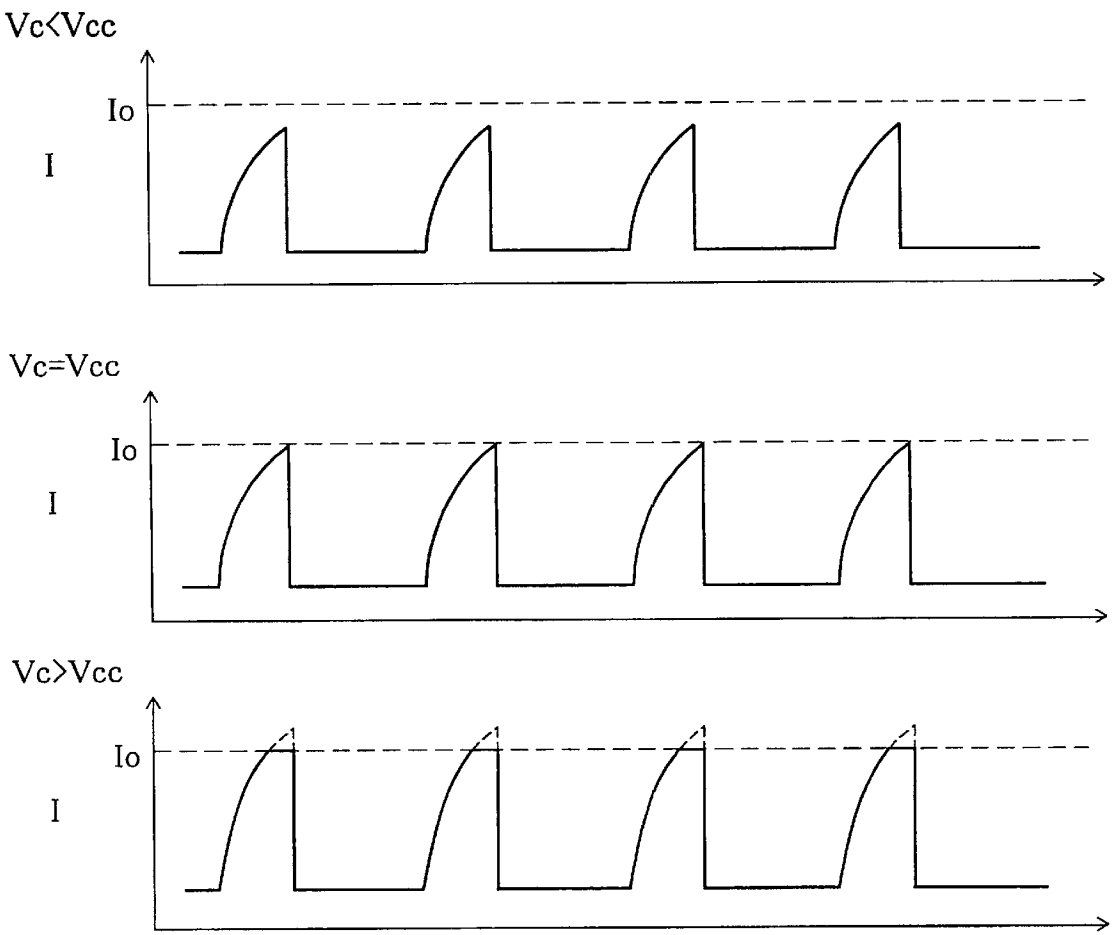
FIG. 45 shows waveforms of electric current flowing through the vibration generating coil 74*c* to move back and forth a plunger 74*b;*

The following describes the control of electric current in the process of repeatedly exciting the vibration generating coil 74*c* at a predetermined duty ratio Dtm to reciprocate the plunger 74*b*. FIG. 45 shows waveforms of electric current flowing through the vibration generating coil 74*c*.

In the personal hygiene appliance of this embodiment, a rated voltage is applied to the vibration generating coil 74*c*. The voltage actually applied on the coil, however, varies by external indefinite factors. As a countermeasure against the voltage variation, the appliance is provided with a waveform control circuit 87 on the base wiring of the switching transistor 86 as shown in FIG. 43. The waveform control circuit 87 carries out control to prevent the peak of the waveform of electric current flowing through the vibration generating coil 74*c* from exceeding a preset level in the ON time of the pulse signal from the electronic control unit 80, based on the result of comparison between a reference voltage Vcc (rated voltage) and an actual application voltage Vc. When the application voltage Vc exceeds the reference voltage Vcc, the control results in cutting off the peak of the waveform of electric current as shown in FIG. 45(*c*). This arrangement effectively prevents an inadvertent increase in exciting magnetic force of the vibration generating coil 74*c* and thereby the hitting noise of the plunger 74*b*

The personal hygiene appliance 10 of this embodiment performs move cleansing as discussed below. In order to attain the duty ratio control discussed below, the width of move cleansing (that is, the length of reciprocation of the nozzle) in the personal hygiene appliance 10 of this embodiment is set to be greater than that in the prior art personal hygiene appliance. More specifically, the width of move cleansing is about 20 mm in the prior art personal hygiene appliance but is about 26 mm in this embodiment. The speed of move cleansing is slowed down by approximately 30% of the speed in the prior art personal hygiene appliance. The speed reduction enables each site to be cleansed for a longer time cycle. More specifically, the number of driving pulses of the nozzle driving motor per second is 500 pps in the prior art personal hygiene appliance but is 333 pps in this embodiment. The move cleansing is carried out with such settings of the width and speed.

In one exemplified procedure, while the nozzle 24 moves back and forth around the center position, the vibration frequency ftm or the duty ratio Dtm is varied according to the nozzle position. In the vicinity of the center position, the vibration frequency ftm is heightened to enhance the soft and continuous clean up feeling. In the vicinity of the forward end position and the backward end position, on the other hand, the vibration frequency ftm is lowered to emphasize the hard clean up feeling. A decrease in duty ratio Dtm in the vicinity of the center position further emphasizes the soft clean up feeling. The vibration frequency ftm may alternatively be lowered in the vicinity of the center position to enhance the hard clean up feeling and the stimulus, and be heightened in the vicinity of the forward end position and the backward end position to emphasize the soft clean up feeling. Only the duty ratio Dtm may be varied according to the position of the nozzle 24 for move cleansing under the condition of a fixed vibration frequency ftm. On the contrary, only the vibration frequency ftm may be varied under the condition of a fixed duty ratio Dtm.

Figure 46A:
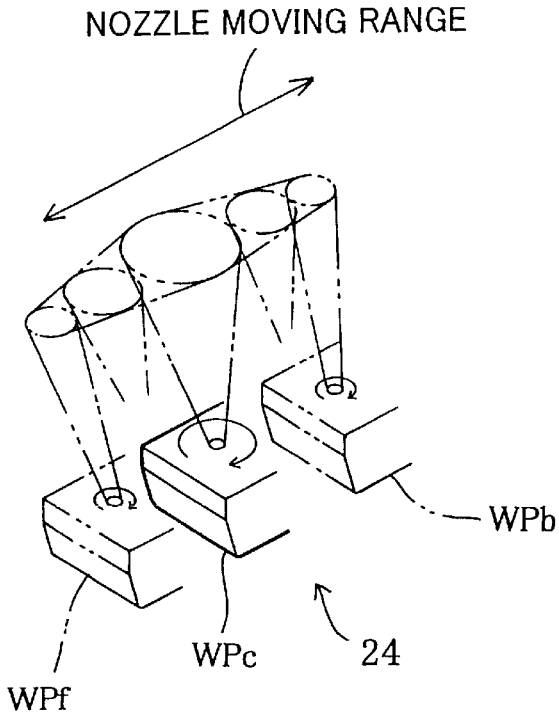
FIG. 46 shows a process of move cleansing in the sixth embodiment.
Figure 46B:
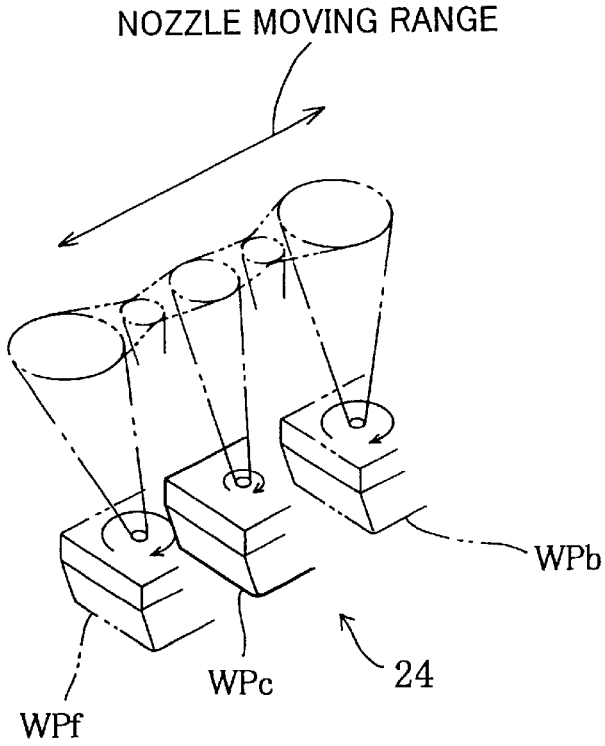

FIG. 46 shows a process of move cleansing. When the nozzle head of the nozzle 24 is located near a center position (cleansing position WPc) in the nozzle moving range, a maximum duty ratio Dtmmax in the practical setting range is set to the duty ratio Dtm. With an increase in distance of the nozzle head from the center position toward a forward end position WPf or a backward end position WPb, the duty ratio Dtm decreases from the maximum duty ratio Dtmmax. At the forward end position WPf and the backward end position WPb, the duty ratio Dtm is equal to a minimum duty ratio Dtmmin in the practical setting range. This arrangement enables the vicinity of the private part to be cleansed according to the move cleansing process, in which the cleansing area reaches the maximum near the center position and gradually decreases towards the forward end position and the backward end position (see FIG. 46(*a*)). Namely the cleansing area is varied with a variation in cleansing position. This ensures the diverse clean up feeling with the variation in stimulus according to the shift of the cleansing position. The cleansing area is widened at the center position and narrowed at the forward end position and the backward end position in the nozzle moving range. This arrangement makes the cleansing area suitable for the shape of the desired private part to be cleaned, and thus enables the private part, for example, the private part for bidet-front, to be cleansed sufficiently.

The duty ratio Dtm may be varied according to the nozzle position in a different manner. When the nozzle head is near the center position (the cleansing position WPc), an intermediate duty ratio Dtmid in the practical setting range is set to the duty ratio Dtm. The duty ratio Dtm is set equal to the maximum duty ratio Dtmmax at the forward end position WPf and the backward end position WPb. The duty ratio Dtm is varied from Dtmid to Dtmmin and further to Dtmmax between the center position and each of the forward and backward end positions. This arrangement enables the vicinity of the private part to be cleansed according to the move cleansing process, in which the cleansing area has a medium level in the vicinity of the center position, reaches the maximum at the forward end position and the backward end position, and varies between the center position of each of the forward and backward end positions (see FIG. 46(*b*)). This arrangement ensures the diverse clean up feeling with the variation in stimulus according to the shift of the cleansing position, and enables the front and rear portions of the private part to be cleansed carefully in a wide cleansing area.

The duty ratio Dtm may be changed among the three levels (DtmS, DtmM, and DtmL) according to the nozzle position as discussed above with FIG. 40. This arrangement requires only a change of the duty ratio Dtm according to the nozzle position, thereby facilitating the control procedure and effectively reducing the loading of operations carried out by the electronic control unit.

Another procedure of move cleansing takes advantage of a variation in cleansing power with a variation in duty ratio Dtm. While the nozzle 24 moves to the forward end position WPf, the duty ratio Dtm is set either equal to the maximum duty ratio Dtmmax or equal to a value corresponding to the preset water power. While the nozzle 24 moves to the backward end position WPb, on the other hand, the duty ratio is set equal to the minimum duty ratio Dtmmin. During the extension of the nozzle, the large duty ratio Dtm enables the excrement on the private part to be cleansed out with the strong cleansing power. In the course of extension of the nozzle, as shown in FIGS. 22 and 24, the combination of the strong cleansing power with the oblique downward locus of the nozzle movement causes the excrement to be effectively separated down from the private part.

Alternatively the duty ratio Dtm may be lowered during the movement of the nozzle 24 to the forward end position and be heightened during the movement to the backward end position. This arrangement enables the excrement on the private part to be cleansed out with the strong cleansing power during the retraction of the nozzle. The oblique upward locus of the nozzle movement effectively interferes with a forward flow of the cleansing water and the excrement separated by the cleansing water. The bidet-front in this move cleansing process favorably enhances the hygiene in the vicinity of the private part.

In the personal hygiene appliance of this embodiment, the massage cleansing process is carried out in the following manner. The massage cleansing process is divided into cleansing time cycles TA, TB, TC, . . . of an identical time interval. The identical time interval is set as a massage cycle (under a fixed duty ratio Dtm, for example, Dtm=DtmL). The vibration frequency ftm is regularly varied at this massage cycle as shown in FIG. 41(*a*). For example, the vibration frequency ftm is regularly varied at the massage cycle like ftmS, ftmM, ftmL, ftmM, ftmS, . . . (ftmS<ftmM<ftmL) or like ftmS, ftmM, ftmL, ftmS, ftmM, . . . In addition to the regular variation in vibration frequency ftm, the duty ratio Dtm may be varied regularly at the massage cycle, which represents the identical time interval of the cleansing time cycles TA, TB, TC, . . . as shown in FIG. 84(*b*). For example, the duty ratio Dtm is regularly varied at the massage cycle like DtmL, DtmM, DtmS, DtmM, DtmL, . . . (DtmS<DtmM<DtmL) or like DtmS, DtmM, DtmL, DtmS, DtmM, . . .

Another possible procedure supplies power to the vibration generating coil 74*c* at the vibration frequency ftm for a first cleansing time cycle TA and carries out cleansing in a next cleansing time cycle TA with stop of the power supply to the vibration generating coil 74*c*. This series of processing is iteratively carried out, and this time interval is set to the massage cycle.

The massage cycle is determined such that the frequency defined by the reciprocal of the cycle is out of the range of unperceptible frequency (lower than about 5 Hz). This arrangement enables the user to distinctly perceive the change of the clean up feeling and the stimulus accompanied by the variation in duty ratio Dtm or in vibration frequency ftm. The clean up feeling and the stimulus of the water spray given to the user regularly and repeatedly changes in a variety of ways. Since combination of the increased duty ratio Dtm with the lowered vibration frequency ftm fades a continuation feeling of stimuli, it is achieved to amplify the intensity of the stimuli. This arrangement amplifies the strength and weakness of the stimuli, and thereby stimulates the movement of the bowels.

Figure 47:
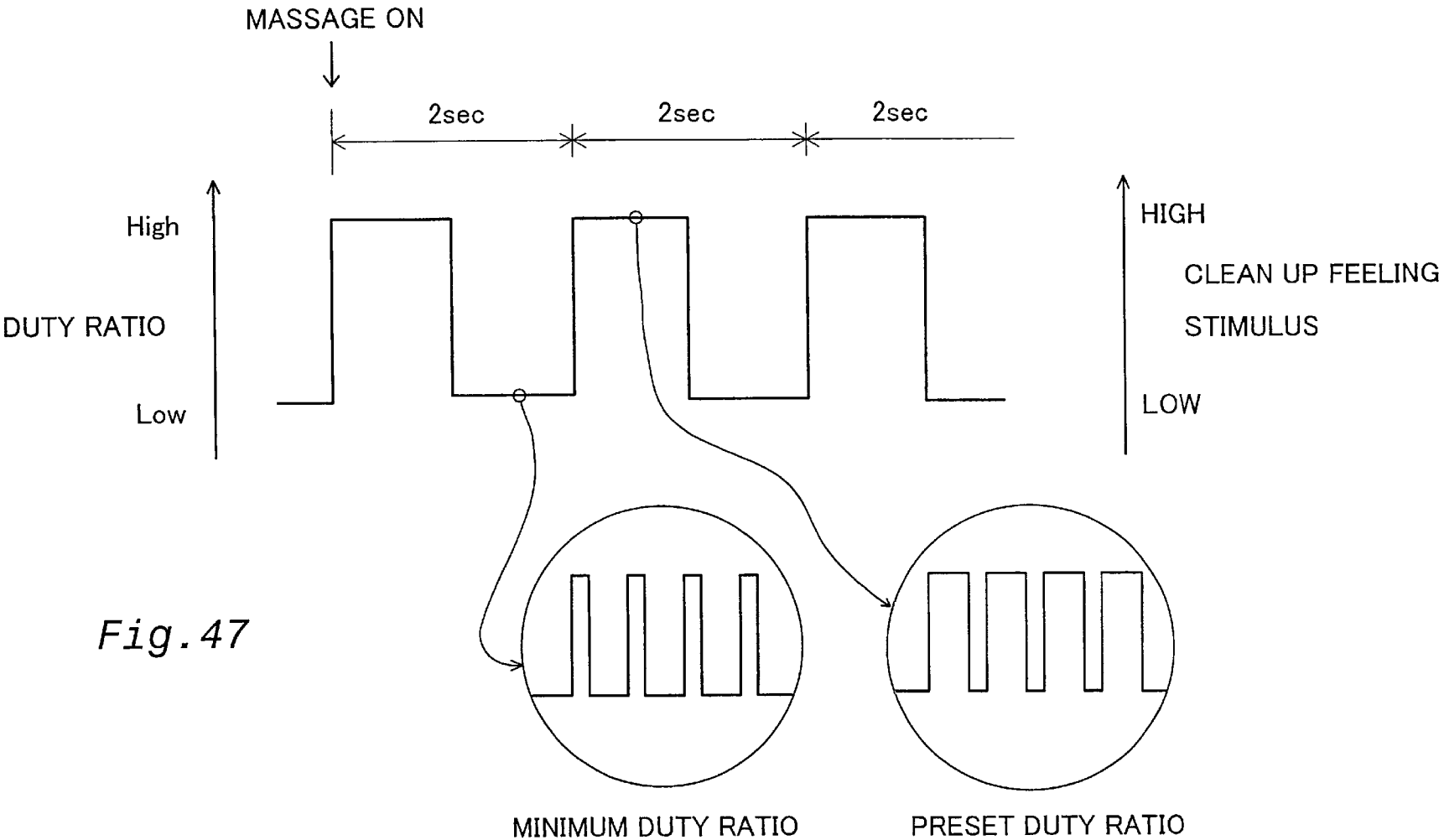
FIG. 47 shows a process of massage cleansing in the sixth embodiment.

One example of the massage cleansing is discussed in detail with reference to FIG. 47. For convenience of explanation, it is assumed that a fixed value is set to the vibration frequency ftm. As illustrated, the cycle of the massage cleansing is 2 seconds, and the frequency is 0.5 Hz. The use thus distinctly feels a variation in clean up feeling and stimulus.

In response to an operation of a Massage button, the duty ratio Dtm is switched over between High level and Low level at intervals of 1 second. In the time of the duty ratio Dtm=Low level, the vibration generating coil 74*c* is excited at the minimum duty ratio Dtmmin in the possible setting range. In the time of the duty ratio Dtm=High level, on the contrary, the vibration generating coil 74*c* is excited at a duty ratio Dtmss corresponding to the user's setting of the water pressure. The user alternately receives the clean up feeling and stimulus based on the minimum duty ratio Dtmmin and the clean up feeling and stimulus based on the user's setting of the duty ratio Dtmss, and distinctly feels the alternate change of the clean up feeling and stimulus. Such massage effects desirably stimulate the movement of the bowels.

In the time of the duty ratio Dtm=High level, the duty ratio Dtm may be set equal to the maximum duty ratio Dtmmax in the possible setting range or a specific level that is greater than the user's setting of the duty ratio Dtmss by a predetermined value, instead of the user's setting of the duty ratio Dtmss.

In the massage cleansing process, the respective cleansing time cycles TA, TB, TC, . . . may be set different from one another. This changes the time of perceiving the stimulus in each cleansing time cycle accompanied with the variation in duty ratio Dtm or vibration frequency ftm, thereby attaining the diverse stimuli and more effectively stimulating the movement of the bowels. The massage cleansing may be carried out synchronously with another stimulus to the five senses, for example, music, light, or aroma (aromatherapy). That soothes the user and thereby further stimulates the movement of the bowels.

In the personal hygiene appliance 10of the embodiment, the fluctuation cleansing process is carried out in the following manner to irregularly change the clean up feeling and the stimulus of the water spray and make the user feel easy and comfortable. The fluctuation cleansing process is divided into cleansing time cycles TA, TB, TC, . . . of an identical time interval. The identical time interval is set as a fluctuation cycle. Either one of or both of the duty ratio Dtm and the vibration frequency ftm are irregularly varied at this fluctuation cycle. For example, as discussed in the first embodiment, the random digit generating program is loaded to generate random digits, and the duty ratio Dtm and the vibration frequency ftm are irregularly varied according to the generated random digits. This enables the duty ratio Dtm and the vibration frequency ftm to vary at the fixed fluctuation cycle like DtmS, DtmM, DtmS, DtmS, DtmL, DtmS, . . . and ftmM, ftmS, ftmM, ftmL, ftmS, ftmL, . . . The duty ratio Dtm and the vibration frequency ftm may be varied independently of each other.

The clean up feeling and the stimulus of the water spray irregularly changes with the variation in duty ratio Dtm or vibration frequency ftm. The fluctuation cycle, at which the clean up feeling and the stimulus changes with the variation in duty ratio Dtm or vibration frequency ftm, is determined such that the frequency f defined by the reciprocal of this fluctuation cycle is the same frequency level (lower than about 5 Hz) as in the case of the massage cycle. This arrangement enables the user to distinctly perceive the change of the clean up feeling and the stimulus accompanied by the variation in duty ratio Dtm or vibration frequency ftm. The clean up feeling and the stimulus changes in an irregular manner at each fluctuation cycle, so that the intensity of the stimulus given to the user irregularly varies. This arrangement makes it difficult for the user to expect the variation in stimulus and accordingly ensures the following advantages.

The muscular sphincter ani internus that opens and closes the anus for evacuation is an involuntary muscle in the automatic nervous system and unconsciously contracts and relaxes. The massage cleansing regularly varies the cleansing area, which affects the stimulus. The continuous massage cleansing over a long time cycle may thus cause the brain of the user to expect the timing of narrowing the cleansing area. The brain of the user may accordingly expect a variation in stimulus due to the narrowed cleansing area. This may lead to the sympathetic nerve predominant state and cause contraction of the muscular sphincter ani internus. The fluctuation cleansing, on the other hand, irregularly varies the cleansing area and thus makes it difficult for the brain of the user to expect the timing of narrowing the cleansing area and a variation in stimulus due to the narrowed cleansing area. This relieves the monotonous clean up feeling and leads to the parasympathetic nerve predominant state, thereby accelerating the unconscious relaxation of the muscular sphincter ani internus. The fluctuation cleansing thus more effectively stimulates the movement of the bowels.

The fluctuation cleansing may also be carried out to cleanse the anal region after evacuation. The difficulty in expectation of the varying stimulus accompanied with the variation in duty ratio Dtm or vibration frequency ftm further relieves the monotonous feeling in the course of cleansing the private part.

In the fluctuation cleansing process, the respective cleansing time cycles TA, TB, TC, . . . may be set different from one another. This changes the time of perceiving the stimulus in each cleansing time cycle accompanied with the variation in duty ratio Dtm or vibration frequency ftm, thereby enhancing the difficulty in expecting the variation in stimulus and more effectively stimulating the movement of the bowels. The fluctuation cleansing may be carried out synchronously with another stimulus to the five senses, for example, music, light, or aroma (aromatherapy). That soothes the user and thereby further stimulates the movement of the bowels.

The power spectrum of a physical quantity, such as the amplitude of the variation in duty ratio Dtm or vibration frequency ftm, the fluctuation cycle that defines the timing of variation, or the instantaneous flow rate, may be proportional to the reciprocal of the frequency like the biorhythm of the human body, for example, the heart rate, or the rhythm in the physical world. This makes the user feel relaxed and leads to the parasympathetic nerve predominance, which relaxes internal anal sphincter and enhances the effect of stimulating the movement of the bowels.

The personal hygiene appliance 10 of the embodiment has other advantages, in addition to those discussed above. The first advantage is given by the accumulator 73 that is disposed upstream the vibration generator 74. FIG. 48 shows the effects of the accumulator 73.

While the vibration generator 74 was driven to spray the vibrating stream of cleansing water, the pressure in the upstream water supply conduit 51 (see FIG. 16) (the primary pressure) and the pressure in the downstream water supply conduit 72 disposed down the vibration generator (the secondary pressure) were measured. The primary pressure without the accumulator 73 disposed upstream the vibration generator 74 was measured in the downstream of the flow regulation valve 65. The primary pressure with the accumulator 73 as shown in FIG. 16 was measured in the downstream of the flow regulation valve 65 and in the upstream of the accumulator 73. The results of the measurement are shown in FIG. 48.

Incorporation of the accumulator in the upstream of the vibration generator in the flow path has the following advantages, in addition to the intrinsic function of the accumulator that relieves the water hammer in the upstream water supply conduit 51. As clearly shown in FIG. 48, the accumulator effectively relieves the variation in primary pressure in the upstream water supply conduit in the process of generating the vibrating stream by the vibration generator. The relieved variation in primary pressure, in combination with the relieved water hammer, prevents irregularities in a temperature distribution of cleansing water in the heat exchange section 62. The water in the heat exchange unit 62 is thus heated without any significant irregularities in the temperature distribution. This simplifies the control process of the heater and enables the cleansing water to be heated homogeneously to a preset temperature with a high response. The primary pressure of the vibrating stream generated by the vibration generator is accumulated by the accumulator and amplified to the secondary pressure. This arrangement reduces the required capacity and the size of the vibration generator. The amplification of the pressure by the accumulator also reduces the energy required for generating a pressure variation (generating a vibration) and thus saves the electric power. The accumulator 73 is disposed close to or integrally with the vibration generator 74. The accumulator may alternatively be disposed close to or integrally with the flow regulation valve 65.

In the personal hygiene appliance 10 of this embodiment, the vibration generator 74 utilizing the reciprocation of the plunger 74*b* is used to spray the cyclically varying stream of cleansing water. The flow rate of the vibrating stream generated by the vibration generator 74 does not reach zero. This does not cut off the stream of cleansing water in the flow path and thereby causes no water hammer. The constituents of the water flowing line system including the vibration generator are accordingly not required to have a high water hammer resistance. This leads to the simplified structure and the reduced size of the vibration generator, and also allows a resin to be applied for the material of the vibration generator.

The vibration generator 74 does not cause the flow rate to reach zero in the process of generating a vibration by the reciprocation of the plunger. This arrangement does not require any element for stopping the water supply, such as a check valve, on the side of spraying the cleansing water. This further simplifies the structure and reduces the size of the vibration generator. The reduced size increases the degree of freedom in position of the vibration generator and simplifies the attachment or integration of the vibration generator to or with another constituent having a greater mass.

The non-zero flow rate in the course of spraying the vibrating stream of cleansing water has the other advantages. Even when the vibration frequency is in the range of unperceptible frequency (not lower than about 5 Hz), the vibration frequency closer to the lower limit in the range of unperceptible frequency causes the user to feel less continuity of the stimuli. The non-zero flow rate of the cleansing water, however, effectively prevents the user from feeling less continuity of the stimuli. The use of the vibration generator 74 to spray the vibrating stream of cleansing water expands the adjustable range of the vibration frequency close to the lower limit in the range of unperceptible frequency. The control of the vibration frequency in a wide range ensures the diverse clean up feeling and water pressure.

In the personal hygiene appliance 10 of this embodiment, after any one of the bidet-back process, the gentle bidet-back process, and the bidet-front process, the vibration generator 74 is driven to reciprocate the plunger 74*b* and forcibly drain the remain of cleansing water. Namely water is completely drained from the flow path between the flow regulation valve 65 and the nozzle head of the nozzle 24. This effectively prevents the problem of frozen remaining water in the flow path. When the vibration generator 74 is driven for the purpose of drainage, the vibration-generating coil 74*c* is activated at a small duty ratio Dtm and a low vibration frequency ftm. This causes the plunger 74*b* to move at a low speed and with a weak force and prevents the plunger from hitting against the end of the cylinder at a high speed and with a strong force, thus reducing the hitting noise of the plunger. In the case where the flow path changeover valve is designed to open all the connection holes of the respective nozzle flow paths at the time of drainage, water is drained from all the flow paths formed in the nozzle.

As discussed previously, the personal hygiene appliance 10 of the embodiment reduces the flow rate of the cleansing water (the quantity of water spray) while making the user feel a continuous water supply, thus enhancing the effects of water saving. This arrangement reduces the power consumption of the heater 61 required to heat the cleansing water to a desired temperature as discussed below.

The outlet in the bathroom often has a limit capacity of 15 A. In the prior art personal hygiene appliance used on the bathroom, however, the capacity of the heater of the instantaneous heat exchange type is set equal to be about 2500 watts, in order to ensure a water spray of a sufficiently high temperature for a sufficient time cycle even in winter. The prior art technique mixes the air with force into the cleansing water to reduce the quantity of cleansing water and thereby the capacity of the heater. The heater capacity of at least 1000 watts is, however, still required. The use of the personal hygiene appliance having this heater capacity requires the power close to the limit capacity of the outlet, so that no other electric appliances cannot be used in the bathroom. In the case where the function of drying with a hot air and the function of heating the room provided on the personal hygiene appliance are activated simultaneously, these heaters require a large total capacity. In this case, the power supply to one of the heaters should be cut off.

In hotels and a variety of facilities, a large number of personal hygiene appliances are required. The upper limit of the total power consumption, however, makes the installation difficult. In the personal hygiene appliance 10 of the embodiment, the vibration generator 74 is driven to generate a vibration. This arrangement significantly decreases the total quantity of cleansing water and saves the electric power through the control of the vibration frequency ftm and the duty ratio Dtm of the vibration, thus solving the above problem.

In the personal hygiene appliance 10 of the embodiment, the flow rate of the cleansing water led to the vibration generator 74 is measured with a flow sensor (not shown). The use of the flow sensor enables the water pressure to be finely adjusted by controlling the conditions of the vibrating stream (that is, by controlling the duty ratio and the vibration frequency) based on the observed flow rate of the sensor as discussed previously, and has other advantages. The electronic control unit 80 receives an alarm signal from the flow sensor in the case of any abnormality, for example, an excess flow rate due to the failure of the solenoid valve 55 or the suspension of water supply. In response to the alarm signal, the electronic control unit 80 stops the operation of the vibration generator 74 and the power supply to the heater 61, and retracts the nozzle 24 to the stand-by position. This arrangement effectively prevents the hitting noise of the plunger 74*b* and the power supply to the heater 61 without water.

Application of the nozzle head 200 having the swirling chamber (see FIG. 9) to the technique of the sixth embodiment ensures the further advantages discussed below. In the course of gentle bidet-back and bidet-front, the vibrating stream of cleansing water is introduced into the water swirling chamber 171 to add the swirling force to the cleansing water. The effects discussed above are accordingly attained by the spray of the vibrating stream of cleansing water, the suction of the air, and the swirl of the cleansing water in the case of gentle bidet-back and bidet-front. The vibrating stream has the cyclically varying flow rate, so that the swirling force varies cyclically. This leads to a cyclic variation in spiral expansion in the cone-shaped range KS shown in FIGS. 2 and 3. This arrangement ensures adequate dispersion of cleansing water in the cone-shaped range KS and thus enables the private part to be cleansed thoroughly.

Some possible modifications of the personal hygiene appliance 10 are discussed below. In the following explanation, the same constituents as those of the embodiments and their modified examples discussed above are expressed by the same names and the same numerals. The constituents having the similar functions are expressed by the same names.

Figures 50A, 50B, 50C:
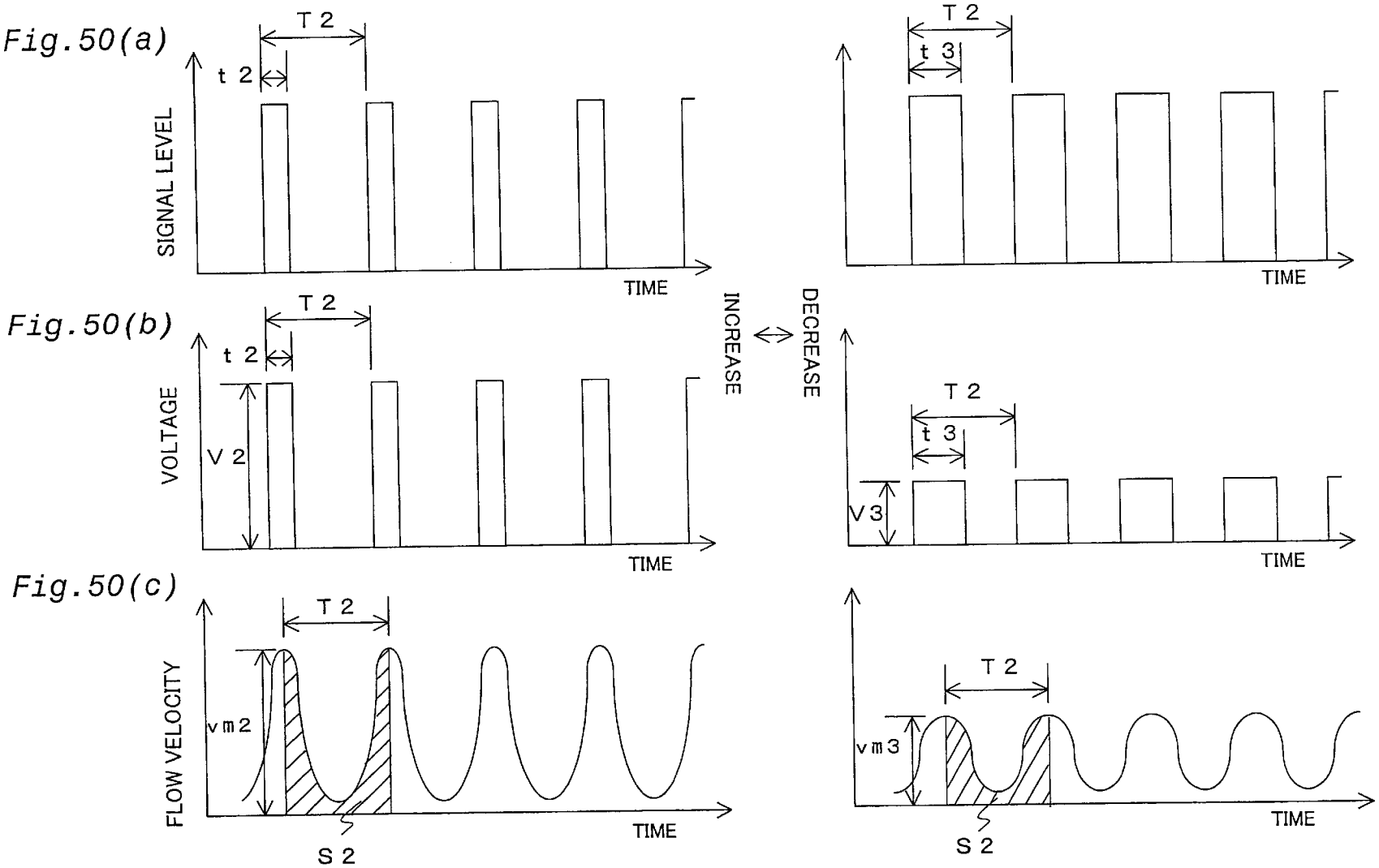
FIG. 50 shows an exemplified control process of reducing a flow velocity vm (v2·vm3) under a fixed flow rate in the spray of vibrating stream.

In the spray of the vibrating stream of cleansing water, or the flow rate and the flow velocity may be varied or the flow velocity may be varied under the condition of a fixed flow rate. FIG. 49 shows an exemplified control process of varying the flow rate and the flow velocity. FIG. 50 shows an exemplified control process of reducing a flow velocity vm (vm2→vm3) under a fixed flow rate in the spray of vibrating stream. In the graphs, t2 and t3 (>t2) represent time cycles of power supply to excite the coil in the vibration generator, T2 denotes a vibration cycle of a vibration generated by the vibration generator, and V denotes a coil excitation voltage, that is, a voltage applied to the switching transistor to turn on and off the power supply to the vibration generating coil in the vibration generator. Among these graphs, (a) shows a variation in duty ratio of the pulse signal, (b) shows a variation in voltage V with time, and (c) shows a variation in flow velocity vm of sprayed cleansing water with time.

The example of varying the flow rate and the flow velocity is discussed first with reference to the graphs of FIG. 49.

As described previously, when the vibrating stream of cleansing water is produced by means of the plunger 74, which is driven by excitation of the vibration generating coil 74*c*, the flow rate is defined by the stroke length of the driven plunger 74*b* and the flow velocity is defined by the driving speed of the plunger 74*b*, that is, the sucking force of the plunger 74*b*. In the case of lowering the flow velocity, the procedure first decreases the voltage V applied to the vibration generating coil 74*c* (that is, the electric current flowed through the vibration generating coil 74*c*) (V2→V2': see FIG. 49(*b*)). This reduces the sucking force of the plunger 74*b* and thereby reduces the driving speed of the plunger 74*b*. At the vibration cycle T2, in the fixed time cycle of power supply t2, because of the fixed duty ratio, the moving distance (stoke length) of the plunger 74*b* is shortened by a value corresponding to the reduction in driving speed of the plunger 74*b*. This reduces the flow rate of cleansing water, which depends upon the moving distance of the plunger. Namely reduction of the voltage applied to the coil under the condition of a fixed duty ratio lowers both the flow rate and the flow velocity of cleansing water. The procedure follows reverse operations to raise the flow rate and the flow velocity. Namely increase in voltage applied to the coil under the condition of a fixed duty ratio simultaneously raises the flow rate and the flow velocity of cleansing water.

The example of reducing a flow velocity vm (vm2→vm3) under a fixed flow rate is discussed next with reference to the graphs of FIG. 50.

The procedure carries out the control as discussed below to vary only the flow velocity without changing the flow rate. The control process first lowers the voltage V applied to the vibration generating coil 74*c* as shown in FIG. 50(*b*). Under the condition of a fixed duty ratio, the shortened stroke length reduces the flow rate and the flow velocity. In order to compensate for only the insufficiency of the flow rate, the duty ratio is increased (t2/T2→t3/T2) as shown in FIG. 50(*a*). The increase in duty ratio extends the time cycle of coil excitation from t2 to t3 to drive the plunger 74*b* by a normal stroke length and thus enables the stroke length of the plunger 74*b* to be kept at a constant level. Only the flow velocity can thus be reduced under the fixed flow rate. This phenomenon is understandable from the fact that areas S2 of one cycle are equal in the left and right graphs (*c*) representing the relationship between the flow velocity and the time. The procedure follows reverse operations to raise the flow velocity. In the case where the vibration is continuously generated at the limit stroke of the plunger 74*b*, there is no variation in stroke length of the driven plunger, which leads to no variation in flow rate. Under such conditions, control of the voltage applied to the vibration generating coil or control of the electric current flowed through the vibration generating coil 74*c* enables the flow velocity to be varied while keeping the flow rate fixed.

The personal hygiene appliance 10 of the embodiment has a diversity of other modifications as discussed below.

Figure 51:
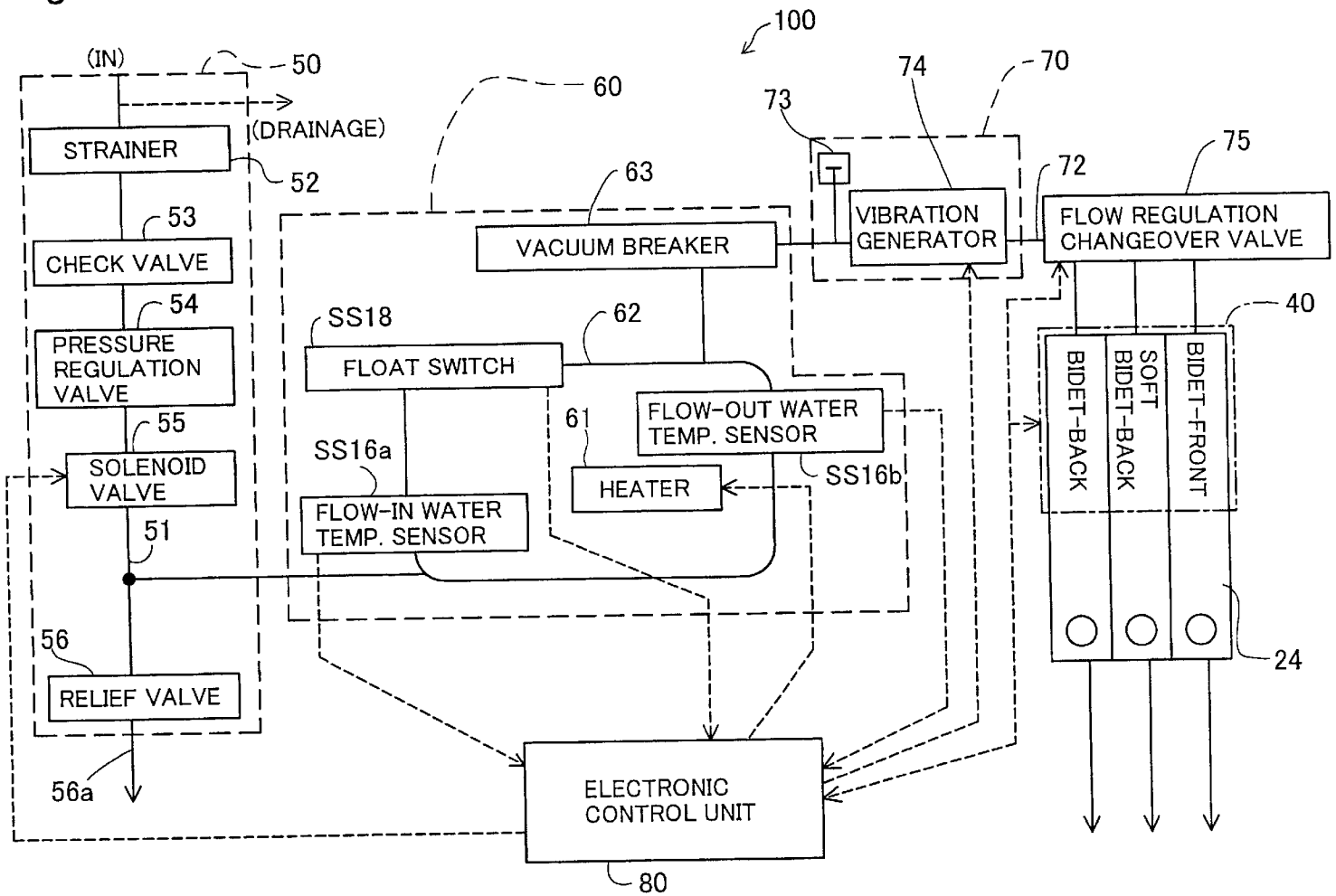
FIG. 51 is a block diagram illustrating the structure of a water flowing line system included in another personal hygiene appliance 100 as a modified example.
Figure 52:
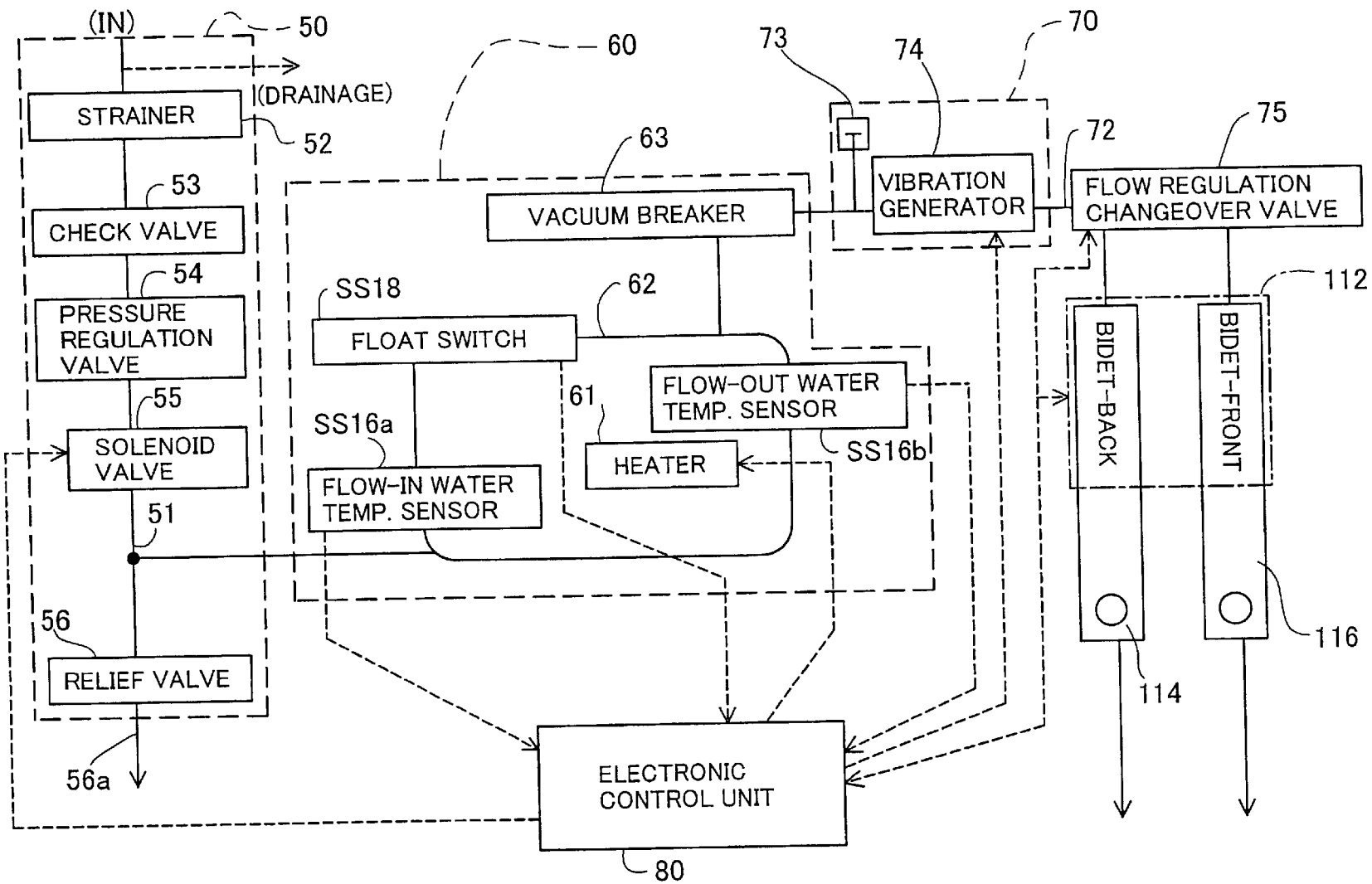
FIG. 52 is a block diagram illustrating the structure of a water flowing line system included in still another personal hygiene appliance 110 as another modified example.
Figure 53:
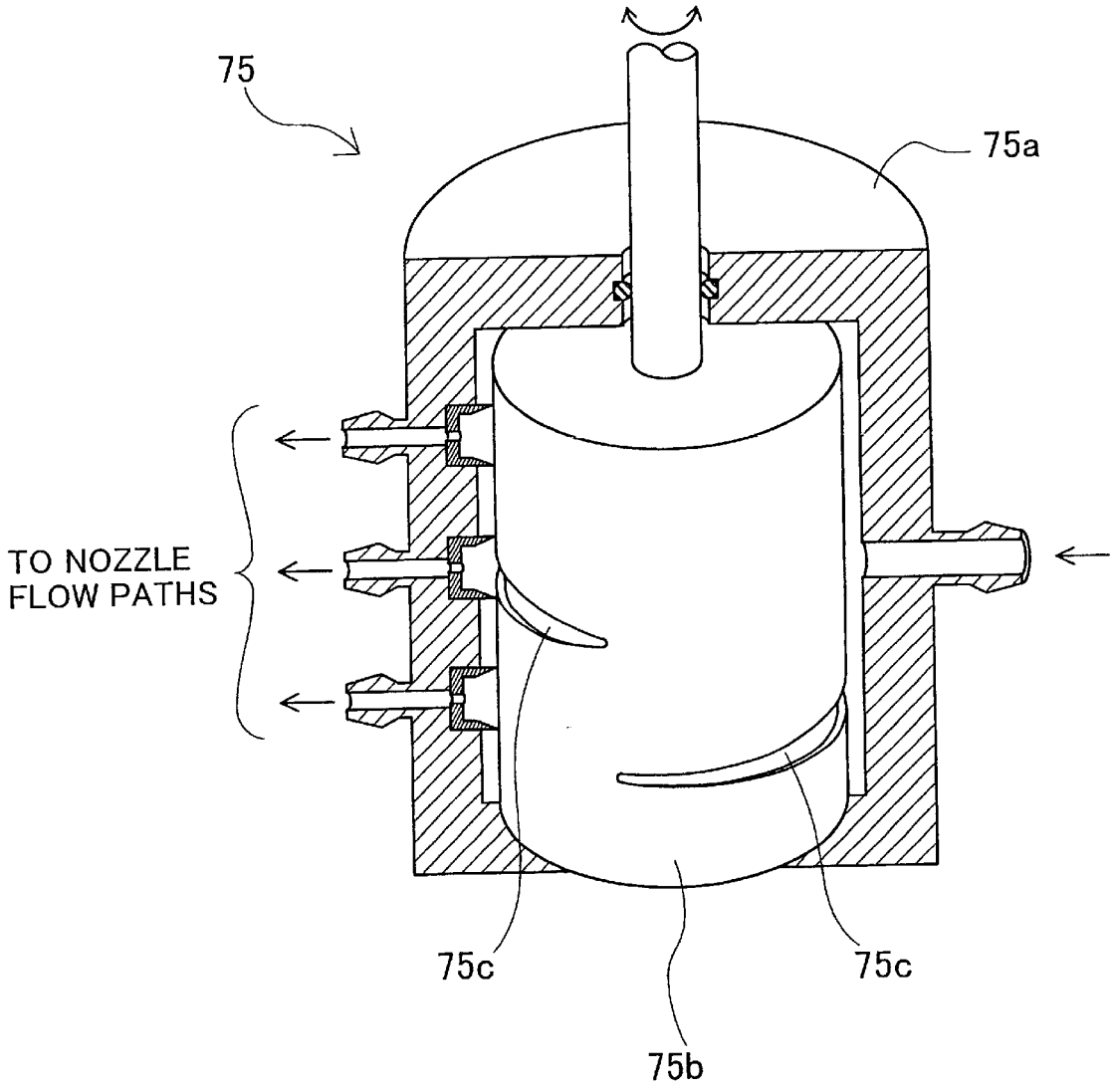
FIG. 53 is a partly broken view schematically illustrating the structure of a flow regulation changeover valve 75 used in these modified examples.
Figure 54:
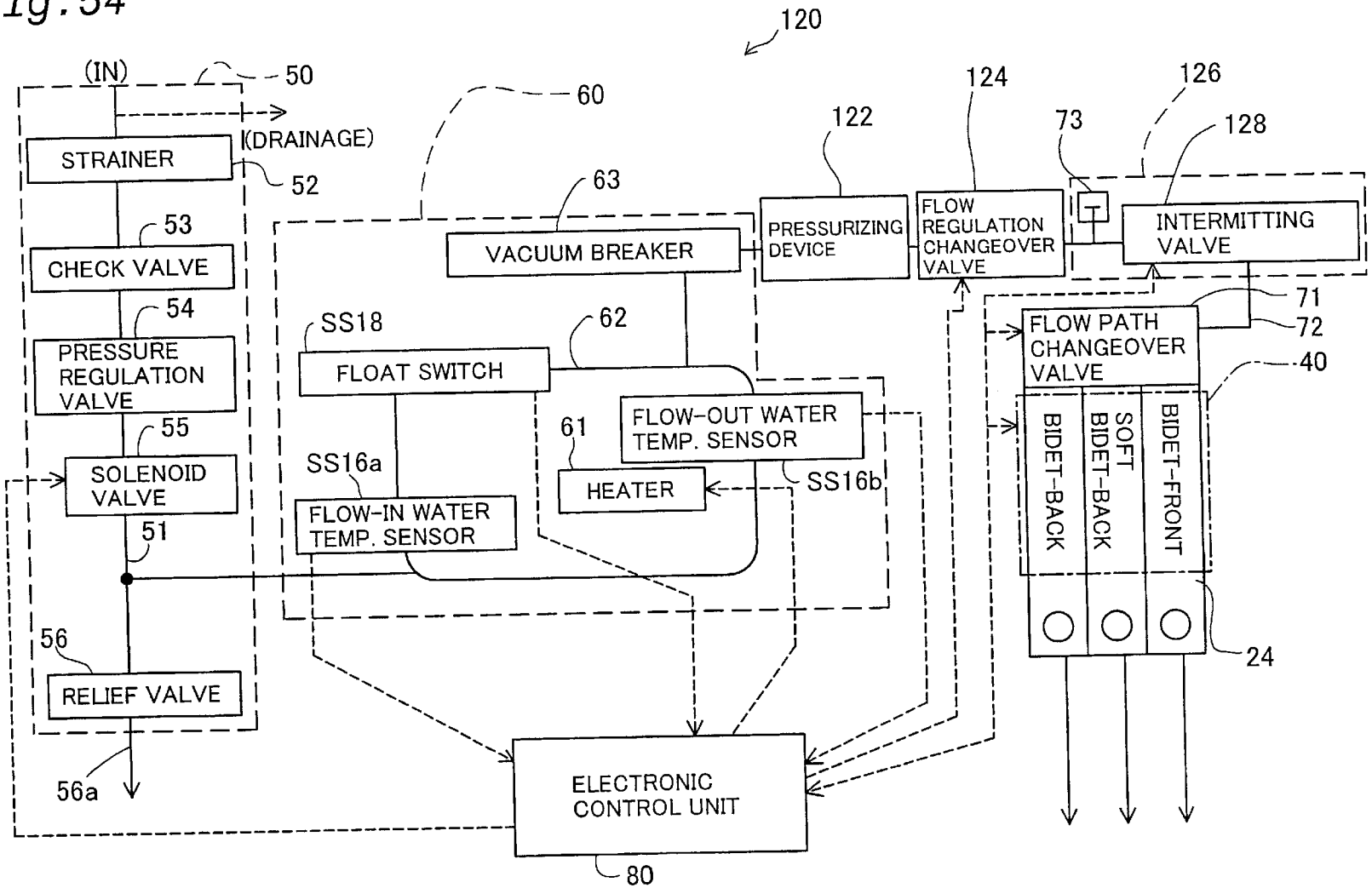
FIG. 54 is a block diagram illustrating the structure of a water flowing line system included in another personal hygiene appliance 120 as still another modified example.
Figure 55A:
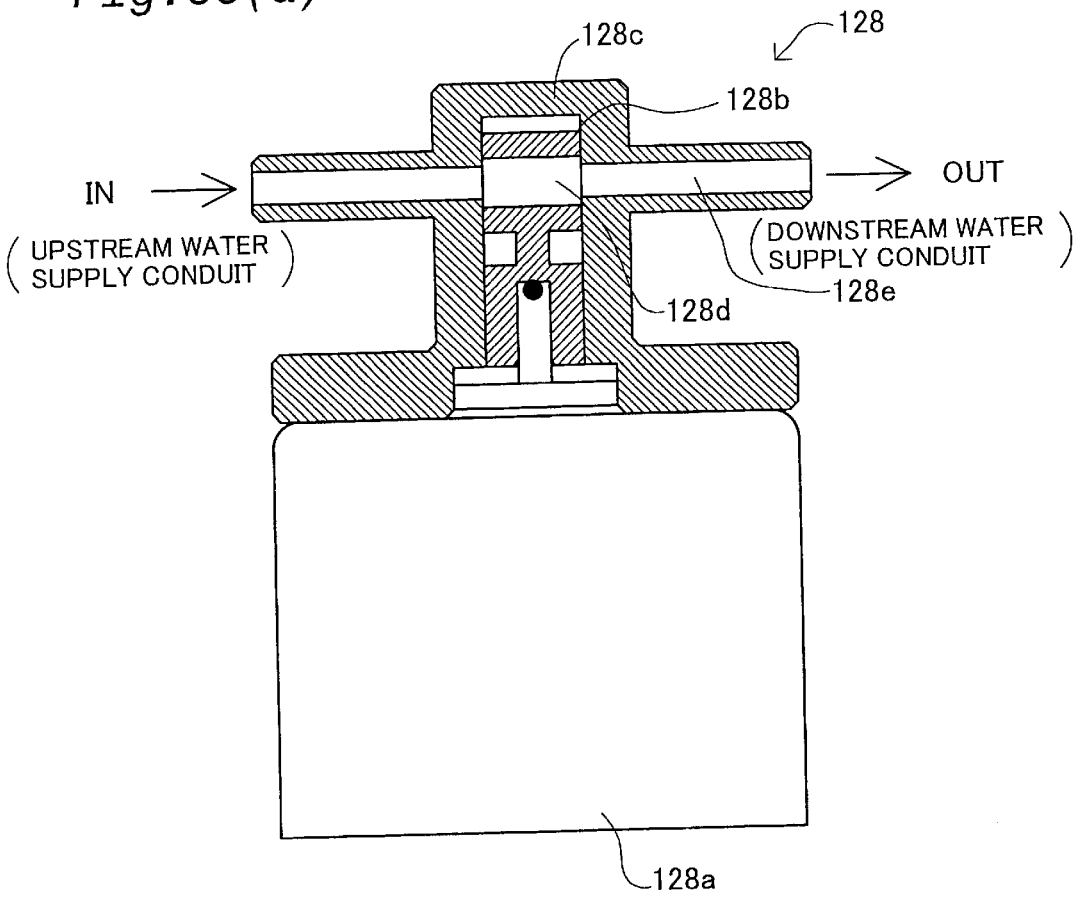
FIG. 55 is a sectional view illustrating the structure of a flow regulation changeover valve 77 disposed in this water flowing line system.
Figure 55B:
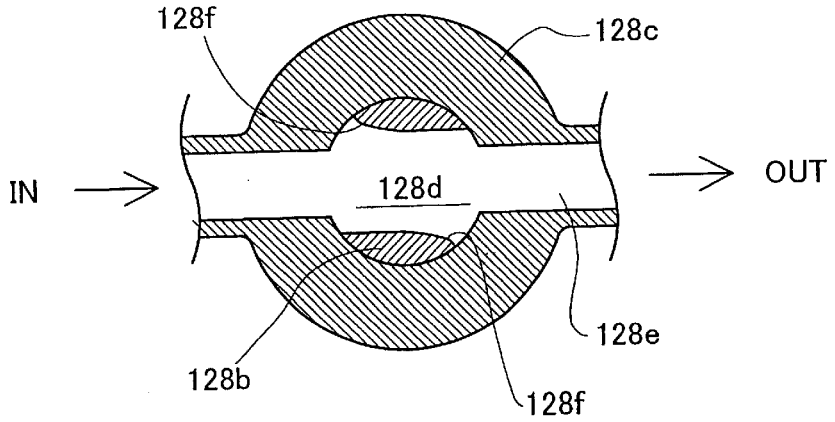
Figure 56:
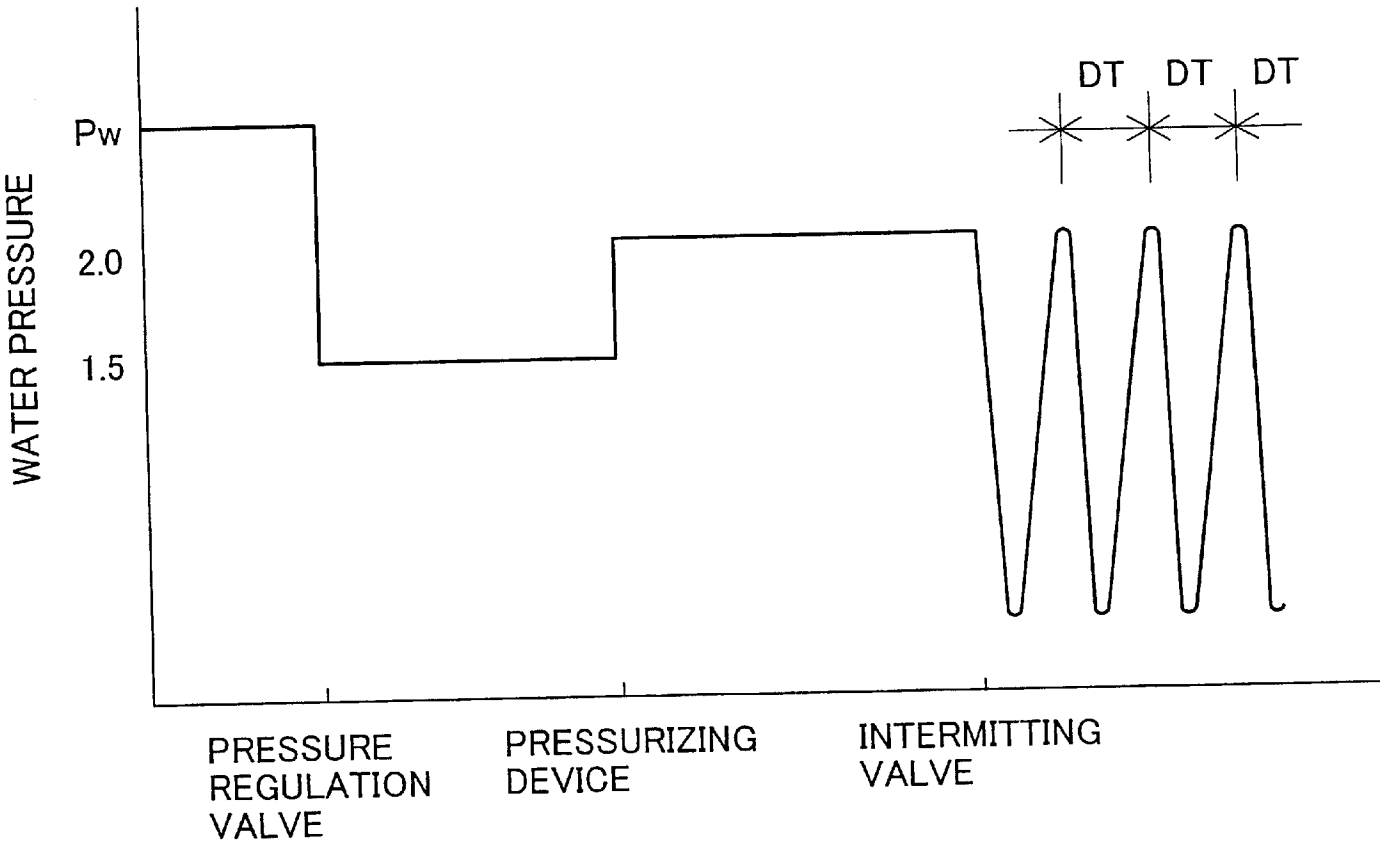
FIG. 56 shows a variation in pressure in the water flowing line system included in the personal hygiene appliance of the modified example having the intermitting valve.
Figure 57:
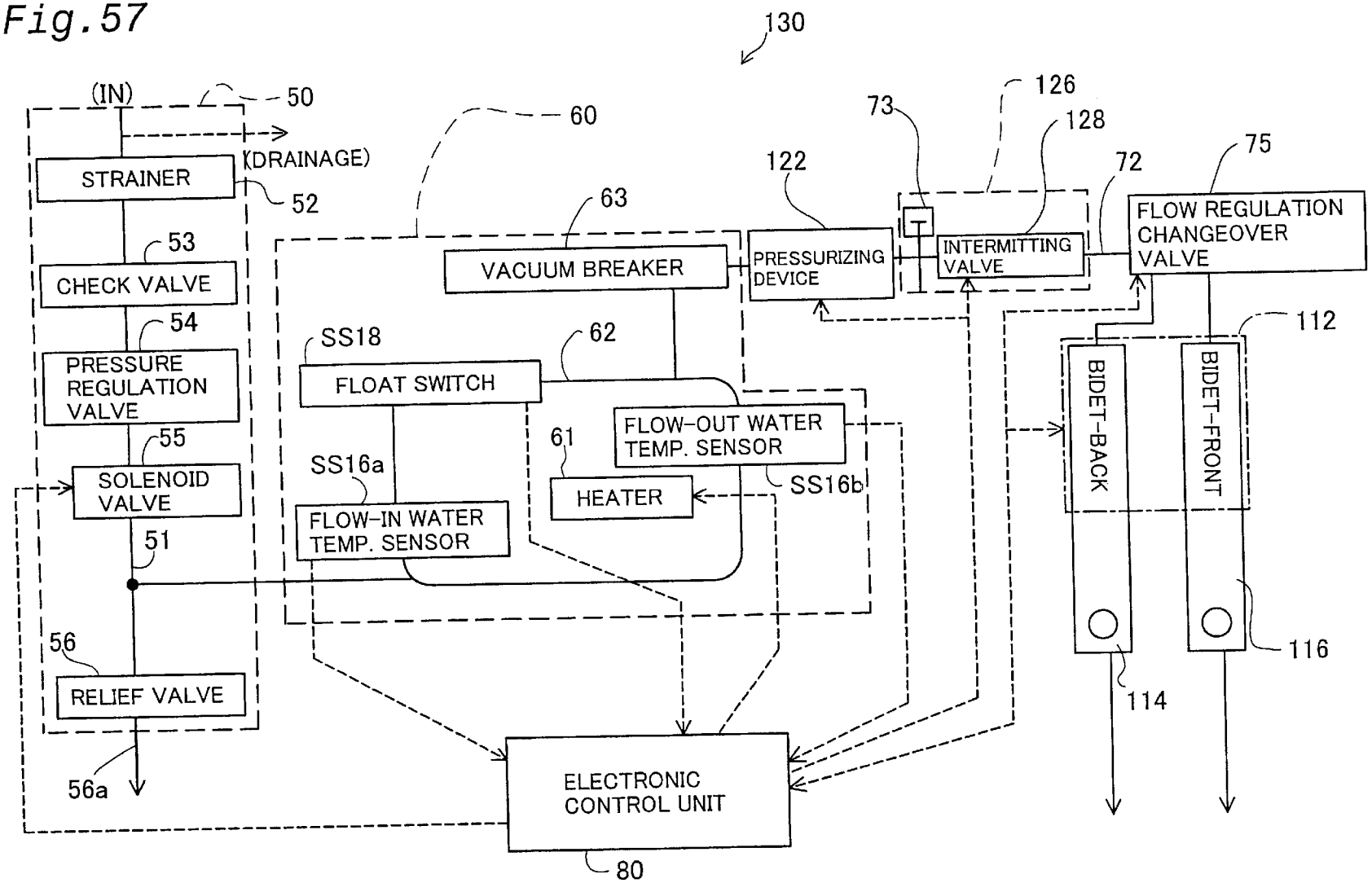
FIG. 57 is a block diagram illustrating the structure of a water flowing line system included in still another personal hygiene appliance as another modified example.

FIG. 51 is a block diagram illustrating the structure of a 10 water flowing line system included in another personal hygiene appliance 100 as a modified example. FIG. 52 is a block diagram illustrating the structure of a water flowing line system included in still another personal hygiene appliance 110 as another modified example. FIG. 53 is a partly broken view schematically illustrating the structure of a flow regulation changeover valve 75 used in these modified examples. FIG. 54 is a block diagram illustrating the structure of a water flowing line system included in another personal hygiene appliance 120 as still another modified example. FIG. 55 is a sectional view illustrating the structure of a flow regulation changeover valve 77 disposed in this water flowing line system. FIG. 56 shows a variation in pressure in the water flowing line system included in the personal hygiene appliance of the modified example having this intermitting valve. FIG. 57 is a block diagram illustrating the structure of a water flowing line system included in still another personal hygiene appliance as another modified example.

(1) In a modified example shown in FIG. 51, the vibration generation unit 70 including the accumulator 73 and the vibration generator 74 is disposed in the downstream of the heat exchange unit 60, and a flow regulation changeover valve 75 is disposed in the downstream of the vibration generation unit 70. The flow regulation changeover valve 75 is separate from the nozzle 24 and functions to change over the destination of the supply of cleansing water among the respective nozzle flow paths formed in the nozzle (the nozzle flow path for bidet-back, the nozzle flow path for gentle bidet-back, and the nozzle flow path for bidet-front) and to regulate the flow rate of the cleansing water flowed through the selected flow path. Namely the flow regulation changeover valve 75 changes over the destination of supply of cleansing water among the respective nozzle flow paths formed in the nozzle and regulates the flow rate of the cleansing water flowed through each flow path. While the structure of the sixth embodiment uses the two valves, that is, the flow regulation valve 65 that regulates the flow rate and the flow path changeover valve 71 that selects one of the nozzle flow paths formed in the nozzle, this modified example requires only one flow regulation changeover valve 75 for the same purpose. This arrangement thus advantageously reduces the number of required parts, the number of steps in assembly, and the manufacturing cost. In the case of application of the nozzle head 200 having the swirling chamber (see FIG. 9), the standard bidet-back ensures the above effects by the spray of the vibrating stream of cleansing water and the suction of the air, whereas the gentle bidet-back and the bidet-front ensure the above effects by the spray of the vibrating stream of cleansing water, the suction of the air, and the swirl of the cleansing water.

In the personal hygiene appliance 100 of this modified structure, the flow path downstream the vibration generation unit 70, that is, the downstream water supply conduit 72 functioning as the flow path between the vibration generation unit 70 and the flow regulation changeover valve 75 and the flow path between the flow regulation changeover valve 75 and the nozzle 24 is composed of a flexible pipe of a higher hardness than the upstream water supply conduit 51 upstream the vibration generation unit 70. Even the flow regulation changeover valve 75 separate from the nozzle 24 effectively prevents the expansion and contraction of the water supply conduits and thereby relieves the possible damping of the vibration due to the expansion and contraction. In this modified example, this arrangement can relieve the damping of the vibrating stream in the flow path and feed the vibrating stream of cleansing water to the nozzle 24.

(2) A personal hygiene appliance 110 in another modified example shown in FIG. 52 has separate nozzles for bidet-back and bidet-front, which are connected with each other via the flow regulation changeover valve 75 discussed above. In this modified example, the flow regulation changeover valve 75 is connected to a nozzle 114 for bidet-back and a nozzle 116 for bidet-front, and functions to change over the destination of the supply of cleansing water between nozzle flow paths formed in the respective nozzles (that is, a nozzle flow path for bidet-back and a nozzle flow path for bidet-front) and to regulate the flow rate of the cleansing water flowed through the selected flow path. Here the nozzles 114 and 116 may have the nozzle head 170 or 170A discussed previously with reference to FIGS. 2 and 3.

Both the nozzle 114 for bidet-back and the nozzle 116 for bidet-front are attached to a nozzle unit 112. The nozzle unit 112 is constructed to separately extend and retract each nozzle between its stand-by position and cleansing position, and is driven and controlled by the electronic control unit 80. The personal hygiene appliance 110 having different nozzles for bidet-back and bidet-front also attains the diverse clean up feeling and water pressure while enhancing the effects of water saving by regulating the vibration frequency ftm and the duty ratio Dtm as discussed above. Like the personal hygiene appliance 100 discussed above, the downstream water supply conduit 72 downstream the vibration generation unit 70 is composed of a flexible pipe having a higher hardness than the upstream water supply conduit 51. In the personal hygiene appliance 110 having separate nozzles for bidet-back and bidet-front, this arrangement can relieve the damping of the vibrating stream in the flow path and feed the vibrating stream of cleansing water to the nozzles for bidet-back and for bidet-front. Application of the nozzle head 170 or 170A having the swirling chamber ensures the above effects by the spray of the vibrating stream of cleansing water, the suction of the air, and the swirl of the cleansing water in the case of standard bidet-back and bidet-front. The nozzle 114 for bidet-back may not have the water swirling chamber 171.

The flow regulation changeover valve 75 used in these modified examples is, for example, a drum-type flow regulation valve as shown in FIG. 53. This flow regulation valve has a drum 75*b* rotatably (both in a normal direction and in a reverse direction) accommodated in a drum casing 75*a*. Water supply grooves 75*c* are formed on the surface of the drum 75*b* corresponding to respective water supply outlets. This valve regulates the overlap of each supply groove formed on the drum and the corresponding water supply outlet, so as to change over the destination of water supply and regulate the flow rate of water flowed to the selected destination. The drum-type flow regulation changeover valve 75 more effectively interferes with damping of the vibration, compared with the changeover valve utilizing the elasticity of an elastic body, such as a diaphragm.

In this modified structure, a nozzle opening and a nozzle flow path for gentle bidet-back may be formed in either one of the nozzle 114 for bidet-back and the nozzle 116 for bidet-front. A nozzle for gentle bidet-back may alternatively be provided separately from these nozzles 114 and 116. The nozzle for gentle bidet-back may have the nozzle head 170 or 170A. This arrangement ensures the above effects by the spray of the vibrating stream of cleansing water, the suction of the air, and the swirl of the cleansing water in the case of gentle bidet-back.

(3) A personal hygiene appliance 120 in still another modified example shown in FIG. 54 is characterized by the spray of cleansing water in the form of an intermittent stream. In this modified example, pressurization of the supply of cleansing water and the downstream intermission of the cleansing water stream generate an intermittent stream of cleansing water with the flow rate momentarily reaching zero. In the water flowing line system of the personal hygiene appliance 120 of this modified example, a pressurizing device 122, a flow regulation valve 124, and an intermittent stream generation unit 126 are disposed in the downstream of the heat exchange unit 60. The stream of cleansing water is sprayed from the nozzle 24 via the flow path changeover valve 71.

The pressurizing device 122 has a pressure pump, such as a line pump, and functions to pressurize the cleansing water fed from the heat exchange unit 60 and supply the pressurized water to the downstream. The pressurizing device 122 has a pump capacity that enhances the primary pressure of about 0.13 MPa {1.3 kgf/cm$^2$} regulated with the pressure control valve 54 to about 0.2 MPa {2 kgf/cm$^2$}. The regulated pressure (about 0.13 MPa {1.3 kgf/cm$^2$}) by the pressure control valve 54 is substantially similar to a conventional level.

The intermittent stream generation unit 126 has an upstream accumulator 73 and an intermitting valve 128 that intermittently connects and disconnects the flow path. As shown in FIG. 55, in the intermitting valve 128, a motor 128*a* rotates a valve disc 128*b* inside a housing 128*c*. The intermitting valve 128 connects an inner valve disc flow path 128*d* with a valve flow path 128*e* at a rotation cycle of the motor 128*a*, so as to intermittently connect and disconnect the flow path. The intermitting valve 128 thus converts the stream of cleansing water pressurized by the pressurizing device 122 into an intermittent output (intermittent stream), and supplies the intermittent stream of cleansing water to the nozzle 24. The process of generating the intermittent stream is described below with the drawing.

Referring to FIG. 56, when a water supply pressure from a water source is Pw, a supply of cleansing water with the lowered pressure of about 0.13 MPa {1.3 kgf/cm$^2$} by the pressure control valve 54 reaches the pressurizing device 122 and is pressurized to about 0.2 MPa {2 kgf/cm$^2$} by the pressuring device 122. The pressurized cleansing water is subjected to cyclical intermission by the intermitting valve 128 and is sprayed as an intermittent stream from the nozzle 24. An intermission cycle DT of the intermittent stream is twice the rotation cycle of the motor 128*a* in the intermitting valve 128 and is varied through the controlled rotation of the motor 128*a* by the electronic control unit 80. In this modified example, a frequency defined by the intermission cycle DT (that is, an intermission frequency) is set to be in the range of unperceptible frequency (not lower than 5 Hz, preferably in the range of 10 to 100 Hz). Like the embodiment discussed above, in the modified example that causes the intermittent stream of cleansing water obtained through intermission of the flow path to be sprayed from the nozzle 24, regulation of the frequency of the spray of cleansing water attains the diverse clean up feeling and the controlled water pressure under the condition of a fixed flow rate of the cleansing water. Combining regulation of the flow rate of the cleansing water with control of the frequency enables the flow velocity of cleansing water to be varied, thus enhancing the diversity of clean up feeling and ensuring the fine adjustment of water pressure. The water pressure can be adjusted by regulating the frequency as mentioned above. Even when there is an insufficiency in quantity of cleansing water, this arrangement ensures the user's desired water pressure. In other words, the desired clean up feeling and water pressure are attained by regulating the frequency of the intermittent stream. This arrangement thus significantly reduces the required quantity of cleansing water.

This modified example has the following advantages. As shown in FIG. 55(*b*), the intermitting valve 128 has inclined elements 128*f* at an opening of the valve disc flow path 128*d*. The inclined elements 128*f* function to gradually shut the valve flow path 128*e* while the valve disc 128*b* is rotated in the direction of blocking the valve flow path 128*e*. This arrangement effectively prevents the occurrence of a water hammer in the course of disconnecting the flow path by driving the intermitting valve for generation of the intermittent stream. Application of the nozzle head 170 or 170A having the swirling chamber to the nozzle attains the effects discussed above by the spray of cleansing water in the intermittent stream, instead of the vibrating stream, the suction of the air, and the swirl of cleansing water.

In this modified example, the intermittent stream has the pressure that is lowered from the maximum pressure (about 0.2 MPa {2 kgf/cm$^2$}), which is obtained through pressure rise by the pressuring device 122, through intermission by the intermitting valve 128. As in the case of the vibrating stream discussed above (see FIG. 19), the vertical shift of the raised pressure by the pressuring device 122 in the intermittent stream enables regulation of the flow rate.

(4) In a personal hygiene appliance 130 in another modified example shown in FIG. 57, the supply of cleansing water is pressurized by the pressurizing device 122 and converted into an intermittent stream of cleansing water by the intermittent stream generation unit 126. The nozzle unit 112 separately extends and retracts the nozzle 114 for bidet-back and the nozzle 116 for bidet-front. The flow regulation changeover valve 75 changes over the flow path to the nozzle and regulates the flow rate. The intermittent stream of cleansing water is sprayed at the regulated flow rate from the nozzle for bidet-back or from the nozzle for bidet-front. In the structure of this modified example, the intermittent stream of cleansing water is sprayed from the separate nozzles 114 and 116 for bidet-back and bidet-front.

Figure 58:
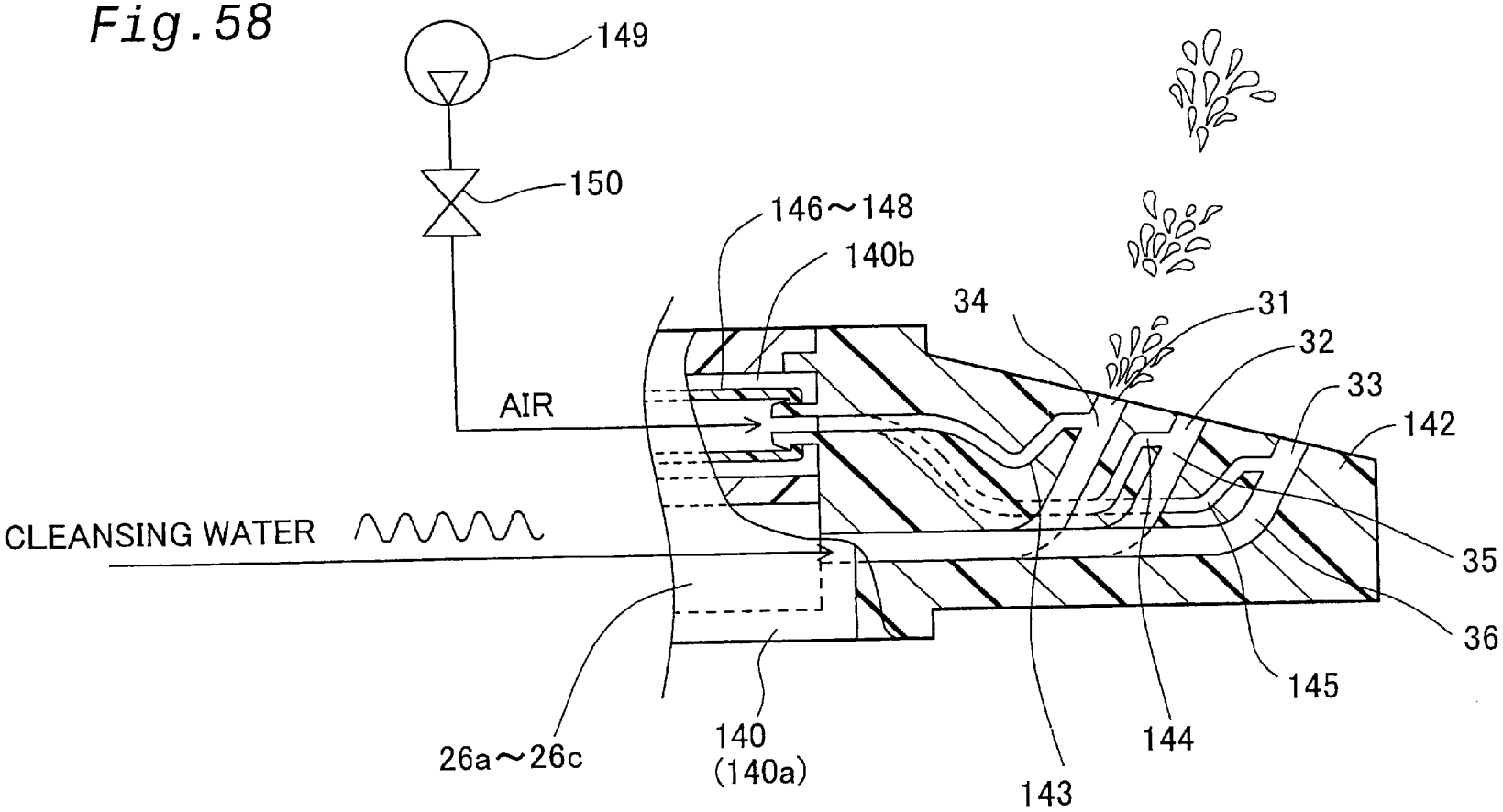
FIG. 58 illustrates the structure of a nozzle 140 in a modified example with forcible suction of the air.
Figure 59:
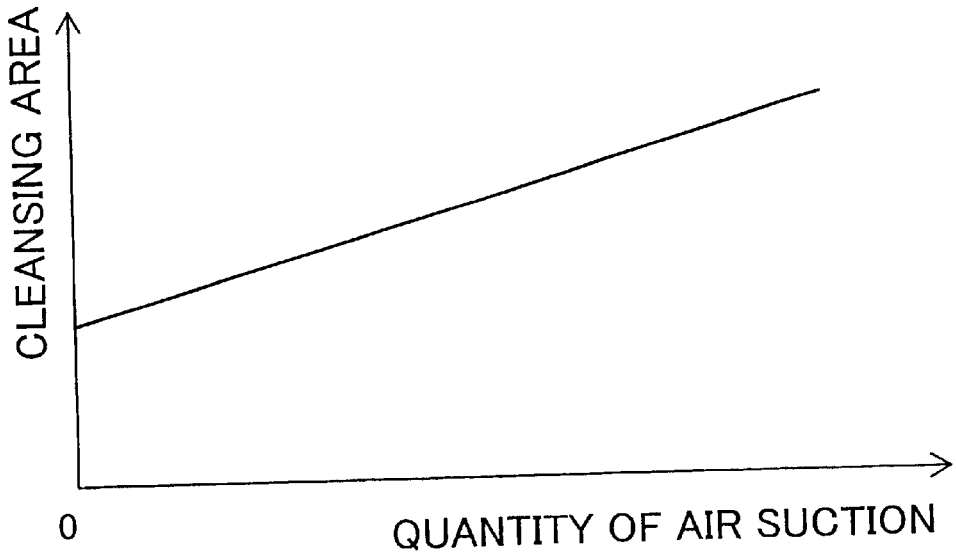
FIG. 59 is a graph showing the relationship between the quantity of the air forcibly supplied into cleansing water and the cleansing area by the spray of cleansing water with the supplied air.
Figure 60:
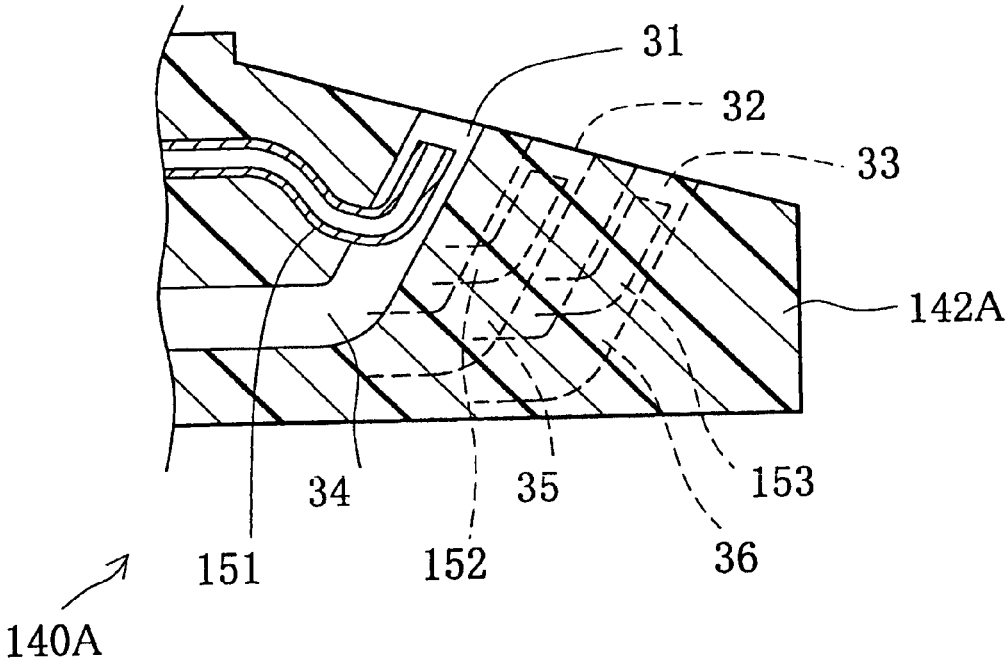
FIG. 60 illustrates the structure of a nozzle 140A in another modified example with forcible suction of the air.

In order to improve the softness of cleansing on the private part, the structure of the sixth embodiment may be modified to forcibly supplied the air into cleansing water. FIG. 58 illustrates the structure of a nozzle 140 in a modified example with forcible suction of the air. FIG. 59 is a graph showing the relationship between the quantity of the air forcibly supplied into cleansing water and the cleansing area by the spray of cleansing water with the supplied air. FIG. 60 illustrates the structure of a nozzle 140A in another modified example with forcible suction of the air.

(1) Referring to FIG. 58, a nozzle 140 in a modified example has a nozzle head 142 with first through third air flow paths 143 through 145 formed therein, which respectively connect with the head flow paths 34 through 36 leading to the nozzle openings 31 through 33 for bidet-back, gentle bidet-back, and bidet-front. These air flow paths 143 through 145 are independently connected to air pipes 146 through 148 in an upper divisional chamber 140*b* of a cylindrical section 140*a* of the nozzle 140. The compressed air that is fed by an air pump 149 under pressure and has the flow rate regulated by an air flow regulation valve 150 is supplied to the respective air pipes 146 through 148. The air flow regulation valve 150 changes over the destination of air supply among the air pipes 146 through 148. The compressed air is accordingly drawn into the selected head flow path via the corresponding air flow path in the nozzle head 142. The vibrating stream or intermittent stream of cleansing water flowing through the selected head flow path is sprayed in the form of water masses and receives a frictional force due to the suction of the compressed air. Suction of the compressed air causes the cleansing water to be sprayed in small water masses as illustrated. The small water masses sprayed from each nozzle opening are not readily joined together.

As clearly understood from the graph of FIG. 59, the water masses are finely dispersed to extend the cleansing area with an increase in flow rate of the air suction. When the quantity of water is reduced to narrow the cleanable zone, this arrangement enables the cleanable zone to be extended by increasing the flow rate of the air. As shown in FIG. 32, the vibrating stream or the intermittent stream of cleansing water sprayed from the nozzle opening grows to large water masses. The arrangement of this modified example reduces the size of the water masses by utilizing the shearing force of the supplied air, thus attaining the gentler clean up feeling. The suction of the air varies the cleanable zone and controls the cleansing power. The suction of the air in combination with the control of the water pressure and the control of the clean up feeling in the vibrating stream or the intermittent stream ensures the finer adjustment of the cleansing power. The arrangement of this modified example reduces the required quantity of cleansing water by the air suction to enhance the water consumption efficiency, while ensuring the clean up feeling of improved softness.

(2) Referring to FIG. 60, in a nozzle 140A of another modified example, first through third air pipes 151 through 153 are inserted respectively into the head flow paths 34 through 36 for bidet-back, gentle bidet-back, and bidet-front in a nozzle head 142A leading to the respective nozzle openings 31 through 33. The first through the third air pipes 151 through 153 are connected to the air pump 149. The compressed air fed from the first through the third air pipes 151 through 153 is directly jetted into cleansing water flowing through the respective head flow paths 34 through 36. This structure enables the air to be drawn directly into the stream of cleansing water, thus further enhancing the effects of dispersing the stream of cleansing water.

Figure 61:
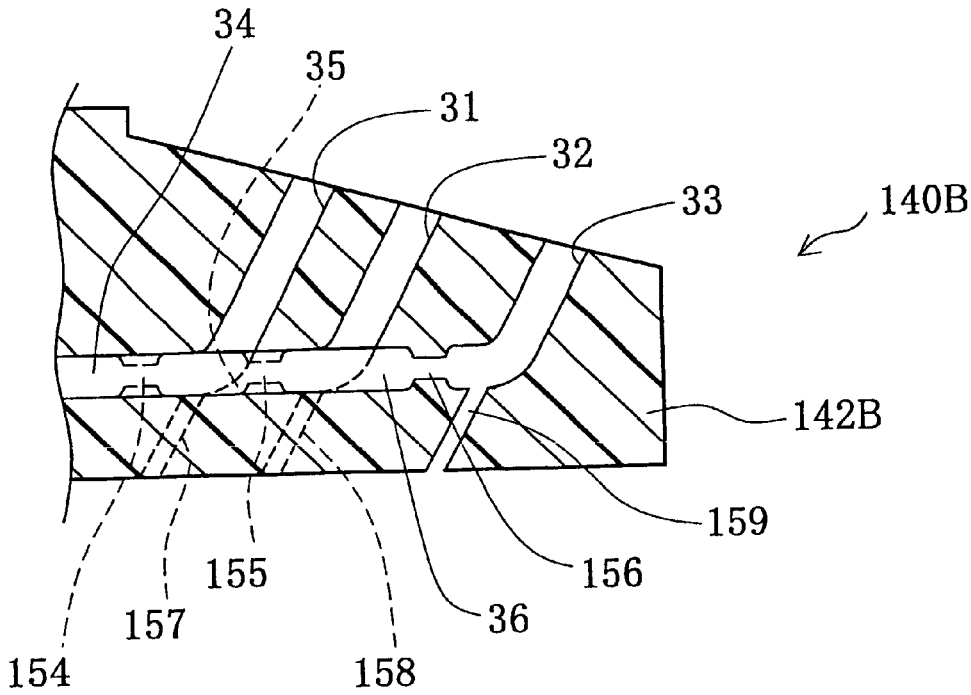
FIG. 61 is a sectional view schematically illustrating the main part of a nozzle in a modified example that attains the spontaneous air suction.
Figure 62:
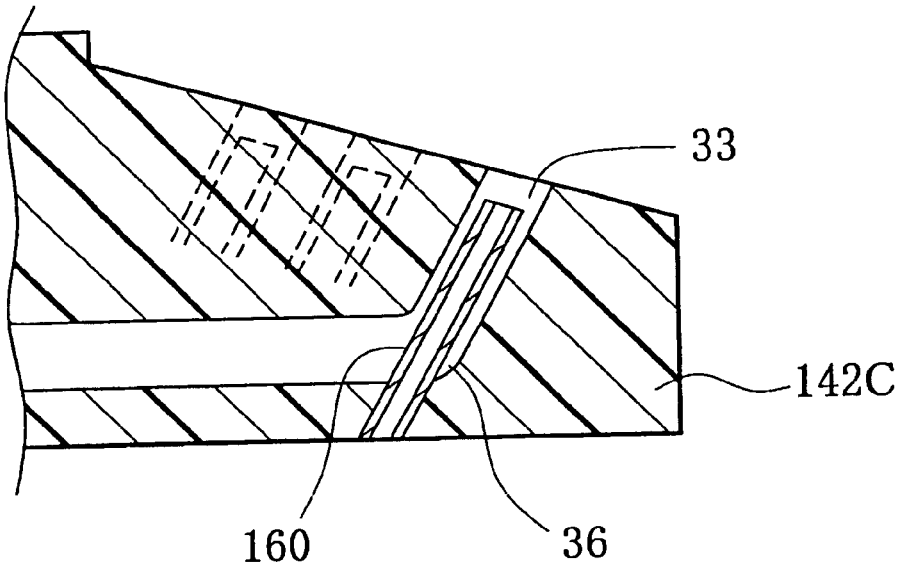
FIG. 62 is a sectional view schematically illustrating the main part of a nozzle in another modified example that attains the spontaneous air suction.
Figure 63:
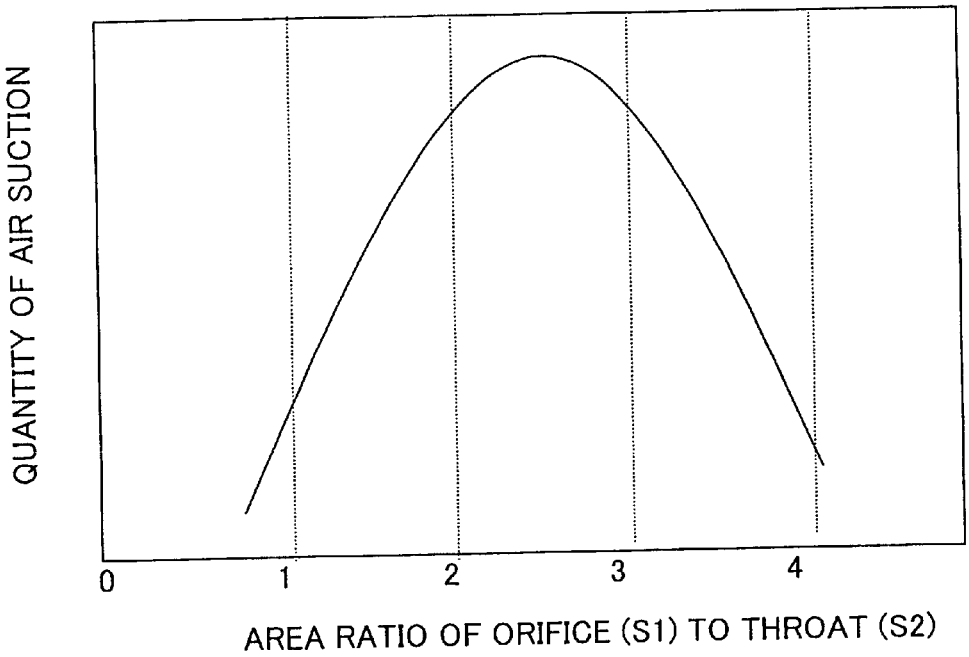
FIG. 63 is a graph showing the air suction characteristics in a nozzle of still another modified example that attains the spontaneous air suction.

The nozzle may be modified to attain the spontaneous air suction by taking advantage of the negative pressure of the cleansing water stream. FIGS. 61 and 62 are sectional views schematically illustrating the main part of nozzles in modified examples that attain the spontaneous air suction. FIG. 63 is a graph showing the air suction characteristics in a nozzle of another modified example that attains the spontaneous air suction (see FIG. 4).

(1) Referring to FIG. 61, a nozzle head 142B included in a nozzle of this modified example has orifices 154 through 156 of narrowed flow path areas formed in parts of the respective head flow paths 34 through 36 for bidet-back, gentle bidet-back, and bidet-front. Air conduits 157 through 159 are formed in the downstream of the orifices to introduce the air from the rear face of the nozzle head. In this structure, the negative pressure is generated when the cleansing water stream flowed out of each orifice increases its flow path area, so that the air is supplied from each of the air conduits 157 through 159 into the cleansing water. This modified example does not require any air pump and thus simplifies the structure. The orifices corresponding to the head flow paths 34 to 36 for bidet-back, gentle bidet-back, and bidet-front may have different diameters. For example, the diameters of the orifices are determined to make the greater quantity of the air supplied for gentle bidet-back and bidet-front than that for bidet-back. This arrangement causes the different quantities of the air to be supplied for bidet-back, gentle bidet-back, and bidet-front, thus changing the clean up feelinguitably for the respective cleansing operations.

(2) In another modified example shown in FIG. 62, a nozzle head 142C has an air pipe 160 disposed in the nozzle flow path 36 for bidet-front. This arrangement also enables the air to be directly introduced into the cleansing water stream. The same structure is applied to the nozzle flow paths for bidet-back and gentle bidet-back.

(3) Application of the nozzle shown in FIG. 4 to the sixth embodiment that sprays the vibrating stream of cleansing water gives another modified example. This modified example adopts the following structure to improve the efficiency of the spontaneous air suction. As a matter of convenience, the explanation regards only one nozzle opening (nozzle opening for bidet-back). The same structure is also applied to the nozzle openings for gentle bidet-back and bidet-front. In this modified example, the nozzle head 161 has the air suction chamber 162. In the nozzle head 161, the orifice 163 formed in the head flow path 34 for bidet-back is arranged to face the nozzle opening 31 for bidet-back across the air suction chamber 162, which has the air conduit 164. This arrangement forms a jet pump, where the cleansing water sprayed from the orifice 163 is a driving fluid, the air introduced through the air conduit 164 is a driven fluid, and the nozzle opening 31 for bidet-back is a throat.

In this modified example, the orifice 163 is arranged in the direction of the spray of cleansing water, thereby relieving the damping of the water pressure. The function of the jet pump increases the quantity of air suction. The arrangement of this modified example reduces the required quantity of cleansing water by the increase in quantity of air suction to enhance the water consumption efficiency, while ensuring the clean up feeling of improved softness. Since the orifice 163 is formed in the direction of the spray of cleansing water, there is no bending of the flow path in the downstream of the orifice, which accordingly causes no collision of cleansing water. This arrangement is thus free from the energy loss and does not lower the flow velocity.

In this modified example, the quantity of air suction was measured with regard to various area ratios (S2/S1) of an orifice diameter S1 to a throat diameter S2. The quantity of air suction was expressed by the ratio of the air to the water (the air mixing rate %) and plotted in a graph. As shown in FIG. 63, the area ratio of 1 to 4 resulted in a large quantity of air suction in the range of 40% to 80%. The arrangement of this modified example that forms the jet pump and sets the area ratio in the range of 1 to 4 increases the quantity of air suction by about 1.2 to 2 times, compared with the arrangement of FIG. 61 that has the orifice and the air conduit. The arrangement of this modified example thus advantageously enhances the water consumption efficiency and ensures the clean up feeling of improved softness. The quantity of air suction was measured in the following manner. A hot-wire air flow meter was connected to an air inlet, and the flow rate of the air was directly measured. The air mixing rate was calculated from the observed flow rate of the air and the flow rate of water supplied to the nozzle, and was plotted as the quantity of air suction in the graph of FIG. 63.

Figure 64:
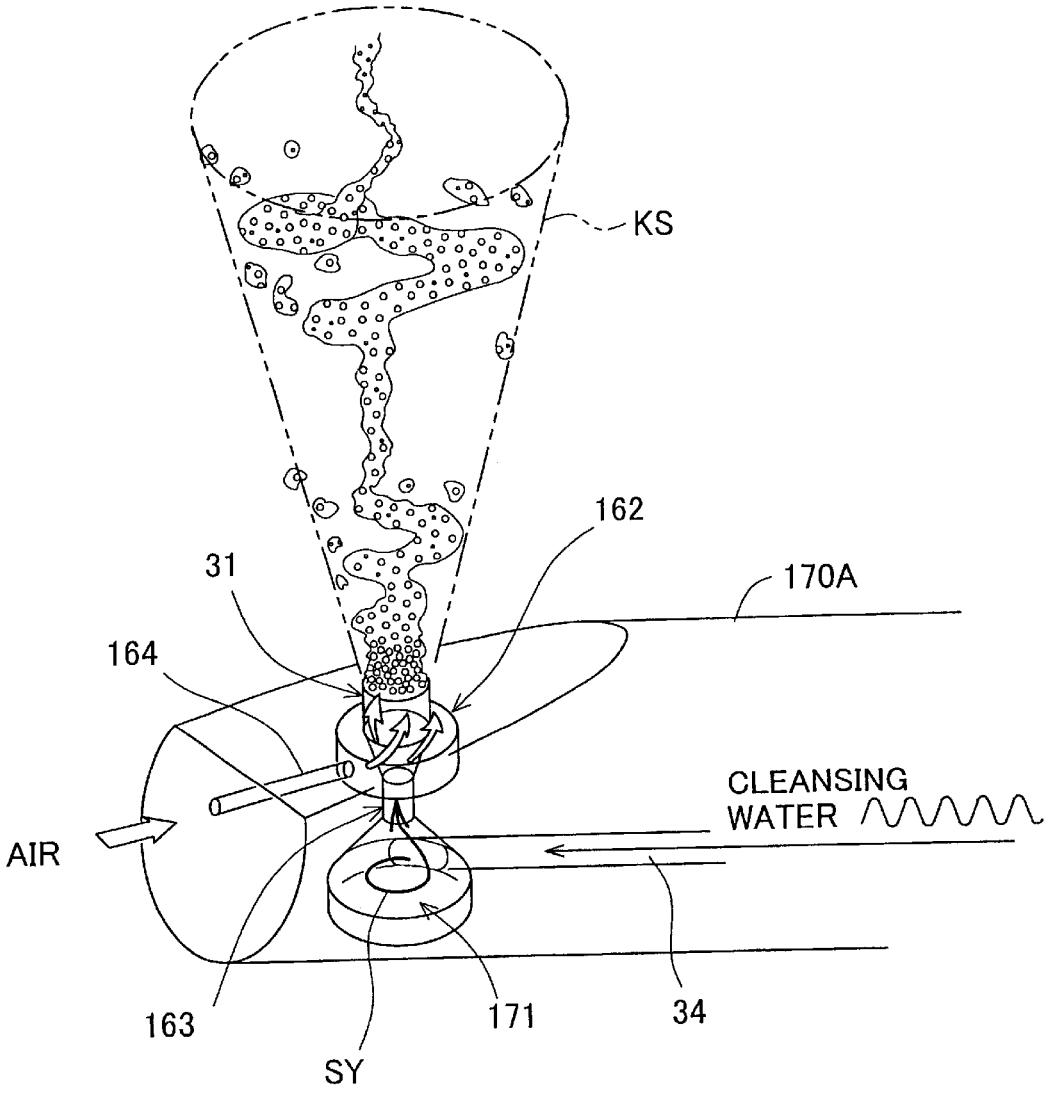
FIG. 64 is a perspective view schematically illustrating the internal structure of another modified example where the nozzle head 170A shown in FIG. 4 is applied to the sixth embodiment.

The following describes still another modification, where the nozzle head 170A shown in FIG. 3 is applied to the sixth embodiment that sprays the vibrating stream of cleansing water. FIG. 64 is a perspective view schematically illustrating the internal structure of this modified example.

In the modified example of FIG. 64, the nozzle head 170A causes the cleansing water to be swirled as shown by the arrow SY and thus to be sprayed in a spiral form as discussed previously in the second embodiment. In this modified example, the vibrating stream or the intermittent stream of cleansing water is fed through the head flow path 34 for bidet-back and is flowed into the water swirling chamber 171. The cleansing water is accordingly sprayed in a spiral form (cone shape) with the supplied air, while keeping the characteristics of the vibrating stream or the intermittent stream. As mentioned previously, the flow-in velocity of cleansing water determines the swirling degree of cleansing water and the degree of air suction. The flow-in velocity of cleansing water is varied by regulating the frequency and the duty ratio of the vibrating stream or the intermittent stream and by adjusting the flow rate with the flow regulation valve. This arrangement thus enables the water spray with wide variations in cleansing area and in quantity of air suction, thus ensuring the comfortable and soft clean up feeling. This arrangement also enables the water pressure to be adjusted under the condition of a low flow rate of the vibrating stream or the intermittent stream.

FIG. 64 shows an instant of the spray of cleansing water. In the actual water spray, this state continues to form an illustrated hollow cone shape KS of cleansing water.

In this modified example, the quantity of air suction was measured by varying the area ratio (S2/S1) of the orifice diameter S1 to the throat diameter S2. The results of the measurement show the effects discussed previously with FIGS. 5 and 6.

The air may forcibly be supplied into the nozzle head 170A of this modified example with an air pump. The use of the air pump raises the quantity of air suction and further enhances the feeling of softness. In the structure that enables forcible air suction, the vibrating stream or intermittent stream of cleansing water may be sprayed with or without the forcible air suction.

The technique of the sixth embodiment may be applied to a variety of existing nozzle heads, other than the nozzle head 170A, the nozzle head 170 shown in FIG. 2, and the nozzle heads 200 and 220 shown in FIGS. 9 through 14. In the case of the nozzle head 220 shown in FIG. 14, the vibrating stream or the intermittent stream of cleansing water may be fed to either one or both of the eccentric flow path 222 and the axial center-directing flow path 223. This arrangement ensures the effects attained by the spray of cleansing water in the vibrating stream or the intermittent stream, in addition to the diversity of clean up feeling, such as soft clean up feeling, corresponding to the swirling degree.

Further modifications are allowed for the structure of the personal hygiene appliance in the above embodiments and their modified examples.

(1) Any pump giving a vibrating output, for example, a gear pump or a trochoid pump, may replace the vibration generator 74 to generate the vibrating stream of cleansing water. In this case, regulating the rotating speed of the pump varies the vibration frequency and adjusts the water pressure. The vibration generator 74 may be driven with AC, and the water pressure is adjusted by regulating the phase angle like the control of the duty ratio as discussed in the above embodiment.

(2) A solenoid-operated valve or a poppet valve that moves a poppet back and forth to open and close a water supply inlet and thereby connect and disconnect the flow path may be used for the intermitting valve 128 that connects and disconnects the flow path to generate the intermittent stream of cleansing water.

Figure 65:
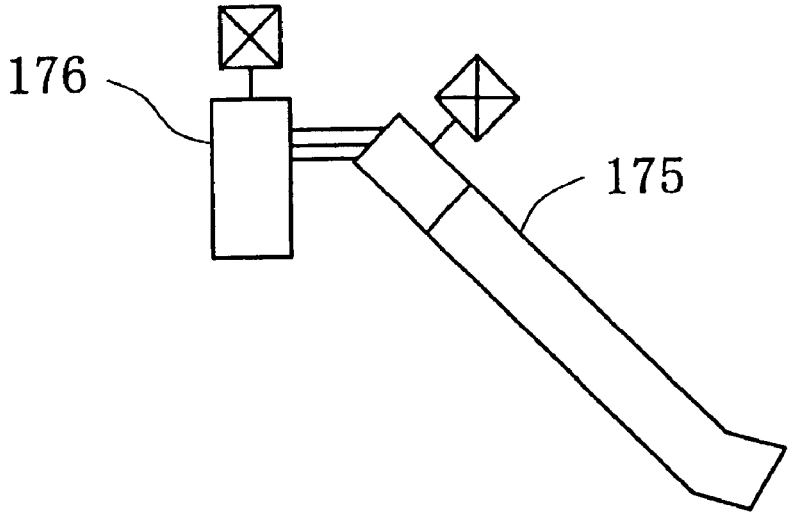
FIG. 65 shows a nozzle 175 in still another modified example.
Figure 66:
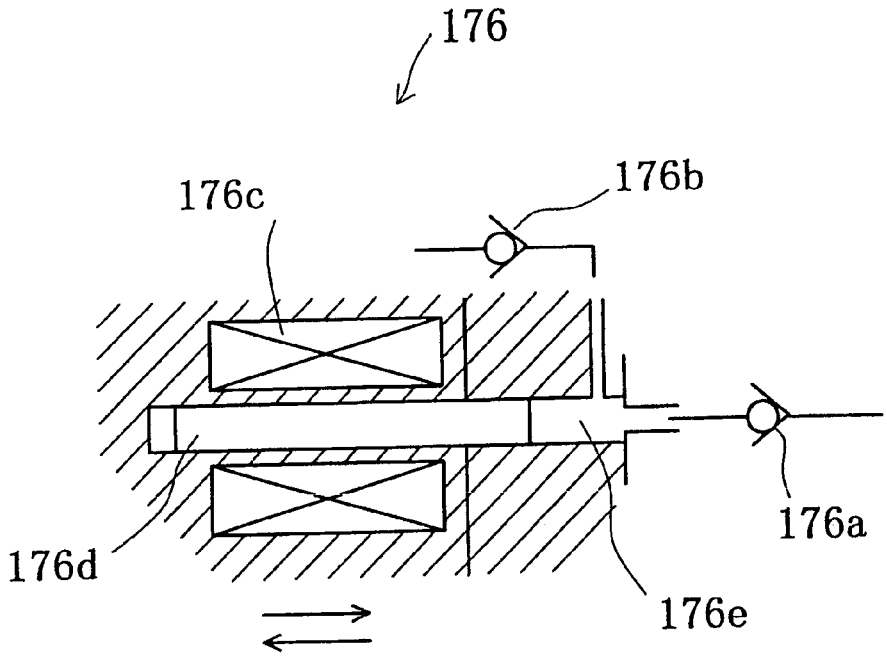
FIG. 66 schematically illustrates the structure of a solenoid pump 176 used in the nozzle 175 of this modified example.

(3) The pressurizing device 122 including the pressure pump, such as the line pump, and the intermitting valve 128, which are separate elements, are used to pressurize the cleansing water and generate the intermittent stream. Any other structures may, however, be applied to pressurize the cleansing water and generate the intermittent stream. FIG. 65 shows a nozzle 175 in still another modified example. FIG. 66 schematically illustrates the structure of a solenoid pump 176 used in the nozzle 175 of this modified example.

The solenoid pump 176 is a conventional flow rate-type electromagnetic pump having an inlet check valve 176*a* and an outlet check valve 176*b*. The solenoid pump 176 excites an electromagnetic solenoid 176*c* to extend and retract a plunger 176*d*, so as to cause an intermittent stream of pressurized water to be flowed out of a pump chamber 176*e*. The solenoid pump is generally used with an accumulator that cancels the intermission of a fluid due to the back and forth movement of the plunger interposed between the inlet check valve and the outlet check valve and makes the pressure curve plateau. The solenoid valve 176 of this modified example, however, does not use the accumulator but utilizes the intermission of the pressure to attain an intermission cycle that is synchronous with the excitation voltage of the electromagnetic solenoid. In this arrangement, only one solenoid pump 176 may function to pressurize the cleansing water and generate the intermittent stream. This simplifies the structure. The excitation cycle of the electromagnetic coil, that is, the intermission cycle, is determined such that the frequency defined by the cycle is within the range of unperceptible frequency described previously.

(4) The pressurizing device 122 and the intermitting valve 128 are used to pressurize the cleansing water and generate the intermittent stream having a cyclic pressure variation with the regulated pressure by the pressure control valve set to the maximum pressure as shown in FIG. 56. The intermittent stream may alternatively have a cyclic pressure variation with the regulated pressure by the pressure control valve set to the minimum pressure. Even when the water source, for example, tap water, has a relatively low pressure, the latter arrangement enables the intermittent stream of cleansing water to be sprayed as discussed above.

(5) In the embodiments and their modified examples discussed above, a conventional continuous stream of cleansing water may be sprayed by stopping the actuation of the vibration generator 74 and the other related constituents. A button may be provided on the remote control 14 or in the rim unit of the main body unit to selectively turn on and off the water spray in the vibrating stream . In response to an operation of this button, the user may desirably select the water spray form for cleansing the private part between the vibrating stream and the continuous stream.

(6) A buffer hot water reservoir may be provided in the downstream of the heat exchange section 62 of the heat exchange unit 60 and used in place of the accumulator 73. The buffer hot water reservoir is located to have a higher water level than that of the heat exchange section 62, and the float switch SS18 and the vacuum breaker 63 are disposed in the buffer water reservoir. Like the accumulator, the buffer hot water reservoir absorbs a variation in pressure propagated from the downstream to the heat exchange section. The buffer hot water reservoir reduces irregularities of the temperature distribution in the heat exchange section by absorbing the pressure variation and makes the temperature in the heat exchange section homogeneous, thus stabilizing the temperature control property. The buffer hot water reservoir may have a stirring plate or a stirring conduit to accelerate stirring of hot water, so as to enhance the effect of absorbing the pressure variation. The buffer hot water reservoir may be integrated with the heat exchange unit. In this case, the stirring plate may be placed in the heat exchange unit.

(7) The temperature of the flow-in water to the heat exchange unit 60 may not be directly observed with the flow-in water temperature sensor but be calculated from the quantity of power supply to the heater 61, for example, the differential power supply to the heater 61. This arrangement does not require the flow-in water temperature sensor and thus simplifies the structure. The flow-in water temperature sensor SS16a and the flow-out water temperature sensor SS16b may be set at any places that reflect the temperature of hot water in the heat exchange section, for example, in the upstream and downstream of the heat exchange unit.

Figure 67:
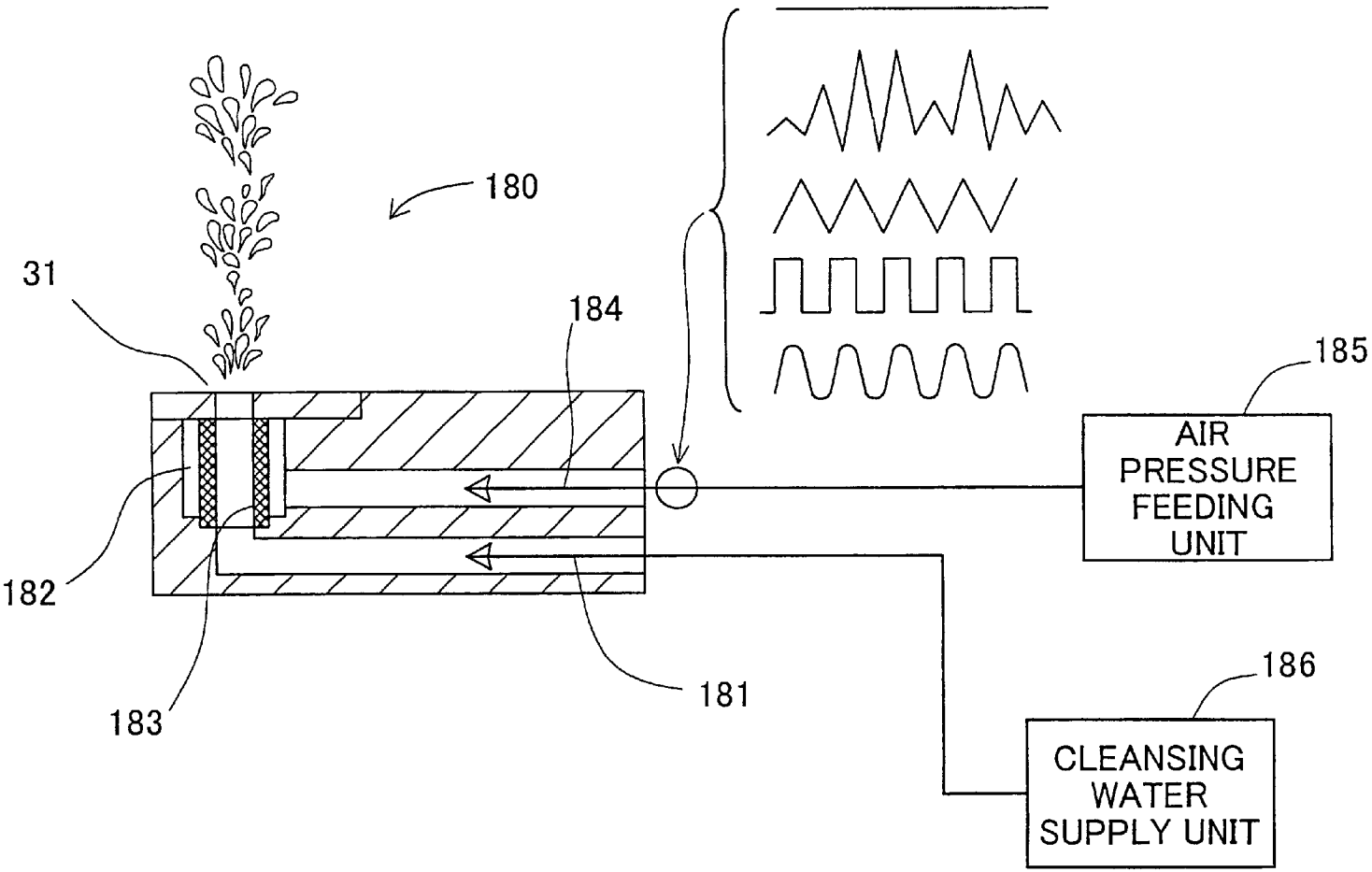
FIG. 67 is a sectional view schematically illustrating the structure of the main part of a nozzle 180 included in a personal hygiene appliance of another modification.

The following describes still another modification. FIG. 67 is a sectional view schematically illustrating the structure of a main part of a nozzle 180 included in the personal hygiene appliance of this modified example. In the following description, the same constituents as those in the embodiments and modified examples discussed above are expressed by the same names and numerals. It is here assumed that the nozzle 180 is used for bidet-back.

The nozzle 180 of this modified example forcibly mixes the air with cleansing water and cyclically varies the quantity of air mixing, so as to cause the vibrating stream or intermittent stream of cleansing water to be sprayed. Referring to FIG. 67, the nozzle 180 has the nozzle opening 31 for bidet-back formed on the end of the nozzle. A supply of cleansing water is flowed through a nozzle flow path 181 and fed to the nozzle opening 31 for bidet-back. An air mixing chamber 182 is formed below the nozzle opening. A porous pipe 183 composed of a resin, metal, or ceramic forms the nozzle flow path in this air mixing chamber 182.

The air mixing chamber 182 connects with an air pressure feeding unit 185 via an air conduit 184. The air pressure feeding unit 185 feeds the air under pressure to the air mixing chamber 182 at a cyclically varying flow rate or at a preset constant flow rate as schematically shown in the drawing, and causes the air to be mixed with cleansing water by means of the porous pipe 183 in the air mixing chamber 182. The porosity of the porous pipe enables the air to be mixed in the form of fine air bubbles with the cleansing water flowing in the pipe. The combination of the porosity of the porous pipe 183 with the feeding of the air under pressure from the air pressure feeding unit 185 enables the air of the four-fold volume at the maximum to be mixed with cleansing water.

The air pressure feeding unit 185 may include a variable-capacity air pump or a combination of a fixed-capacity or variable-capacity air pump with a flow regulation valve disposed in the downstream of the air pump. A combination of the air pump with an on-off valve that is disposed in the downstream of the air pump to open and close the flow path is also applicable for the air pressure feeding unit 185. The air pressure feeding unit 185 having any of such construction feeds the air under pressure while cyclically varying the flow rate of the air. This is attained by regulating the rotating speed of the air pump, by cyclically varying the effective sectional area of the flow path in the range of 0 to 100% or in the range of 10 to 100% with the flow regulation valve, or by cyclically opening and closing the flow path with the on-off valve. A volume-type air pump enables the feeding of the air under pressure to be repeatedly activated and stopped with the operation of the air pump. In this structure, when the effective area of the flow path is set equal to zero with the flow regulation valve, when the flow path is disconnected with the on-off valve, or when the volume-type air pump is deactivated, the stream of cleansing water is cut off and only the air is flowed out of the nozzle opening. This arrangement prevents the air from being mixed with water in the form of fine air bubbles but enables the sequence of water, the air, water, the air . . . to be sprayed in succession. This is substantially equivalent to the spray of cleansing water in the intermittent stream described previously. Mixing the air increases the apparent volume of the water spray and enhances the flow velocity of cleansing water. The cleansing water is sprayed in the form of water masses between the air jets. This ensures the equivalent effects to those of the spray of cleansing water in the form of the vibrating stream.

When water is supplied from a cleansing water supply unit 186 to the nozzle 180 while the feeding of the air under pressure from the air pressure feeding unit 185 is stopped, a continuous stream of cleansing water is sprayed from the nozzle opening 31 for bidet-back. When water is supplied to the nozzle 180 while the air is fed under pressure at a preset constant flow from the air pressure feeding unit 185, a continuous stream of cleansing water with air bubbles mixed at a substantially fixed rate is sprayed from the nozzle opening. Namely this arrangement enables the selection between the spray of cleansing water with the air mixed therein and the spray of cleansing water alone. Mixing the air favorably enhances the water consumption efficiency. Control of the quantity of air mixing and/or control of the flow velocity of cleansing water enables the cleansing water with the air mixed therein at a varying rate to be sprayed in the form of a continuous stream. This ensures the clean up feeling and the water pressure according to the regulated quantity of air mixing and the regulated flow velocity.

The nozzle 180 feeds the air under pressure to be mixed with cleansing water while cyclically varying the flow rate of the air. This arrangement gives the stream of cleansing water, where the portion having a higher quantity of air mixing and the portion having a lower quantity of air mixing are repeated cyclically. The portion having the higher quantity of air mixing has the enhanced flow velocity of cleansing water, whereas the portion having the lower quantity of air mixing has the lower flow velocity. The portion having the higher quantity of air mixing and the enhancedflow flow velocity catches up and joins with the portion having the lower quantity of air mixing and the lower flow velocity. This phenomenon is equivalent to the phenomenon discussed previously with FIG. 32. In the technique of this modified example, the variation frequency is set in the range of unperceptible frequency described previously. Here the variation frequency is defined by the variation cycle, at which the flow rate of the air is cyclically varied in the process of feeding the air under pressure.

This results in the spray of cleansing water in the vibrating stream or intermittent stream according to the cyclic variation in flow rate of the air. The water spray in this modified example is equivalent to that of the above embodiment or the combination of the embodiment with the air suction. In the nozzle 180 of this modified example, the vibrating stream or intermittent stream of cleansing water is mixed with the air and sprayed in the form of small water masses as illustrated. The small water masses sprayed from each nozzle opening are not readily joined together. The nozzle 180 accordingly exerts the similar effects to those of the embodiment discussed above and allows the enhanced water consumption efficiency and diverse settings of clean up feeling and water pressure. In the nozzle 180, the diverse clean up feeling may be attained by regulating the amplitude of the cyclic variation in flow rate of the air and/or the flow velocity of cleansing water. Even when the flow velocity is lowered due to insufficiency of the flow rate of water, such adjustment of the amplitude of the cyclic variation in flow rate of the air fed under pressure enables the water pressure to be varied to and kept at a desirable level.

In the embodiments and their modified examples discussed above, the respective head flow paths for bidet-back, gentle bidet-back, and bidet-front may be formed in a vertical alignment in the nozzle head. This arrangement reduces the width of the nozzle and enables the various constituents and units to be disposed close to one another, thus reducing the size of the whole personal hygiene appliance. The nozzle flow paths may also be formed in a vertical alignment in the nozzle corresponding to the vertically aligned head flow paths. The nozzle head may be designed to have a head cover with the respective nozzle openings that is attached to a base with the respective head flow paths. In this structure, the air conduit may be formed between the base and the head cover.

The present invention is not restricted to the above embodiments or their modifications, but there may be many other modifications, changes, and alterations without departing from the scope or spirit of the main characteristics of the present invention.

For example, the heat exchange unit 60 has the heater 61 of spirally wound Nichrome wire, which is incorporated in the heat exchange section 62 of a small capacity. There are, however, some possible modifications. In the case where a laminated cylindrical ceramic heater is applied for the heater 61, an electrical leak detection circuit and an overheat protection circuit may be printed with a paste on a raw sheet and formed on the surface of the heater by calcination. This arrangement does not require external electrical leak detection circuit or electrical leak protection circuit as well as any overheat protection device like a bimetal. The lamination and the omission of some devices favorably reduce the size of the heat exchange unit 60. The heater 61 may be an electromagnetic induction heater that causes an electromagnetic induction in a resistor due to a variation in magnetic flux in combination with a high-frequency electric current and thereby generates the Joule heat. This arrangement does not require the heater 61 to be submerged in the heat exchange section and does not need an electrical leak protection circuit, thus reducing the size of the heat exchange unit 60. The heater 61 has a high degree of freedom in shape and may be formed along a serpentine water flowing line, thus enabling cleansing water to be heated with a high efficiency.

The heat exchange unit 60 is not restricted to the instantaneous heating type but may be a hot water storage type. The hot water storage type extends the time of a continuous spray of cleansing water at a preset temperature. The cleansing water in the heat exchange section may be heated during no use of the toilet, for example, at midnight. The heater 61 of a low power consumption type is applicable for such heating. This modified structure desirably reduces the maximum power consumption of the personal hygiene appliance. The modification thus lowers the possibility of insufficient capacity of the existing interior wiring and the possibility of requiring a change of the contracted capacity in the case where the personal hygiene appliance is attached to an existing toilet. The hydraulic nozzle may replace the power-driven nozzle discussed in the embodiments. The hydraulic nozzle does not require a nozzle driving motor and is thus relatively inexpensive.

Industrial Applicability

The human body cleaner of the present invention is applicable to a personal hygiene appliance attached to a toilet, a shower in a bathroom, and a diversity of other human body cleaners.

What is claimed is:

1. A human body cleaner that sprays cleansing water to a human body, said human body cleaner comprising:

a nozzle having a nozzle opening;

a water supply unit that supplies cleansing water;

a swirling chamber that is formed in said nozzle and connected with the nozzle opening;

an eccentric conduit that is eccentrically connected with the swirling chamber and makes the cleansing water flown into the swirling chamber; and an axial center-directing conduit that is connected with the swirling chamber toward an axial center of the swirling chamber and makes the cleansing water flown into the swirling chamber, wherein by introducing the cleansing water into the eccentric conduit and the axial center-directing conduit, in the swirling chamber, swirling force around an axial center of the nozzle opening is applied to the supplied cleansing water, and the cleansing water with the swirling force is then led to the nozzle opening to be sprayed with the swirling force from the nozzle opening, and wherein said water supply unit regulates the flow rate of the cleansing water to be introduced into said eccentric conduit and the axial center-directing conduit to vary a degree of the swirling force applied to the supplied cleansing water.

2. A human body cleaner that sprays cleansing water to a human body, said human body cleaner comprising:

a nozzle having a nozzle opening;

a water supply unit that supplies cleansing water;

a swirling chamber that is formed in said nozzle and connected with the nozzle opening;

an eccentric conduit that is eccentrically connected with the swirling chamber and makes the cleansing water flown into the swirling chamber;

an axial center-directing conduit that is connected with the swirling chamber toward an axial center of the swirling chamber and makes the cleansing water flown into the swirling chamber; and an air conduit that is connected with said swirling chamber so as to introduce air to said swirling chamber from the outside, wherein by introducing the cleansing water into the eccentric conduit and the axial center-directing conduit, in the swirling chamber, swirling force around an axial center of the nozzle opening is applied to the supplied cleansing water, and the cleansing water with the swirling force is then led to the nozzle opening to be sprayed with the swirling force from the nozzle opening, and wherein said air conduit introduces air into the cleansing water, prior to the spray of the cleansing water with the swirling force from the nozzle opening.

* * * * *

UNITED STATES PATENT AND TRADEMARK OFFICE

CERTIFICATE OF CORRECTION

PATENT NO. : 6,754,912 B1
DATED : June 29, 2004
INVENTOR(S) : Hayashi et al.

It is certified that error appears in the above-identified patent and that said Letters Patent is hereby corrected as shown below:

Column 6,
Line 22, change “in the as stream” to -- in the stream --.

Colum 20,
Line 54, change “disposed upstream downstream” to -- disposed downstream --.

Column 22,
Line 12, change “of he body” to -- of the body --.

Column 31,
Line 12, change “that easures” to -- that measures --.

Column 40,
Line 11, change “cycle Ti” to -- cycle T1 --.

Column 61,
Line 32, change “10 water flowing” to -- water flowing --.

Column 70,
Line 66, change “enhancedflow flow” to -- enhanced flow --.

Signed and Sealed this

Ninth Day of November, 2004

JON W. DUDAS
*Director of the United States Patent and Trademark Office*